US011155937B2

(12) United States Patent
Su et al.

(10) Patent No.: US 11,155,937 B2
(45) **Date of Patent: *Oct. 26, 2021**

(54) METHODS AND COMPOSITIONS FOR COOLING YARNS AND FABRICS, AND ARTICLES COMPRISING SAME

(71) Applicant: BRRR! INC., Atlanta, GA (US)

(72) Inventors: Hung-Yuan Su, Taoyuan (TW); Ying-Pin Wei, HsinChu County (TW)

(73) Assignee: BRRR! Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/802,528

(22) Filed: Feb. 26, 2020

(65) Prior Publication Data

US 2020/0208305 A1 Jul. 2, 2020

Related U.S. Application Data

(63) Continuation of application No. 16/264,611, filed on Jan. 31, 2019, now Pat. No. 10,597,798.
(Continued)

(51) Int. Cl.
*D01F 8/12* (2006.01)
*D01F 8/02* (2006.01)
(Continued)

(52) U.S. Cl.
CPC ..... *D01F 8/02* (2013.01); *D01F 1/10* (2013.01); *D01F 8/12* (2013.01); *D01F 8/14* (2013.01);
(Continued)

(58) Field of Classification Search
CPC ..... D01F 8/02; D01F 1/10; D01F 8/12; D01F 8/14; D10B 2201/00; D10B 2201/20;
(Continued)

(56) References Cited

U.S. PATENT DOCUMENTS 2,855,758 A 5/1956 Johnson
4,343,334 A 8/1982 Schulze et al.
(Continued)

FOREIGN PATENT DOCUMENTS

WO 2012062480 5/2012

OTHER PUBLICATIONS

International Search Report issued for PCT/US2019/066045, dated Mar. 5, 2020.

*Primary Examiner* — Matthew D Matzek
(74) *Attorney, Agent, or Firm* — Innovators Legal

(57) ABSTRACT

In one aspect, the disclosure relates to composite fibers having a structure comprising a core component and sheath component, wherein each of the core component and the sheath layer independently comprise a polymer and a disclosed cooling composition. In various further aspects, the present disclosure pertains to single-covered yarn comprising a core yarn comprising a disclosed composite fiber comprising a core component and a sheath component. In still further aspects, the present disclosure pertains to a fabric, such as a denim fabric, comprising a disclosed single-covered yarn. This abstract is intended as a scanning tool for purposes of searching in the particular art and is not intended to be limiting of the present disclosure.

20 Claims, 13 Drawing Sheets

Related U.S. Application Data

(60) Provisional application No. 62/785,768, filed on Dec. 28, 2018.

(51) Int. Cl.

| | |
|---|---|
| ***D01F 8/14*** | (2006.01) |
| ***D02G 3/32*** | (2006.01) |
| ***D01F 1/10*** | (2006.01) |
| ***D03D 15/47*** | (2021.01) |

(52) U.S. Cl.
CPC ..... *D02G 3/32* (2013.01); *D03D 15/47* (2021.01); *D10B 2201/02* (2013.01); *D10B 2331/04* (2013.01); *D10B 2401/02* (2013.01); *D10B 2501/00* (2013.01)

(58) Field of Classification Search
CPC ..... D10B 2201/22; D10B 2201/24; D10B 2331/02; D10B 2331/04; D10B 2401/02; D10B 2501/00
USPC ..... 428/373, 375; 977/773, 775–777, 779; 442/361, 364
See application file for complete search history.

(56) References Cited

U.S. PATENT DOCUMENTS

| | | | | |
|---|---|---|---|---|
| 8,093,160 | B2 | 1/2012 | Tharpe, Jr. et al. | |
| 10,337,128 | B2 * | 7/2019 | Su | D01F 1/10 |
| 10,557,219 | B1 * | 2/2020 | Su | D01F 8/14 |
| 10,597,798 | B1 * | 3/2020 | Su | D03D 15/56 |
| 2007/0026228 | A1 | 2/2007 | Hartmann et al. | |
| 2008/0299855 | A1 | 12/2008 | Morihashi | |
| 2009/0068463 | A1 | 3/2009 | Mochizuki et al. | |
| 2013/0133353 | A1 | 5/2013 | Araujo et al. | |
| 2015/0038040 | A1 | 2/2015 | Gabbay | |
| 2017/0342606 | A1 | 11/2017 | Takagi et al. | |
| 2018/0151795 | A1 | 5/2018 | Cobanoglu et al. | |
| 2018/0245249 | A1 * | 8/2018 | Yenici | D04B 1/18 |
| 2018/0347084 | A1 | 12/2018 | Lawrence | |

* cited by examiner

METHODS AND COMPOSITIONS FOR COOLING YARNS AND FABRICS, AND ARTICLES COMPRISING SAME

CROSS-REFERENCE TO RELATED APPLICATIONS

This Application is a continuation of, and claims the benefit of, co-pending U.S. patent application Ser. No. 16/264,611, filed Jan. 31, 2019, and which U.S. patent application Ser. No. 16/264,611 claims the benefit of U.S. Provisional Application No. 62/785,768, filed on Dec. 28, 2018, each of which is incorporated herein by reference in its entirety.

BACKGROUND

Denim is thought to have derived its name from a French fabric called "serge de Nimes" that was worn in the 16th century and has a twill weave similar to the denim fabric of today. The durability and flexible application of denim led to it becoming popular in England in the $17^{th}$ century. Another fabric that gained popularity during the same time period was a cotton corduroy fabric that originated in Genoa, Italy and which was called jean, derived from its place of origin. At the time, denim was made of two different threads of cotton, one colored and one white, while jean used two threads of cotton of the same color. It seems that the two fabrics became synonymous during this period and became known by both names.

The fabric traveled to North America, and American textile factories were producing denim/jean in the late 1700s. The book, "The Weavers Draft Book and Clothiers Assistant," published in 1792, contains technical sketches of the weaving methods for a variety of denims. The popularity of denim was secured in the success of the Levi Strauss Company, who patented the riveting process to produce denim work pants in 1873 and sold them to miners in San Francisco. The pants were known for their comfort, durability and ability to hold their shape. In "Staple Cotton Fabrics" by John Hoye, published in 1942, denim was described as, "The most important fabric of the work-clothing group . . . . Denims are strong and serviceable; they are particularly strong in the warp direction, where the fabric is subjected to greater wear than the filling."

The widespread appeal of denim, especially in pants, based on their comfortable shape and durability overshadows drawbacks of this material such as poor drying, lack of stretch, rough hand feel and poor thermal conductiveness. Denim enhancements have led to the combination of spandex to soften the fabric and give it stretch. Other yarns have also been added to improve the softness and hand feel of the fabric. However, little has been done to improve the wicking, drying and thermal conductivity of the fabric. Denim naturally absorbs moisture, but does not effectively remove it away from the skin. The fabric becomes "swampy"—moist and hot—when worn in warm environments or while active, holding on to the moisture and the heat generated by the person wearing the material.

Thus, despite advances in textile research, there remains an important need for yarns that can be utilized in denim that address the know shortcomings of this fabric, such as poor wicking, drying time, and thermal conductiveness, while maintaining the hand feel and function. These needs and other needs are satisfied by the present disclosure.

SUMMARY

In accordance with the purpose(s) of the disclosure, as embodied and broadly described herein, the disclosure, in one aspect, relates to composite fibers having a core component and a sheath component, wherein each of the core component and the sheath component independently comprise a polymer and a disclosed cooling composition.

Disclosed are cooling compositions comprising aluminum, calcium, copper, iron, magnesium, potassium, silicon, silver, sodium, titanium, zirconium, and combinations thereof.

Also disclosed are cooling polymer compositions comprising a polymer and a cooling composition comprising aluminum, calcium, copper, iron, magnesium, potassium, silicon, silver, sodium, titanium, zirconium, and combinations thereof.

Also disclosed are composite fibers comprising a core component and a sheath component, wherein: (a) the core component comprises a polyester polymer and a first cooling composition; and (b) the sheath component comprises a polyamide polymer and a second cooling composition; wherein the first cooling composition is present in an amount from about 0.1 wt % to about 25 wt % based on the total weight of the polyester polymer and the first cooling composition; wherein the first cooling composition comprises aluminum, calcium, copper, iron, magnesium, potassium, silicon, silver, sodium, titanium, zirconium, and combinations thereof; wherein the second cooling composition is present in an amount from about 0.1 wt % to about 35 wt % based on the total weight of the polyamide polymer and the second cooling composition; and wherein the second cooling composition comprises aluminum, calcium, copper, iron, magnesium, potassium, silicon, silver, sodium, titanium, zirconium, and combinations thereof.

Also disclosed are single-covered yarns comprising: (a) a core fiber comprising a disclosed composite fiber; and (b) a first fiber comprising a cellulosic fiber; wherein the first yarn is wound around the core yarn to form a single covered yarn.

Also disclosed are double-covered yarns comprising: (a) an elastic core comprising an elastic yarn; (b) a first fiber comprising a disclosed composite fiber; and (c) a second fiber comprising a cellulosic fiber; wherein the first fiber is wound around the elastic core to form a single covered yarn; and wherein the second fiber is wound around the single covered yarn to form a double covered yarn.

Also disclosed are fabrics comprising: a weft yarn comprising a disclosed single-covered yarn or a disclosed double-covered yarn; and a warp yarn comprising cotton fibers. In a further aspect, the present disclosure pertains to a denim fabric, comprising a weft yarn comprising a disclosed single-covered yarn or a disclosed double-covered yarn; and a warp yarn comprising a cotton fibers.

Also disclosed are articles comprising a yarn comprising a core component and a sheath layer, where: (a) the core component comprises a polyester polymer and a first cooling composition; and (b) the sheath layer comprises a polyamide polymer and a second cooling composition; wherein the first cooling composition comprises aluminum, calcium, copper, iron, magnesium, potassium, silicon, silver, sodium, titanium, zirconium, and combinations thereof; and wherein the second cooling composition independently comprises aluminum, calcium, copper, iron, magnesium, potassium, silicon, silver, sodium, titanium, zirconium, and combinations thereof.

Also disclosed are articles comprising a disclosed single-covered yarn

Also disclosed are articles comprising a disclosed double-covered yarn.

Also disclosed are articles comprising a disclosed fabric.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE FIGURES

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 1A shows a side on cross-sectional view of a portion of a disclosed composite fiber with a cross-sectional view of an end thereof. An enlarged view of the cross-sectional end view is highlighted. A key is shown beneath the views indicating the gray-scale colors associated with a sheath layer, a core component, and distribution of one or more cooling compositions in each of the sheath layer and core component. FIG. 1B shows a cross-sectional view of a disclosed composite fiber, 100, with aspects specified as follows: a polyester core, 110; a first cooling composition, 112; a polyamide sheath, 115; and a second cooling composition, 117. FIG. 1C shows a cross-sectional view of a disclosed composite fiber, 120, with aspects specified as follows: a polyester core, 110; a polyamide sheath, 115; and a second cooling composition, 117. FIG. 1D shows a cross-sectional view of a disclosed composite fiber, 130, with aspects specified as follows: a polyester core, 110; a first cooling composition, 112; and a polyamide sheath, 115.

FIG. 2A shows the disclosed fabric at one magnification, with a 1 mm scalar bar shown in the lower left of the image. FIG. 2B shows the disclosed fabric at a higher magnification compared to FIG. 2A, with a 200 μm scalar bar shown in the lower left of the image.

FIG. 3A shows the disclosed warp yarn at one magnification, with a 200 μm scalar bar shown in the lower left of the image. FIG. 3B shows the disclosed warp yarn at a higher magnification compared to FIG. 3A, with a 100 μm scalar bar shown in the lower left of the image.

FIG. 4A shows the disclosed weft yarn at one magnification, with a 200 μm scalar bar shown in the lower left of the image. FIG. 4B shows the disclosed weft yarn at a higher magnification compared to FIG. 4A, with a 100 μm scalar bar shown in the lower left of the image. FIG. 4C shows a cross-sectional view of a disclosed double covered yarn with the various components as labeled therein. A 100 μm scalar bar is shown in the lower right of FIG. 4C.

FIG. 6A shows a schematic cross-sectional view of a disclosed single-covered yarn comprising a cellulosic fiber (e.g., a viscose rayon) wrapped around one or more composite fibers. FIG. 6B shows a cross-sectional view of a disclosed single-covered yarn, 1000, with aspects specified as follows: (a) a plurality of core fibers, 100*a*-100*d*, each comprising a disclosed composite fiber, such as that shown in FIG. 1B, comprising a core component comprising a polyester polymer and a first cooling composition, and a sheath layer comprising a polyamide polymer and a second cooling composition; and (b) a plurality of first fibers, 200*a*-200*n*, comprising a cellulosic fiber; such that the plurality of first fibers are wound around the plurality of core fibers to form a single-covered yarn.

FIG. 7A shows a schematic cross-sectional view of a disclosed double-covered yarn comprising a cellulosic fiber (e.g., a viscose rayon), a composite fiber, and an elastic core (e.g., a spandex yarn). FIG. 7B shows a cross-sectional view of a disclosed double-covered yarn, 2000, with aspects specified as follows: (a) an elastic core, 500, comprising an elastic yarn; (b) a plurality of first fibers, 100*a*-100*h*, each comprising a disclosed composite fiber, such as that shown in FIG. 1B, comprising a core component comprising a polyester polymer and a first cooling composition, and a sheath layer comprising a polyamide polymer and a second cooling composition; and (c) a plurality of second fibers, 600*a*-600*h*, comprising a cellulosic fiber; such that the plurality of first fibers are wound around the elastic core to form a single-covered yarn; and the plurality of second fibers are wound around the single-covered yarn to form a double-covered yarn.

FIG. 9A shows the disclosed weft yarn at one magnification, with a 500 μm scalar bar shown in the lower right of the image. FIG. 9B shows the disclosed weft yarn at the same magnification as shown in FIG. 9A, with a 500 μm scalar bar shown in the lower right of the image.

Figure 1A:
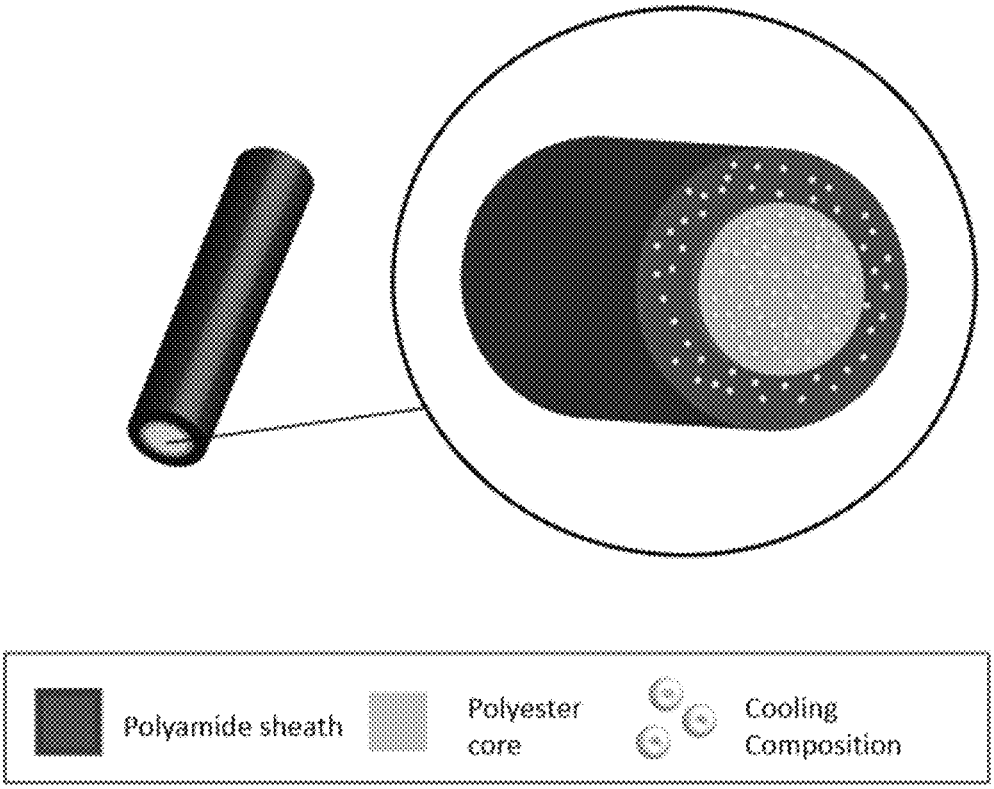
FIGS. 1A-1D show representative schematic views of a disclosed composite fiber.

Additional advantages of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Many modifications and other embodiments disclosed herein will come to mind to one skilled in the art to which the disclosed compositions and methods pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. The skilled artisan will recognize many variants and adaptations of the aspects described herein. These variants and adaptations are intended to be included in the teachings of this disclosure and to be encompassed by the claims herein.

Although specific terms are employed herein, they are used in a generic and descriptive sense only and not for purposes of limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure.

Any recited method can be carried out in the order of events recited or in any other order that is logically possible. That is, unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

All publications mentioned herein are incorporated herein by reference to disclose and describe the methods and/or materials in connection with which the publications are cited. The publications discussed herein are provided solely for their disclosure prior to the filing date of the present application. Nothing herein is to be construed as an admission that the present invention is not entitled to antedate such publication by virtue of prior invention. Further, the dates of publication provided herein can be different from the actual publication dates, which can require independent confirmation.

While aspects of the present disclosure can be described and claimed in a particular statutory class, such as the system statutory class, this is for convenience only and one of skill in the art will understand that each aspect of the present disclosure can be described and claimed in any statutory class.

It is also to be understood that the terminology used herein is for the purpose of describing particular aspects only and is not intended to be limiting. Unless defined otherwise, all technical and scientific terms used herein have the same meaning as commonly understood by one of ordinary skill in the art to which the disclosed compositions and methods belong. It will be further understood that terms, such as those defined in commonly used dictionaries, should be interpreted as having a meaning that is consistent with their meaning in the context of the specification and relevant art and should not be interpreted in an idealized or overly formal sense unless expressly defined herein.

Prior to describing the various aspects of the present disclosure, the following definitions are provided and should be used unless otherwise indicated. Additional terms may be defined elsewhere in the present disclosure.

A. Definitions

As used herein, "comprising" is to be interpreted as specifying the presence of the stated features, integers, steps, or components as referred to, but does not preclude the presence or addition of one or more features, integers, steps, or components, or groups thereof. Additionally, the term "comprising" is intended to include examples and aspects encompassed by the terms "consisting essentially of" and "consisting of." Similarly, the term "consisting essentially of" is intended to include examples encompassed by the term "consisting of."

As used herein, the term "produced from" is synonymous to "comprising". As used herein, the terms "comprises," "comprising," "includes," "including," "has," "having," "contains" or "containing," or any other variation thereof, are intended to cover a non-exclusive inclusion. For example, a composition, process, method article, or apparatus that comprises a list of elements is not necessarily limited to only those elements but may include other elements not expressly listed or inherent to such composition, process, method, article, or apparatus.

The transitional phrase "consisting of" excludes any element, step, or ingredient not specified. If in the claim, such a phrase would close the claim to the inclusion of materials other than those recited except for impurities ordinarily associated therewith. When the phrase "consisting of" appears in a clause of the body of a claim, rather than immediately following the preamble, it limits only the element set forth in that clause; other elements are not excluded from the claim as a whole.

The transitional phrase "consisting essentially of" is used to define a composition, method or apparatus that includes materials, steps, features, components, or elements, in addition to those literally discussed, provided that the additional materials, steps features, components, or elements do not materially affect the basic and novel characteristic(s) of the claimed invention. The term "consisting essentially of" occupies a middle ground between "comprising" and "consisting of".

Further, unless expressly stated to the contrary, "or" refers to an inclusive "or" and not to an exclusive "or". For example, a condition A "or" B is satisfied by any one of the following: A is true (or present) and B is false (or not present), A is false (or not present) and B is true (or present), and both A and B are true (or present).

As used in the specification and the appended claims, the singular forms "a," "an" and "the" include plural referents unless the context clearly dictates otherwise. Thus, for example, reference to "a polymer," "a yarn," or "a fabric,"

including, but not limited to, two or more such polymers, yarns, or fabrics, and the like. Therefore "a" or "an" should be read to include one or at least one, and the singular word form of the element or component also includes the plural unless the number is obviously meant to be singular.

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

When a range is expressed, a further aspect includes from the one particular value and/or to the other particular value. For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range. To further illustrate, when a range of "1 to 5" is recited, the recited range should be construed as including ranges "1 to 4", "1 to 3", "1-2", "1-2 & 4-5", "1-3 & 5", and the like.

As used herein, the terms "about," "approximate," "at or about," and "substantially" mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In such cases, it is generally understood, as used herein, that "about" and "at or about" mean the nominal value indicated ±10% variation unless otherwise indicated or inferred. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

The terms "decrease", "reduced", "reduction" "decrease" or "inhibit" are all used herein generally to mean a decrease by a statistically significant amount. However, for avoidance of doubt, "reduced", "reduction" or "decrease" or "inhibit" means a decrease by at least 10% as compared to a reference level, for example a decrease by at least about 20%, or at least about 30%, or at least about 40%, or at least about 50%, or at least about 60%, or at least about 70%, or at least about 80%, or at least about 90% or up to and including a 100% decrease (e.g. absent level as compared to a reference sample), or any decrease between 10-100% as compared to a reference level.

The terms "increased", "increase" or "enhance" or "activate" are all used herein to generally mean an increase by a statically significant amount; for the avoidance of any doubt, the terms "increased", "increase" or "enhance" or "activate" means an increase of at least 10% as compared to a reference level, for example an increase of at least about 20%, or at least about 30%, or at least about 40%, or at least about 50%, or at least about 60%, or at least about 70%, or at least about 80%, or at least about 90% or up to and including a 100% increase or any increase between 10-100% as compared to a reference level, or at least about a 2-fold, or at least about a 3-fold, or at least about a 4-fold, or at least about a 5-fold or at least about a 10-fold increase, or any increase between 2-fold and 10-fold or greater as compared to a reference level.

The term "statistically significant" or "significantly" refers to statistical significance and generally means at least two standard deviation (2SD) away from a reference level. The term refers to statistical evidence that there is a difference. It is defined as the probability of making a decision to reject the null hypothesis when the null hypothesis is actually true.

As used herein the terms "weight percent," "wt %," and "wt. %," which can be used interchangeably, indicate the percent by weight of a given component based on the total weight of a composition of which it is a component, unless otherwise specified. That is, unless otherwise specified, all wt % values are based on the total weight of the composition. It should be understood that the sum of wt % values for all components in a disclosed composition or formulation are equal to 100. Alternatively, if the wt % value is based on the total weight of a subset of components in a composition, it should be understood that the sum of wt % values the specified components in the disclosed composition or formulation are equal to 100.

As used herein, the term "effective amount" refers to an amount that is sufficient to achieve the desired modification of a physical property of the composition or material. For example, an "effective amount" of a cooling composition refers to an amount that is sufficient to achieve the desired improvement in the property modulated by the cooling composition, e.g. achieving the desired enhancement in Qmax compared to a yarn or fabric without the effective amount. The specific level in terms of wt % in a composition required as an effective amount will depend upon a variety of factors including the amount and type of polymer and yarn, fabric use, and the like.

As used herein, the terms "optional" or "optionally" means that the subsequently described event or circumstance can or cannot occur, and that the description includes instances where said event or circumstance occurs and instances where it does not.

The term "microscale" as used herein comprises a surface having a measurable feature in the range of from about 1 to about 1000 μm.

The term "nanoscale" as used herein comprises a surface having a measurable feature in the range of from about 1 to about 1000 nm.

The term "nanoparticle" as used herein comprises a nanoscale deposit of a homogenous or heterogeneous material. Nanoparticles may be regular or irregular in shape and may be formed from a plurality of co-deposited particles that form a composite nanoscale particle. Nanoparticles may be generally spherical in shape or have a composite shape formed from a plurality of co-deposited generally spherical particles. Exemplary shapes for the nanoparticles include, but are not limited to, spherical, rod, elliptical, cylindrical, disc, and the like. In some embodiments, the nanoparticles have a substantially spherical shape.

As used herein, reference to an element, e.g., a core component comprises Al, Ca, Cu, Fe . . . Zr" or "a core component comprises aluminum, calcium, copper, iron . . . zirconium," is intended to be inclusive of any form or valency of the element as appropriate for a given compound or material in which the element is part of the composition of the compound or material, unless otherwise specified. That is, it is understood that a reference to a particular element in a composition or material is inclusive of ionic forms of the element in typical oxidation states for that element if the composition or material comprises the element as an ionic compound; covalently bonded forms of the element if the composition or material comprises the element as an covalent compound; and elemental forms (i.e., oxidation state of 0) as suitable or appropriate for the indicated if the composition or material comprises the element in an oxidation state of 0, e.g., Al as metallic aluminum.

As used herein, the term "transition metal" means an element whose atom has a partially filled d sub-shell, or which can give rise to cations with an incomplete d sub-shell, typically found in Groups 3-12 of the periodic table in Periods 4-7. Exemplary, but non-limiting, transition metals include titanium, vanadium, chromium, manganese, iron, cobalt, nickel, copper, zinc, yttrium, zirconium, silver, tungsten, platinum, and gold.

As used herein, "nanosilver" and "nanosilver oxide," can be used interchangeably, and refer to silver oxide (i.e., silver (I) oxide, silver (II) oxide, or combinations thereof) in which the silver oxide is in a form comprising substantially a particulates, a powder, or combinations thereof, in which the particles and/or powder are nano-sized. That is the particles or powder, as appropriate, generally have a size of about 1 nm to about 1000 nm.

The term "denier" or abbreviated as "d" as used herein will be understood to be a relative measure of a fineness (or linear density) of a fiber or yarn. Denier is equivalent numerically to the weight in grams per 9,000 meters length of the material. The term "decitex" is another measure of a fineness of a fiber, which is equivalent to the weight in grams of a 10,000 meter length of the material.

As used herein, "multicomponent" refers to a fiber composed of more than one polymer.

As used herein, the term "fiber" refers to refers to any slender, elongated structure that can be carded, combed, or otherwise formed into a thread or filament. A fiber can comprise a natural material (e.g., cotton, linen or wool) or an artificial material (e.g., nylon, polyester). A fiber is a material in which the length to diameter ratio is greater than about 10. Fiber is typically classified according to its fineness. Fiber is generally defined as having a fiber fineness greater than about 15 denier, usually greater than about 30 denier. Fine denier fiber generally refers to a fiber having a fineness less than about 15 denier. Examples of fibers include "staple fibers", a term that is well-known in the textile art. A reference to "fiber" of "fibers" may mean or include individual fibers or a plurality or bulk of fibers as the situation requires. A plurality of fibers may comprise fibers of different compositions or may be substantially uniform in composition. Thus, by way of illustration, a reference to "natural fiber" or "synthetic fiber" may mean and may include a single fiber of such type, or may mean any quantity or plurality of such fibers and they may be comprised in threads, felts, yarns, fabrics materials etc., all as will be apparent from the context.

The fiber can be a synthetic fiber or a natural or organic fiber. As one of skill in the art is well aware, smoothness of the outer surfaces is significantly varied between different fibers. Accordingly, the outer surface of the fiber can be smooth or rough. By way of example only, manmade fibers, such as polyester fibers, usually have a smooth outer surface. In contrast, natural fibers, such as cotton, usually have a rough outer surface. One consequence of the roughness of the outer surface is that rough surfaces take more fluid to completely cover the surface per unit diameter.

As used herein, "fiber" refers to any one of the various types of matter that form the basic elements of a textile and that is characterized by a flexible, macroscopically homogeneous body having a high ratio of length to width and being small in cross section, and may include one or more fibrous materials (e.g., fibers or filaments). It is understood that "fiber" includes "filaments."

As used herein, "filament" refers generally to a continuous fiber of extremely long length, whereas a "staple fiber" means a fiber of finite length. A staple fiber can be a natural fiber or a fiber cut from, for example, a filament.

As used herein, "natural fibers" refer to fibers which are obtained from natural sources, such as cellulosic fibers and protein fibers, or which are formed by the regeneration of or processing of natural occurring fibers and/or products. Natural fibers are not intended to include fibers formed from petroleum products. Natural fibers include fibers formed from cellulose, such as cotton fiber and regenerated cellulose fiber, commonly referred to as rayon, or acetate fiber derived by reacting cellulose with acetic acid and acetic anhydride in the presence of sulfuric acid. As used herein, "natural fibers", are intended to include natural fibers in any form, including individual filaments, and fibers present in yarns, fabrics and other textiles, while "individual natural fibers" is intended to refer to individual natural filaments.

As used herein, the term "cellulosic fiber" is intended to refer to a fiber comprising cellulose, and include, but are not limited to, cotton, linen, flax, rayon, cellulose acetate, cellulose triacetate, hemp and ramie fibers.

As used herein, the term "non-cotton cellulosic" fiber, yarn, or fabric means fibers, yarns, or fabrics which are comprised primarily of a cellulose based composition other than cotton. Examples of such compositions include linen, ramie, jute, flax, rayon, lyocell, cellulose acetate, bamboo and other similar compositions which are derived from non-cotton cellulosics.

As used herein, the term "rayon fiber" is intended to include, but is not limited to, a fiber comprising viscose rayon, high wet modulus rayon, cuprammonium rayon, saponified rayon, modal rayon and lyocell rayon.

"Protein fibers", are intended to refer to fibers comprising proteins, and include, but are not limited to, wools, such as sheep wool, alpaca, vicuna, mohair, cashmere, guanaco, camel and llama, and silks.

As used herein, the term "synthetic fiber" refers to a fiber that is not prepared from naturally occurring filaments and include, but are not limited to, fibers made from components by polymerization, polycondensation or polyaddition. Materials for forming the synthetic fibers include, but are limited to, polyesters, polyamides such as nylons, polyacrylics, polyurethanes such as spandex, elastanes, elastodienes, fluoro fibers, acrylics, modacrylics, aramids, polyvinyl chlorides, polyvinylidene chloride, polyethylenes, polypropylenes and vinylals. Synthetic fibers include fibers formed from petroleum products. Synthetic-fiber containing materials are those that contain both the purely synthetic fiber and also natural materials.

"Polymers" are understood to include, but are not limited to, homopolymers, copolymers, such as for example, block, graft, random and alternating copolymers, terpolymers, etc. and blends and modifications thereof.

The term "polyamide" as used herein means the well-known fiber-forming substance that is a long-chain synthetic polyamide. The term particularly relates to poly (ε-caprolactam; "nylon 6") and poly (hexamethylene adipamide; "nylon 6,6") as well as their copolymers.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. A common example of a polyester is poly(ethylene terephthalate) which is a condensation product of ethylene glycol and terephthalic acid.

As used herein, the term "polyurethane-polyurea copolymer" refers to synthetic polymers sold as "spandex" or "elastane" under the brand names of LYCRA (Invista), ELASPAN (Invista), ACEPORA (Taekwang), CREORA (Hyosung), INVIYA (Indorama Corporation), ROICA and DORLASTAN (Asahi Kasei), LINEL (Fillattice), and ESPA (Toyobo).

The term "filament fiber" including "monofilament fiber" and "multifilament fiber" means a fiber comprising one or more continuous strands of natural or synthetic material of indefinite (i.e., not predetermined) length, as opposed to a "staple fiber" which is a discontinuous strand of fiber of definite length (i.e., a strand which has been cut or otherwise divided into segments of a predetermined length).

Filaments are generally formed by the melting of polymer pellets or another source of polymer which is then forced through an extrusion die to produce a continuous fiber. A filament can be a single continuous extrusion, or may be a chopped apart extrusion such as to form a staple. This fiber can then be texturized directly (which is uncommon), or can be combined with other filaments to form a filament bundle with the resultant filament bundle can then be texturized.

As used herein, "composite fiber" refers to a continuous fiber in which two distinct polymers are intimately adhered to each other along the length of the fiber. In some instances, a composite filament is a filament or fiber that is composed of at least two distinct polymers which have been spun together to form a single filament or fiber. By the term "distinct polymers" it is meant that each of the at least two polymeric components are arranged in distinct substantially constantly positioned zones across the cross-section of the composite fiber and extend substantially continuously along the length of the fiber. Composite fibers are distinguished from fibers that are extruded from a homogeneous melt blend of polymeric materials in which zones of distinct polymers are not formed. The at least two distinct polymeric components useable herein can be chemically different or they can be chemically the same polymer, but have different physical characteristics, such as tacticity, intrinsic viscosity, melt viscosity, die swell, density, crystallinity, and melting point or softening point. One or more of the polymeric components in the composite fiber can be a blend of different polymers. A composite fiber can have a fiber cross-section that is, for example, a side-by-side, eccentric sheath-core, concentratic sheath-core, or other suitable cross-section.

As understood herein, "filaments", which will be considered single strand synthetic fiber or polymer extrusions, and "yarns" or "filament bundles" are structures comprising a number of filaments combined together. For example, filaments are spun or otherwise interconnected, entangled, or arranged together form a filament bundle or yarn.

The term "yarn" refers a structure comprising a plurality of fibers that have been twisted, spun or otherwise joined together to form the yarn and may include spun yarns, continuous filament yarns, and yarns of core spun construction. The strands that that have been twisted, spun or otherwise joined together can be of natural or synthetic material, such as wool, nylon, or polyester, in a form suitable for sewing, knitting, weaving, or otherwise intertwining to form a textile fabric. In general, "yarn" refers to a product obtained when fibers are aligned. Yarns are products of substantial length and relatively small cross-section. Yarns may be single ply yarns, that is, having one yarn strand, or multiple ply yarns, such as 2-ply yarn that comprises two single yarns twisted together or 3-ply yarn that comprises three yarn strands twisted together. In various aspects, the disclosed composite fibers are used to prepare disclosed yarns. The disclosed yarns can be formed using staple fibers, using continuous fibers, or combinations thereof.

As used herein, "multifilament" means a yarn consisting of many continuous filaments or strands, as opposed to monofilament which is one strand. Most textile filament yarns are multifilament.

As used herein, "CSY" and "core spun yarn" can be used interchangeably to refer to a yarn made by twisting fibers around one or more core fibers or filaments, thus concealing the core fibers or filaments.

As used herein, "FDY" and "fully drawn yarn" can be used interchangeably to refer to filament yarns in which the draw ratio is normal so that full longitudinal orientation of polymer molecules.

As used herein, "POY" and "partially oriented yarn" can be used interchangeably to refer to filament yarns in which the draw ratio is less than normal so that only partial longitudinal orientation of the polymer molecules.

As used herein, the term "filament yarn" refers to a yarn that is composed of more than one fiber filaments that run the whole length of the yarn. Filament yarns can also be referred to as multi-filament yarns. The structure of a filament yarn is influenced by the amount of twist, and in some cases the fiber texturing. The properties of the filament yarn can be influenced by the structure of the yarn, fiber to fiber friction of the constituent fibers, and the properties of the constituent fibers. In some embodiments, the yarn structure and the recombinant protein fiber properties are chosen to impart various characteristics to the resulting yarns. The properties of the yarn can also be influenced by the number of fibers (i.e., filaments) in the yarn. The filament yarns disclosed herein can be multifilament yarns. Throughout this disclosure "filament yarns" can refer to flat filament yarns, textured filament yarns, drawn filament yarns, undrawn filament yarns, or filament yarns of any structure.

As used herein, the term "spun yarn" refers to a yarn that is made by twisting staple fibers together to make a cohesive yarn (or thread, or "single"). The structure of a spun yarn is influenced by the spinning methods parameters. The properties of the spun yarn are influenced by the structure of the yarn, as well as the constituent fibers.

As used herein, the term "blended yarn" refer to a type of yarn comprising various fibers being blended together.

As used herein, the term "warp direction" refers to the length direction or the machine direction of the fabric, and the term "weft direction" refers to the width direction or the cross machine direction of the fabric.

As used herein, the term "textile" shall mean a fiber, filament, yarn, fabric, or any article comprising fabrics and/or yarns, such as garments, articles of clothing, home goods, including, but not limited to, bed and table linens, linens, draperies and curtains, and upholsteries, and the like.

The term "articles of clothing" include any article of clothing including, for example, underwear, t-shirts, shirts, pants, socks, hats, diapers, and jackets.

As used herein, the term "garment" refers to wearable articles comprising fabrics or cloth to any item that is covers or protects some region of the user's body from weather or other factors in the environment outside the body. Exemplary garments, include, but are not limited to, coats, jackets, pants, hats, gloves, shoes, socks, shirts, blouses, dresses, coats, and the like. It is noted that the term "garment" is intended to cover clothing for human or animal use.

The term "linen" as used herein, refers to any article routinely washed in a residential or commercial washing machine besides articles of clothing, including, for example, sheets, blankets, towels, drapery, wash cloths, napkins, table cloths, and pillow cases.

As used herein, the term "fabric" is to be understood in its widest meaning. The term "fabric" may be used for all structures composed of fibers which have been manufactured according to a surface-forming method. Fabrics include materials where one or more different types of yarns, threads, filaments, or fibers that have been woven, knitted, felted, wrapped, spun, co-mingled, coated, coextruded, braided, entangled, applied or otherwise assembled into a desired material. Generally, the fabric has a structure which comprises a series of meshes or openings and filament bundles which define the mesh boundaries, such as woven, knitted, knotted, interwoven or tufted structures. Without limitations, the term "fabric" is intended to include woven fabrics, yarn sheets, knitted fabrics and non-woven fabrics. Further, the fabrics may be constructed from a combination of fibers, threads or yarns. Fabrics comprising different fibers, threads or yarns are also referred to as fabric blends herein. A knitted fabric may be flat knit, circular knit, warp knit, narrow elastic, and lace. A woven fabric may be of any construction, for example sateen, twill, plain weave, oxford weave, basket weave, and narrow elastic and the like.

As used herein, the term "cloth" refers to any textile fabric woven, nonwoven, felted, knitted or otherwise formed from any filament or fiber or plurality of filaments or fibers, including but not limited to thread yarn, monofilaments, and ribbons. Further, the term cloth is intended to include within its scope not only woven, knitted, non-woven, and felted materials, but also sheet materials.

As used herein, the term "strand" is being used as a term generic to both "fiber" and filament". In this regard, "filaments" are referring to continuous strands of material while "fibers" mean cut or discontinuous strands having a definite length. Thus, while the following discussion may use "strand" or "fiber" or "filament", the discussion can be equally applied to all three terms.

As used herein, the term "wicking" refers to the passage of liquids along or through a textile material or a textile element of a coated fabric, or along interstices formed by a textile element and a coating polymer of a coated fabric. Wicking involves a spontaneous transport of a liquid driven into a porous system by capillary forces.

Unless otherwise specified, temperatures referred to herein are based on atmospheric pressure (i.e. one atmosphere).

B. Cooling Compositions

In one aspect, the disclosure relates to cooling compositions that can be used in manufacture of a yarn. More specifically, in one aspect, the present disclosure relates to a cooling polymer composition comprising a polymer and a cooling composition comprising a cooling material, a cooling compound, a cooling salt, or combinations thereof. Disclosed cooling polymer compositions can be fabricated in chips or pellets for use in a yarn or filament spinning apparatus or machine.

In various aspects, the polymer in a disclosed cooling polymer composition can comprise a polyester polymer, such as a polyethylene terephthalate, a polytrimethylene terephthalate, or combinations thereof. In some aspects, the polyester can comprise a polyethylene terephthalate. In further aspects, the polyester can comprise a polytrimethylene terephthalate. In still further aspects, the polyester is a polyeseter co-polymer comprising a polyethylene terephthalate, a polytrimethylene terephthalate, or combinations thereof. In a yet further aspect, the polyester can comprise a co-polymer comprising polyethylene terephthalate. In a further aspect, the polyester can comprise a co-polymer comprising polytrimethylene terephthalate.

In various aspects, the polymer in a disclosed cooling polymer composition can comprise a polyamide polymer, such as a nylon 6, nylon 4/6, nylon 6/6, nylon 6/10, nylon 6/12, nylon 11, nylon 12, or combinations thereof. In a further aspect, the polyamide can comprise a nylon 6/6. In a still further aspect, the polyamide is a polyamide co-polymer comprising nylon 6, nylon 4/6, nylon 6/6, nylon 6/10, nylon 6/12, nylon 11, nylon 12, or combinations thereof. In a yet further aspect, the polyamide is a polyamide co-polymer comprising nylon 6/6.

In an aspect, the cooling composition can be present in the cooling polymer composition present in an amount of about 0.001 wt % to about 5 wt % based on the total weight of the polymer and the cooling composition. In a further aspect, the cooling composition can be present in an amount, based on the total weight of the polymer and the cooling composition of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %;

about 0.010 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In an aspect, the cooling composition can be present in an amount of about 5.0 wt % to about 25 wt % based on the total weight of the polymer and the cooling composition. In a further aspect, the cooling composition can be present in an amount, based on the total weight of the polymer and the cooling composition of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; a range utilizing any of the foregoing values; a sub-range with a range utilizing any of the foregoing values; or any set of values utilizing the foregoing values.

In a further aspect, the cooling material can be present in the cooling composition in an amount of about 0.2 wt % to about 2 wt % of the cooling material; about 0.02 wt % to about 0.07 wt % of the cooling compound; about 0.001 wt % to about 0.02 wt % of the cooling salt; or combinations thereof; and wherein the wt % is based on the total weight of the polymer and the cooling composition. In a still further aspect, the cooling material can be present in the cooling composition, based on the total weight of the polymer and the cooling composition, in an amount of about 0.5 wt % to about 1 wt % of the cooling material; about 0.03 wt % to about 0.05 wt % of the cooling compound; about 0.001 wt % to about 0.01 wt % of the cooling salt; or combinations thereof; and wherein the wt % is based on the total weight of the polymer and the cooling composition. In a yet further aspect, the cooling material can be present in the cooling composition in an amount of about 0.2 wt % to about 2 wt % of the cooling material; about 0.02 wt % to about 0.07 wt % of the cooling compound; and about 0.001 wt % to about 0.02 wt % of the cooling salt; and wherein the wt % is based on the total weight of the polymer and the cooling composition. In an even further aspect, the cooling material can be present in the cooling composition in an amount of about 0.5 wt % to about 1 wt % of the cooling material; about 0.03 wt % to about 0.05 wt % of the cooling compound; and about 0.001 wt % to about 0.01 wt % of the cooling salt; and wherein the wt % is based on the total weight of the polymer and the cooling composition.

In a further aspect, the cooling material can be present in the cooling composition in an amount of about 3.0 wt % to about 10.0 wt % of the cooling material; about 5.0 wt % to about 12.0 wt % of the cooling compound; about 0.3 wt % to about 4.0 wt % of the cooling salt; or combinations thereof; and wherein the wt % is based on the total weight of the polymer and the cooling composition. In a still further aspect, the cooling material can be present in the cooling composition, based on the total weight of the polymer and the cooling composition, in an amount of about 4.0 wt % to about 8.0 wt % of the cooling material; about 5.5 wt % to about 11.0 wt % of the cooling compound; about 0.4 wt % to about 3.0 wt % of the cooling salt; or combinations thereof; and wherein the wt % is based on the total weight of the polymer and the cooling composition. In a yet further aspect, the cooling material can be present in the cooling composition in an amount of about 4.5 wt % to about 7.7 wt % of the cooling material; about 5.9 wt % to about 11.0 wt % of the cooling compound; and about 0.4 wt % to about 2.5 wt % of the cooling salt; and wherein the wt % is based on the total weight of the polymer and the cooling composition. In an even further aspect, the cooling material can be present in the cooling composition in an amount of about 5.0 wt % to about 7.2 wt % of the cooling material; about 6.4 wt % to about 10.5 wt % of the cooling compound; and about 0.5 wt % to about 2.1 wt % of the cooling salt; and wherein the wt % is based on the total weight of the polymer and the cooling composition. In a still further aspect, the cooling material can be present in the cooling composition in an amount of about 5.0 wt % to about 7.0 wt % of the cooling material; about 6.7 wt % to about 10.0 wt % of the cooling compound; and about 0.59 wt % to about 2.0 wt % of the cooling salt; and wherein the wt % is based on the total weight of the polymer and the cooling composition.

In a further aspect, the cooling material can be present in the cooling composition in an amount of about 0.2 wt % to about 2 wt %; and wherein the wt % is based on the total weight of the polymer and the cooling composition. In a still further aspect, the cooling material can be present in an amount of about 0.4 wt % to about 1 wt %; and wherein the wt % is based on the total weight of the polymer and the cooling composition. In a yet further aspect, the cooling material can be present in an amount of about 0.5 wt % to about 0.9 wt %; and wherein the wt % is based on the total weight of the polymer and the cooling composition.

In a further aspect, the cooling material can be present in the cooling composition in an amount of about 3.0 wt % to about 10.0 wt %; and wherein the wt % is based on the total weight of the polymer and the cooling composition. In a still further aspect, the cooling material can be present in an amount of about 4.0 wt % to about 8.0 wt %; and wherein the wt % is based on the total weight of the polymer and the cooling composition. In a yet further aspect, the cooling material can be present in an amount of about 4.5 wt % to about 7.7 wt %; and wherein the wt % is based on the total weight of the polymer and the cooling composition. In a still further aspect, the cooling material can be present in an amount of about 5.0 wt % to about 7.2 wt %; and wherein the wt % is based on the total weight of the polymer and the cooling composition. In an even further aspect, the cooling material can be present in an amount of about 5.0 wt % to about 7.0 wt %; and wherein the wt % is based on the total weight of the polymer and the cooling composition.

In a further aspect, the cooling material can be present in the cooling composition, based on the total weight of the polymer and the cooling composition, in an amount of about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; a range utilizing any of the foregoing values; a sub-range with a range utilizing any of the foregoing values; or any set of values utilizing the foregoing values.

In a further aspect, the cooling material can be present in the cooling composition, based on the total weight of the polymer and the cooling composition, in an amount of about 4.0 wt %, about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %, about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %, about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; a range utilizing any of the foregoing values; a sub-range with a range utilizing any of the foregoing values; or any set of values utilizing the foregoing values.

In various aspects, the cooling material comprises a metal, a metal alloy, a metal oxide, a carbon material, a ceramic material, a mineral, or combinations thereof.

In a further aspect, the cooling material comprises a metal oxide. Exemplary, but non-limiting, metal oxides useful for preparation of the cooling material include those comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. In a still further aspect, the metal oxide comprises silver (I) oxide, copper (I) oxide, copper (II) oxide, or combinations thereof. In a yet further aspect, the metal oxide comprises silver (I) oxide. In an even further aspect, the metal oxide can be a mixture comprising two or metal oxides.

In a further aspect, the cooling material comprises a mineral. Exemplary, but non-limiting, minerals useful for the disclosed cooling compositions include those comprising silicon, zirconium, titanium, or combinations thereof. For example, a mineral comprising zirconium can be allendeite, baddeleyite, eudialyte, loranskite, menezesite, or combinations thereof. In a still further aspect, a mineral comprising titanium can be rutile, ilmenite, titanite, anatase, brookite, or combinations thereof. In a yet further aspect, a mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof. In some instances, a mineral can comprise both zirconium and titanium, including minerals such as calzirtite, kobeite, lakargiite, lindsleyite, loveringite, mathiasite, tazheranite, zircon, zirconolite, zirkelite, or combinations thereof.

In a further aspect, the cooling material comprises a ceramic comprising aluminum oxide, aluminum titanate, zirconium oxide, aluminum nitride, silicon carbide, silicon nitride, silicon alumina nitride, or combinations thereof.

In a further aspect, the cooling material comprises a metal such as silver, aluminum, copper, or combinations thereof. In a still further aspect, the metal can comprise silver. In a yet further aspect, the metal can comprise copper. In an even further aspect, metal can comprise a mixture of copper and silver. In various aspects, the metal can be a mixture comprising two or more metals.

In a further aspect, the cooling material comprises a metal alloy comprising silver, aluminum, copper, or combinations thereof. In a still further aspect, the metal alloy can comprise silver. In a yet further aspect, the metal alloy can comprise copper. In an even further aspect, metal alloy can comprise a mixture of copper and silver. In various aspects, the metal alloy can be a mixture comprising two or more metal alloys.

In various aspects, the cooling material, comprising a metal, a metal alloy, a metal oxide, a carbon material, a ceramic material, a mineral, or combinations thereof, can be in a form that is convenient for incorporation into the cooling polymer composition, such as a powder, a wire, a filament, a sheet, a particle, or combinations thereof. In other instances, the cooling material, comprising a metal, a metal alloy, a metal oxide, a carbon material, a ceramic material, a mineral, or combinations thereof, can be in the form of a particle, a powder, or combinations thereof. In some instances, the cooling material, comprising a metal, a metal alloy, a metal oxide, a carbon material, a ceramic material, a mineral, or combinations thereof, is in the form of a particle, including forms such as a nanoparticle, a microparticle, or combinations (or mixtures) thereof.

In a further aspect, the cooling material comprises a metal, a metal alloy, a metal oxide, a carbon material, a ceramic material, a mineral, or combinations thereof, comprising nanoparticles having a size of about 10 nm to about 100 nm. In a still further aspect, the nanoparticles have a size of about 15 nm to about 50 nm. In a yet further aspect, the nanoparticles have a size of about 20 nm to about 40 nm. In an even further aspect, the nanoparticles have a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In a further aspect, the cooling material is a metal, a metal alloy, a metal oxide, a carbon material, a ceramic material, a mineral, or combinations thereof, comprising microparticles. The microparticles in the cooling material can have a size of about 10 μm to about 200 μm; about 20 μm to about 100 μm; about 30 μm to about 90 μm; about 40 μm to about 80 μm; about 50 μm to about 70 μm; a size or set of sizes within any of the foregoing ranges, or a sub-range within the foregoing ranges.

In a further aspect, the cooling compound can be present in the cooling polymer composition in an amount of about 0.02 wt % to about 0.07 wt %; about 0.03 wt % to about 0.07 wt %; about 0.03 wt % to about 0.06 wt %; about 0.03 wt % to about 0.05 wt %; and wherein the wt % is based on the total weight of the polymer and the cooling composition; and wherein the wt % is based on the total weight of the polymer and the cooling composition.

In a further aspect, the cooling compound can be present in the cooling polymer composition, based on the total weight of the polymer and the cooling composition, in an amount of about 0.020 wt %; 0.025 wt %; about 0.030 wt %; about 0.035 wt %; about 0.040 wt %; about 0.045 wt %; about 0.050 wt %; about 0.055 wt %; about 0.060 wt %; about 0.065 wt %; about 0.070 wt %; a range utilizing any of the foregoing values; a sub-range with a range utilizing any of the foregoing values; or any set of values utilizing the foregoing values.

In a further aspect, the cooling compound can be present in the cooling polymer composition in an amount of 5.0 wt % to about 12.0 wt %; about 5.5 wt % to about 11.0 wt %; about 5.9 wt % to about 11.0 wt %; about 6.4 wt % to about 10.5 wt %; about 6.7 wt % to about 10.0 wt %; and wherein the wt % is based on the total weight of the polymer and the cooling composition.

In a further aspect, the cooling compound can be present in the cooling polymer composition, based on the total weight of the polymer and the cooling composition, in an amount of about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; a range utilizing any of the foregoing values; a sub-range with a range utilizing any of the foregoing values; or any set of values utilizing the foregoing values.

The cooling compound can comprise a transition metal oxide, a Group 13 oxide, a Group 14 oxide, a Group 13 carbide, Group 14 carbide, or mixtures thereof. In some instances, the cooling compound can comprise an aluminum oxide, silicon carbide, silicon dioxide, silicon carbide, silicon dioxide, titanium oxide, titanium dioxide, titanium trioxide, zirconium dioxide, or combinations thereof. In a further aspect, the cooling compound can comprise aluminum oxide, silicon dioxide, titanium dioxide, or combinations thereof. In a still further aspect, the cooling compound can comprise titanium dioxide. The cooling compound can be in the form of a powder, a particle, or combinations thereof. In a further aspect, the cooling compound can be in the form of a particle, such as a nanoparticle, a microparticle, or combinations thereof.

In various aspects, the cooling compound can be in a form that is convenient for incorporation into the cooling polymer composition, such as a powder, a wire, a filament, a sheet, a particle, or combinations thereof. In other instances, the cooling compound can be in the form of a particle, a powder, or combinations thereof. In some instances, the cooling compound is in the form of a particle, including forms such as a nanoparticle, a microparticle, or combinations thereof.

In various aspects, the cooling compound comprises a particle form of the cooling compound, and the particle size is about 10 μm to about 200 μm; about 20 μm to about 100 μm; about 30 μm to about 90 μm; about 40 μm to about 80 μm; or about 50 μm to about 70 μm; or a sub-range within any of the foregoing ranges.

In a further aspect, the cooling compound comprises a particle form of the cooling compound, and the particle size is about 10 μm; about 20 μm; about 30 μm; about 40 μm; about 50 μm; about 60 μm; about 70 μm; about 80 μm; about 90 μm; about 100 μm; about 110 μm; about 120 μm; about 130 μm; about 140 μm; about 150 μm; about 160 μm; about 170 μm; about 180 μm; about 190 μm; about 200 μm; a range utilizing any of the foregoing values; a sub-range with a range utilizing any of the foregoing values; or any set of values utilizing the foregoing values.

In a further aspect, the cooling compound can comprise nanoparticles having a size of about 10 nm to about 100 nm. In a still further aspect, the cooling compound can comprise nanoparticles having a size of about 15 nm to about 50 nm. In a yet further aspect, the cooling compound can comprise nanoparticles having a size of about 20 nm to about 40 nm. In an even further aspect, the cooling compound can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

In various aspects, the cooling composition comprises a cooling salt present in an amount, based on the total weight of the polymer and the cooling composition, of about 0.001 wt % to about 0.02 wt %; about 0.001 wt % to about 0.01 wt %; about 0.002 wt % to about 0.01 wt %; or a sub-range within any of the foregoing ranges.

In a further aspect, the cooling composition comprises a cooling salt present in an amount, based on the total weight of the polymer and the cooling composition, of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.02 wt %; a range utilizing any of the foregoing values; a sub-range with a range utilizing any of the foregoing values; or any set of values utilizing the foregoing values.

In various aspects, the cooling composition comprises a cooling salt present in an amount, based on the total weight of the polymer and the cooling composition, of about 0.3 wt % to about 4.0 wt %; about 0.4 wt % to about 3.0 wt %; about 0.4 wt % to about 2.5 wt %; about 0.5 wt % to about 2.1 wt %; about 0.59 wt % to about 2.0 wt %; or a sub-range within any of the foregoing ranges.

In a further aspect, the cooling composition comprises a cooling salt present in an amount, based on the total weight of the polymer and the cooling composition, of about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; a range utilizing any of the foregoing values; a sub-range with a range utilizing any of the foregoing values; or any set of values utilizing the foregoing values.

The cooling composition comprises a cooling salt comprising a transition metal salt, a Group I salt, a Group II salt, or combinations thereof. In some instances, the cooling salt is a Group I salt. In other instances, the cooling salt is a Group II salt. In further instances, the cooling salt is a transition metal salt. The cooling salt can comprise a Group I carbonate, a Group I halide, a Group I nitrate, or combinations thereof. Alternatively, the cooling salt can comprise a Group II carbonate, a Group II halide, a Group II nitrate, or combinations thereof. In further aspects, the cooling salt can comprise a transition metal carbonate, a transition metal halide, a transition metal nitrate, or combinations thereof. In some instances, the salt comprises a transition metal carbonate, Group I carbonate, a Group II carbonate, or combinations thereof. In a particular aspect, the salt comprises calcium carbonate.

In various aspects, the cooling salt can be in a form that is convenient for incorporation into the cooling polymer composition, such as a powder, a wire, a filament, a sheet, a particle, or combinations thereof. In other instances, the cooling salt can be in the form of a particle, a powder, or combinations thereof. In some instances, the cooling salt is in the form of a particle, including forms such as a nanoparticle, a microparticle, or combinations thereof.

The cooling salt in the cooling composition can be in the form of a powder, a particle, or combinations thereof. In some aspects, the cooling salt in the cooling composition comprises particles having a size of about 10 μm to about 1000 μm. In a further aspect, the salt in the cooling composition comprises particles having a size of about 30 μm to about 500 μm.

In various aspects, the cooling salt in the cooling composition comprises particles having a size of about 10 μm; about 20 μm; about 30 μm; about 40 μm; about 50 μm; about 60 μm; about 70 μm; about 80 μm; about 90 μm; about 100 μm; 110 μm; about 120 μm; about 130 μm; about 140 μm; about 150 μm; about 160 μm; about 170 μm; about 180 μm; about 190 μm; about 200 μm; 210 μm; about 220 μm; about 230 μm; about 240 μm; about 250 μm; about 260 μm; about 270 μm; about 280 μm; about 290 μm; about 300 μm; 310 μm; about 320 μm; about 330 μm; about 340 μm; about 350 μm; about 360 μm; about 370 μm; about 380 μm; about 390 μm; about 400 μm; 410 μm; about 420 μm; about 430 μm; about 440 μm; about 450 μm; about 460 μm; about 470 μm; about 480 μm; about 490 μm; about 500 μm; about 550 μm; about 600 μm; about 650 μm; about 700 μm; about 750 μm; about 800 μm; about 850 μm; about 900 μm; about 950 μm; about 1000 μm; a range utilizing any of the foregoing values; a sub-range with a range utilizing any of the foregoing values; or any set of values utilizing the foregoing values.

In a further aspect, the cooling salt can comprise nanoparticles having a size of about 10 nm to about 100 nm. In a still further aspect, the cooling salt can comprise nanoparticles having a size of about 15 nm to about 50 nm. In a yet further aspect, the cooling salt can comprise nanoparticles having a size of about 20 nm to about 40 nm. In an even further aspect, the cooling salt can comprise nanoparticles having a size of about 10 nm; about 11 nm; about 12 nm; about 13 nm; about 14 nm; about 15 nm; about 16 nm; about 17 nm; about 18 nm; about 19 nm; about 20 nm; about 21 nm; about 22 nm; about 23 nm; about 24 nm; about 25 nm; about 26 nm; about 27 nm; about 28 nm; about 29 nm; about 30 nm; about 31 nm; about 32 nm; about 33 nm; about 34 nm; about 35 nm; about 36 nm; about 37 nm; about 38 nm; about 39 nm; about 40 nm; about 41 nm; about 42 nm; about 43 nm; about 44 nm; about 45 nm; about 46 nm; about 47 nm; about 48 nm; about 49 nm; about 50 nm; about 51 nm; about 52 nm; about 53 nm; about 54 nm; about 55 nm; about 56 nm; about 57 nm; about 58 nm; about 59 nm; about 60 nm; about 61 nm; about 62 nm; about 63 nm; about 64 nm; about 65 nm; about 66 nm; about 67 nm; about 68 nm; about 69 nm; about 70 nm; about 71 nm; about 72 nm; about 73 nm; about 74 nm; about 75 nm; about 76 nm; about 77 nm; about 78 nm; about 79 nm; about 80 nm; about 81 nm; about 82 nm; about 83 nm; about 84 nm; about 85 nm; about 86 nm; about 87 nm; about 88 nm; about 89 nm; about 90 nm; about 91 nm; about 92 nm; about 93 nm; about 94 nm; about 95 nm; about 96 nm; about 97 nm; about 98 nm; about 99 nm; about 100 nm; a range utilizing any of the foregoing values; a sub-range with a range utilizing any of the foregoing values; or any set of values utilizing the foregoing values.

C. Composite Fibers

In one aspect, the disclosure relates to composite fibers, comprising a core component and a sheath layer that can be used in manufacture of a single-covered yarn or a double-covered yarn, or utilized in a woven or knit fabric. More particularly, in some aspects, the present disclosure relates composite fibers comprising a core component and a sheath component, wherein: (a) the core component comprises a polyester polymer; and (b) the sheath component comprises a polyamide polymer; and such that each of the core component and the sheath component independently comprise a cooling composition.

In various aspects, a disclosed composite fiber comprises about 20 wt % to about 80 wt % of a polyester polymer and about 80 wt % to about 20 wt % of a polyamide polymer, based on the total weight of the composite fiber. In a further aspect, a disclosed composite fiber comprises about 50 wt % to about 70 wt % of a polyester polymer and about 50 wt % to about 30 wt % of a polyamide polymer, based on the total weight of the composite fiber. In a still further aspect, a disclosed composite fiber comprises about 55 wt % to about 65 wt % of a polyester polymer and about 45 wt % to about 35 wt % of a polyamide polymer, based on the total weight of the composite fiber. In a yet further aspect, a disclosed composite fiber comprises about 57 wt % to about 63 wt % of a polyester polymer and about 43 wt % to about 37 wt % of a polyamide polymer, based on the total weight of the composite fiber. A disclosed composite fiber comprises about 58 wt % to about 62 wt % of a polyester polymer and about 42 wt % to about 38 wt % of a polyamide polymer, based on the total weight of the composite fiber.

In a further aspect, a disclosed composite fiber comprises a polyester polymer in a weight percent amount based on the total weight of the composite fiber of about 20 wt %; about 21 wt %; about 22 wt %; about 23 wt %; about 24 wt %; about 25 wt %; about 26 wt %; about 27 wt %; about 28 wt %; about 29 wt %; about 30 wt %; about 31 wt %; about 32 wt %; about 33 wt %; about 34 wt %; about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; about 61 wt %; about 62 wt %; about 63 wt %; about 64 wt %; about 65 wt %; about 66 wt %; about 67 wt %; about 68 wt %; about 69 wt %; about 70 wt %; about 71 wt %; about 72 wt %; about 73 wt %; about 74 wt %; about 75 wt %; about 76 wt %; about 77 wt %; about 78 wt %; about 79 wt %; about 80 wt %; a range utilizing any of the foregoing values; a sub-range with a range utilizing any of the foregoing values; or any set of values utilizing the foregoing values, provided that the weight percent total of the polyamide polymer and the polyester polymer in the composite is about 80 wt % to about 100 wt %.

In a further aspect, a disclosed composite fiber comprises a polyamide polymer in a weight percent amount based on the total weight of the composite fiber of about 20 wt %; about 21 wt %; about 22 wt %; about 23 wt %; about 24 wt %; about 25 wt %; about 26 wt %; about 27 wt %; about 28 wt %; about 29 wt %; about 30 wt %; about 31 wt %; about 32 wt %; about 33 wt %; about 34 wt %; about 35 wt %; about 36 wt %; about 37 wt %; about 38 wt %; about 39 wt %; about 40 wt %; about 41 wt %; about 42 wt %; about 43 wt %; about 44 wt %; about 45 wt %; about 46 wt %; about 47 wt %; about 48 wt %; about 49 wt %; about 50 wt %; about 51 wt %; about 52 wt %; about 53 wt %; about 54 wt %; about 55 wt %; about 56 wt %; about 57 wt %; about 58 wt %; about 59 wt %; about 60 wt %; about 61 wt %; about 62 wt %; about 63 wt %; about 64 wt %; about 65 wt %; about 66 wt %; about 67 wt %; about 68 wt %; about 69 wt %; about 70 wt %; about 71 wt %; about 72 wt %; about 73 wt %; about 74 wt %; about 75 wt %; about 76 wt %; about 77 wt %; about 78 wt %; about 79 wt %; about 80 wt %; a range utilizing any of the foregoing values; a sub-range with a range utilizing any of the foregoing values; or any set of values utilizing the foregoing values, provided that the weight percent total of the polyamide polymer and the polyester polymer in the composite is about 80 wt % to about 100 wt %.

In various aspects, the polyester polymer is a polyethylene terephthalate, a polytrimethylene terephthalate, or combinations thereof. In a further aspect, the polyester polymer is a polyethylene terephthalate. In a still further aspect, the polyester polymer is a polytrimethylene terephthalate.

In various aspects, the polyamide polymer can comprise a nylon 6, nylon 4/6, nylon 6/6, nylon 6/10, nylon 6/12, nylon 11, nylon 12, or combinations thereof. In a further aspect, the polyamide polymer can comprise a nylon 6, a nylon 6/6, a nylon 6/12, or combinations thereof. In a still further aspect, the polyamide polymer can comprise a nylon 6/6.

Figure 1B:
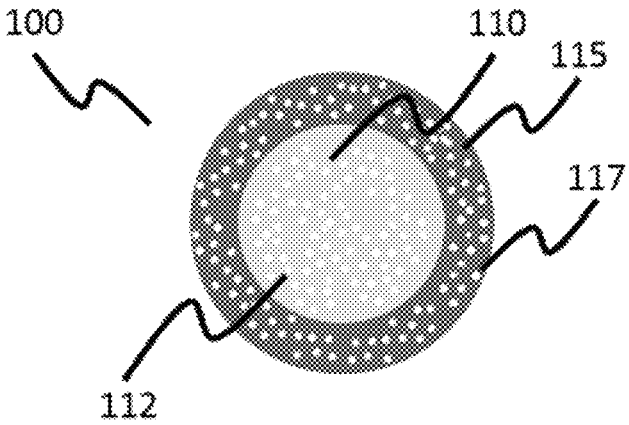
Figure 1C:
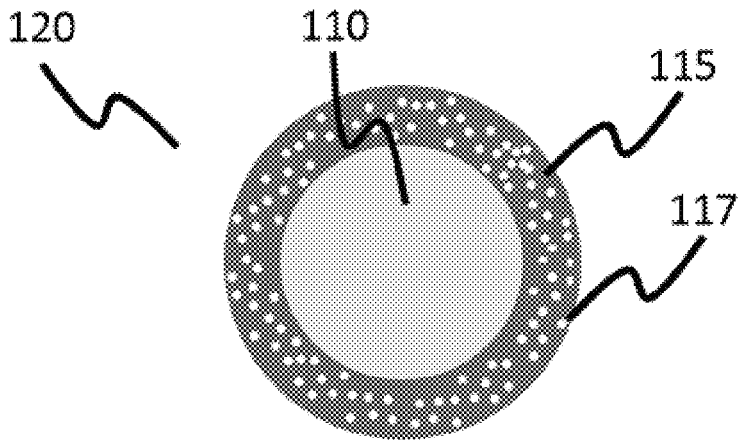
Figure 1D:
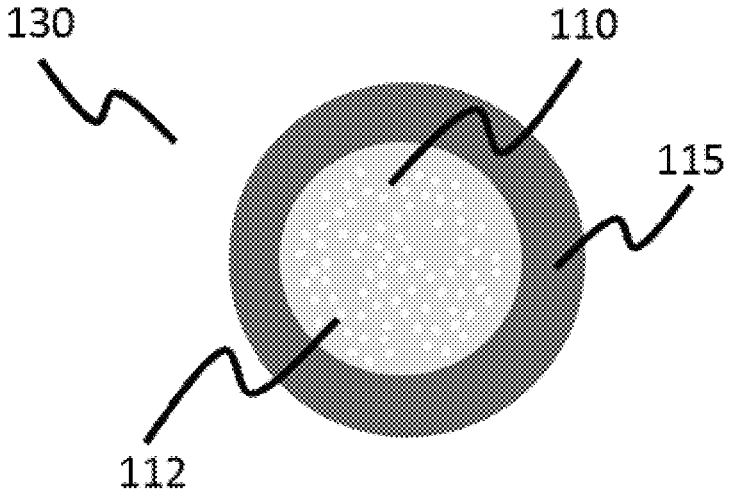

Referring now to FIGS. 1A-1D, which show representative schematic views of disclosed composite fibers. FIG. 1A shows a side on cross-sectional view of a portion of a disclosed composite fiber with a cross-sectional view of an end thereof. An enlarged view of the cross-sectional end view is highlighted. A key is shown beneath the views indicating the gray-scale colors associated with a sheath layer, a core component, and distribution of one or more cooling compositions in each of the sheath layer and core component. FIG. 1B shows a cross-sectional view of a disclosed composite fiber, 100, with aspects specified as follows: a polyester core, 110; a first cooling composition, 112; a polyamide sheath, 115; and a second cooling composition, 117. FIG. 1C shows a cross-sectional view of a disclosed composite fiber, 120, with aspects specified as follows: a polyester core, 110; a polyamide sheath, 115; and a second cooling composition, 117. FIG. 1D shows a cross-sectional view of a disclosed composite fiber, 130, with aspects specified as follows: a polyester core, 110; a first cooling composition, 112; and a polyamide sheath, 115.

In various aspects, the present disclosure relates composite fibers comprising a core component and a sheath component, wherein: (a) the core component comprises a polyester polymer and a first cooling composition; and (b) the sheath component comprises a polyamide polymer and a second cooling composition; wherein the first cooling composition is present in an amount from about 0.1 wt % to about 25 wt % based on the total weight of the polyester polymer and the first cooling composition; wherein the first cooling composition comprises aluminum, calcium, copper, iron, magnesium, potassium, silicon, silver, sodium, titanium, zirconium, or combinations thereof; wherein the second cooling composition is present in an amount from about 0.1 wt % to about 35 wt % based on the total weight of the polyamide polymer and the second cooling composition; and wherein the second cooling composition comprises aluminum, calcium, copper, iron, magnesium, potassium, silicon, silver, sodium, titanium, zirconium, or combinations thereof.

In a further aspect, the disclosed composite fiber comprises a first cooling composition that can be present in an amount of about 0.1 wt % to about 20 wt % based on the total weight of the polyester polymer and the first cooling composition. In a still further aspect, the first cooling composition can be present in an amount, based on the total weight of the polyester polymer and the first cooling composition of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %;

about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; a range utilizing any of the foregoing values; a sub-range with a range utilizing any of the foregoing values; or any set of values utilizing the foregoing values.

In a further aspect, the disclosed composite fiber comprises a first ceramic material, a first cooling compound, a first metal, a first metal alloy, a first metal oxide, a first mineral, a first salt, or combinations thereof.

In a further aspect, the disclosed composite fiber comprises a first ceramic material comprising aluminum oxide, aluminum titanate, zirconium oxide, aluminum nitride, silicon carbide, silicon nitride, silicon alumina nitride, or combinations thereof.

In a further aspect, the disclosed composite fiber comprises a first cooling compound comprising a transition metal oxide, a Group 1 oxide, a Group 2 oxide, a Group 13 oxide, a Group 14 oxide, a transition metal carbide, a Group 13 carbide, Group 14 carbide, a transition metal nitride, a Group 13 nitride, Group 14 nitride, or mixtures thereof. For example, in a non-limiting aspect, the first cooling compound comprises aluminum oxide, magnesium oxide, silicon carbide, silicon dioxide, silicon carbide, silicon dioxide, titanium oxide, titanium dioxide, titanium trioxide, zirconium dioxide, or combinations thereof. In a still further non-limiting aspect, the first cooling compound comprises aluminum oxide, magnesium oxide, silicon dioxide, titanium dioxide, or combinations thereof. In a particular aspect, the first cooling compound comprises titanium dioxide.

In a further aspect, the disclosed composite fiber comprises a first metal comprising silver, aluminum, copper, or combinations thereof. For example, in a non-limiting aspect, the first metal can comprise silver. Alternatively, the first metal can comprise copper. In some aspects, the first metal can comprise a mixture of copper and silver.

In a further aspect, the disclosed composite fiber comprises a first metal alloy comprises silver, aluminum, copper, or combinations thereof. For example, in a non-limiting aspect, the first metal alloy can be a metal alloy comprising silver. Alternatively, the first metal alloy can be a metal alloy comprising copper. In a still further alternative aspect, the first metal alloy can be a metal alloy comprising copper and silver In a further aspect, the disclosed composite fiber comprises a first metal oxide comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. For example, in a non-limiting aspect, the first metal oxide can comprise silver (I) oxide, copper (I) oxide, copper (II) oxide, or combinations thereof. In a specific aspect, the first metal oxide can comprise silver (I) oxide.

In a further aspect, the disclosed composite fiber comprises a first mineral comprising dolomite, tourmaline, zircon, magnesia, magnesite, calcite, aragonite, zircon, limestone, allendeite, periclase, baddeleyite, eudialyte, loranskite, menezesite, rutile, ilmenite, titanite, anatase, brookite, is quartz, granite, chalcedony, chrysoprase, garnet, phenacite, olivine, mica, kaolinite, feldspar, zeolite, carnelian, agate, onyx, jasper, heliotrope, flint, calzirtite, kobeite, lakargiite, lindsleyite, loveringite, mathiasite, tazheranite, zircon, zirconolite, zirkelite, or combinations thereof. For example, in a non-limiting aspect, in some instances the first mineral can comprise dolomite, tourmaline, zircon, magnesia, magnesite, calcite, periclase, limestone, aragonite, quartz, or combinations thereof. In a further non-limiting particular aspect, the first mineral can comprise calcium, magnesium, silicon, zirconium, titanium, or combinations thereof. In some instances, the first mineral can comprise calcium in the form of calcite, aragonite, dolomite, tourmaline, or combinations thereof. In other instances, the first mineral can comprise magnesium in the form of magnesia, periclase, magnesite, dolomite, tourmaline, or combinations thereof. In further instances, the first mineral can comprise silicon in the form of quartz, granite, chalcedony, chrysoprase, garnet, phenacite, olivine, mica, kaolinite, feldspar, zeolite, carnelian, agate, onyx, jasper, heliotrope, flint, or combinations thereof. In alternative instances, the first mineral can comprise titanium in the form of rutile, Imenite, titanite, anatase, brookite, or combinations thereof. The first mineral comprising zirconium can be in the form of zircon, allendeite, baddeleyite, eudialyte, loranskite, menezesite, or combinations thereof. In some instances, the first mineral can comprise both zirconium and titanium, for example, but not limited to, in the form of calzirtite, kobeite, lakargiite, lindsleyite, loveringite, mathiasite, tazheranite, zircon, zirconolite, zirkelite, or combinations thereof.

In a further aspect, the disclosed composite fiber can comprise a first cooling salt comprising a Group I salt, a Group II salt, a transition metal salt, or combinations thereof.

In a further aspect, the disclosed composite fiber can comprise a first cooling salt such as a Group I salt, for example, but not limited to, a Group I salt comprising a cation of sodium, potassium or combinations thereof. For example, the disclosed composite fiber can comprise a first cooling salt comprising a Group I salt, such as, but not limited to, a Group I carbonate, a Group I halide, a Group I nitrate, a Group I sulfate, or combinations thereof.

In a further aspect, the disclosed composite fiber can comprise a first cooling salt such as a Group II salt, for example, but not limited to, a Group II salt comprising a cation of calcium, magnesium or combinations thereof. For example, the disclosed composite fiber can comprise a first cooling salt comprising a Group II salt, such as, but not limited to a Group II carbonate, a Group II halide, a Group II nitrate, a Group II sulfate, or combinations thereof.

In a further aspect, the disclosed composite fiber can comprise a first cooling salt such as a transition metal salt, for example, but not limited to, a transition metal salt comprising a cation of silver, copper, titanium, iron, nickel, zinc, gold, or combinations thereof. For example, the disclosed composite fiber can comprise a first cooling salt comprising a transition metal salt, such as, but not limited to a transition metal carbonate, a transition metal halide, a transition metal nitrate, a transition metal sulfate, or combinations thereof.

In a further aspect, the disclosed composite fiber can comprise a first cooling salt such as a Group I sulfate, a Group II sulfate, transition metal sulfate, or combinations thereof. For example, the disclosed composite fiber can comprise a first cooling salt comprising sodium sulfate, potassium sulfate, calcium sulfate, magnesium sulfate, or combinations thereof. In a particular aspect, the first cooling salt can comprise sodium sulfate, potassium sulfate, magnesium sulfate, or combinations thereof.

In a further aspect, the disclosed composite fiber can comprise a first cooling salt such as a Group I halide, a Group II halide, transition metal halide, or combinations thereof. For example, the disclosed composite fiber can comprise a first cooling salt comprising iron (II) chloride, iron (III) chloride, sodium chloride, potassium chloride, calcium chloride, magnesium chloride, or combinations thereof. In a particular aspect, the first cooling salt can comprise potassium chloride.

In a further aspect, the disclosed composite fiber can comprise a first cooling salt such as a Group I carbonate, a Group II carbonate, transition metal carbonate, or combinations thereof. For example, the disclosed composite fiber can comprise a first cooling salt comprising calcium carbonate, magnesium carbonate, or combinations thereof.

In various aspects, the disclosed composite fiber can comprise a first cooling composition that is in the form of a powder, a wire, a filament, a sheet, a particle, or combinations thereof. In a particular aspect, the first cooling composition comprises a particle, a powder, or combinations thereof. In some instances, the first cooling composition comprises a particle, such as a nanoparticle, a microparticle, or combinations thereof. A first cooling composition comprising a nanoparticle can comprise a nanoparticle having a size of about 10 nm to about 100 nm; about 15 nm to about 50 nm; about 20 nm to about 40 nm; about 10 μm to about 200 μm; about 20 μm to about 100 μm; about 30 μm to about 90 μm; about 40 μm to about 80 μm; about 50 μm to about 70 μm; a sub-range within any of the foregoing ranges; or any set of values utilizing values within any of the foregoing ranges.

It is understood herein throughout that reference to a composition comprising an element, e.g., "a composition comprises Al, Ca, Cu, Fe . . . Zr" or "a composition comprises aluminum, calcium, copper, iron . . . zirconium," is intended to be inclusive of any form or valency of the element as appropriate for a given compound or material in which the element is part of the composition of the compound or material, unless otherwise specified. That is, it is understood that a reference to a particular element in a composition or material is inclusive of ionic forms of the element in typical oxidation states for that element if the composition or material comprises the element as an ionic compound; covalently bonded forms of the element if the composition or material comprises the element as an covalent compound; and elemental forms (i.e., oxidation state of 0) as suitable or appropriate for the indicated if the composition or material comprises the element in an oxidation state of 0, e.g., Al as metallic aluminum. Thus, reference to a composition, as discussed above, is intended to comprise ionic, covalent, and elemental forms of the element as disclosed herein.

For example, reference to a composition comprising aluminum refers to forms of aluminum disclosed herein, such as aluminum metal, $Al_2O_3$, tourmaline, and other disclosed aluminum containing minerals and compounds. Similarly, reference to a composition comprising: (a) calcium refers to materials comprising calcium disclosed herein, such as $CaCO_3$, dolomite, tourmaline, and other disclosed calcium containing minerals and compounds; (b) iron refers to materials comprising iron disclosed herein, such as iron metal, alloys comprising iron, $FeCl_2$, FeO, tourmaline, and other disclosed iron containing minerals and compounds; (c) potassium refers to materials comprising potassium disclosed herein, such as $K_2SO_4$, KCl, and other disclosed potassium containing minerals and compounds; (d) magnesium refers to materials comprising magnesium disclosed herein, such as magnesium metal, alloys comprising magnesium, $MgCO_3$, MgO, dolomite, tourmaline, and other disclosed magnesium containing minerals and compounds; (e) sodium refers to forms of sodium disclosed herein, such as sodium salts, tourmaline, and other disclosed sodium containing minerals and compounds; (f) silicon refers to materials comprising silicon disclosed herein, such as SiC, SiO, tourmaline, and other disclosed calcium containing minerals and compounds; and (g) silver refers to materials comprising silver disclosed herein, such as silver, alloys comprising silver, AgO, tourmaline, and other disclosed calcium containing minerals and compounds.

In addition, it is understood herein throughout, that an amount of an element, e.g., weight percent, is the overall weight percent for the element in aggregate as determined by elemental analysis and that the element may be present in one or more chemical and/or physical forms. For example, reference to 5 wt % silver as determined by element analysis refers to the determination that the material comprises 5 wt % silver which may be present in one or more of the disclosed forms of silver such as silver, a silver alloy, and AgO. This understanding extends to other elements that are specified as having been determined to be present at a certain weight percent as determined by elemental analysis.

In a further aspect, the disclosed composite fiber can comprise a first cooling composition comprising aluminum.

Aluminum can be present in a first cooling composition in an amount of about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed composite fiber can comprise a first cooling composition comprising calcium. Calcium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed composite fiber can comprise a first cooling composition comprising copper. Copper can be present in a first cooling composition in an amount of about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed composite fiber can comprise a first cooling composition comprising iron. Iron can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed composite fiber can comprise a first cooling composition comprising magnesium. Magnesium can be present in a first cooling composition in an amount of about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed composite fiber can comprise a first cooling composition comprising potassium. Potassium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed composite fiber can comprise a first cooling composition comprising silver. Silver can be present in a first cooling composition in an amount of about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed composite fiber can comprise a first cooling composition comprising sodium. Sodium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed composite fiber can comprise a first cooling composition comprising titanium. Titanium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed composite fiber can comprise a first cooling composition comprising zirconium. Zirconium can be present in a first cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

In a further aspect, the disclosed composite fiber comprises a second cooling composition that can be present in an amount of about 0.1 wt % to about 30 wt % based on the total weight of the polyamide polymer and the second cooling composition. In a still further aspect, the second cooling composition can be present in an amount, based on the total weight of the polyamide polymer and the second cooling composition of about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %;

about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; about 25.1 wt %; about 25.2 wt %; about 25.3 wt %; about 25.4 wt %; about 25.5 wt %; about 25.6 wt %; about 25.7 wt %; about 25.8 wt %; about 25.9 wt %; about 26.0 wt %; about 26.1 wt %; about 26.2 wt %; about 26.3 wt %; about 26.4 wt %; about 26.5 wt %; about 26.6 wt %; about 26.7 wt %; about 26.8 wt %; about 26.9 wt %; about 27.0 wt %; about 27.1 wt %; about 27.2 wt %; about 27.3 wt %; about 27.4 wt %; about 27.5 wt %; about 27.6 wt %; about 27.7 wt %; about 27.8 wt %; about 27.9 wt %; about 28.0 wt %; about 28.1 wt %; about 28.2 wt %; about 28.3 wt %; about 28.4 wt %; about 28.5 wt %; about 28.6 wt %; about 28.7 wt %; about 28.8 wt %; about 28.9 wt %; about 29.0 wt %; about 29.1 wt %; about 29.2 wt %; about 29.3 wt %; about 29.4 wt %; about 29.5 wt %; about 29.6 wt %; about 29.7 wt %; about 29.8 wt %; about 29.9 wt %; about 30.0 wt %; a range utilizing any of the foregoing values; a sub-range with a range utilizing any of the foregoing values; or any set of values utilizing the foregoing values.

In a further aspect, the disclosed composite fiber comprises a second ceramic material, a second cooling compound, a second metal, a second metal alloy, a second metal oxide, a second mineral, a second salt, or combinations thereof.

In a further aspect, the disclosed composite fiber comprises a second ceramic material comprising aluminum oxide, aluminum titanate, zirconium oxide, aluminum nitride, silicon carbide, silicon nitride, silicon alumina nitride, or combinations thereof.

In a further aspect, the disclosed composite fiber comprises a second cooling compound comprising a transition metal oxide, a Group 1 oxide, a Group 2 oxide, a Group 13 oxide, a Group 14 oxide, a transition metal carbide, a Group 13 carbide, Group 14 carbide, a transition metal nitride, a Group 13 nitride, Group 14 nitride, or mixtures thereof. For example, in a non-limiting aspect, the second cooling compound comprises aluminum oxide, magnesium oxide, silicon carbide, silicon dioxide, silicon carbide, silicon dioxide, titanium oxide, titanium dioxide, titanium trioxide, zirconium dioxide, or combinations thereof. In a still further non-limiting aspect, the second cooling compound comprises aluminum oxide, magnesium oxide, silicon dioxide, titanium dioxide, or combinations thereof. In a particular aspect, the second cooling compound comprises titanium dioxide.

In a further aspect, the disclosed composite fiber comprises a second metal comprising silver, aluminum, copper, or combinations thereof. For example, in a non-limiting aspect, the second metal can comprise silver. Alternatively, the second metal can comprise copper. In some aspects, the second metal can comprise a mixture of copper and silver.

In a further aspect, the disclosed composite fiber comprises a second metal alloy comprises silver, aluminum, copper, or combinations thereof. For example, in a non-limiting aspect, the second metal alloy can be a metal alloy comprising silver. Alternatively, the second metal alloy can be a metal alloy comprising copper. In a still further alternative aspect, the second metal alloy can be a metal alloy comprising copper and silver In a further aspect, the disclosed composite fiber comprises a second metal oxide comprising gold (II) oxide, gold (III) oxide, silver (I) oxide, silver (II) oxide, silver (I, III) oxide, magnesium oxide, iron (II) oxide, iron (III) oxide, copper (I) oxide, copper (II) oxide, or combinations thereof. For example, in a non-limiting aspect, the second metal oxide can comprise silver (I) oxide, copper (I) oxide, copper (II) oxide, or combinations thereof. In a specific aspect, the second metal oxide can comprise silver (I) oxide.

In a further aspect, the disclosed composite fiber comprises a second mineral comprising dolomite, tourmaline, zircon, magnesia, magnesite, calcite, aragonite, zircon, limestone, allendeite, periclase, baddeleyite, eudialyte, loranskite, menezesite, rutile, ilmenite, titanite, anatase, brookite, is quartz, granite, chalcedony, chrysoprase, garnet, phenacite, olivine, mica, kaolinite, feldspar, zeolite, carnelian, agate, onyx, jasper, heliotrope, flint, calzirtite, kobeite, lakargiite, lindsleyite, loveringite, mathiasite, tazheranite, zircon, zirconolite, zirkelite, or combinations thereof. For example, in a non-limiting aspect, in some instances the second mineral can comprise dolomite, tourmaline, zircon, magnesia, magnesite, calcite, periclase, limestone, aragonite, quartz, or combinations thereof. In a further non-limiting particular aspect, the second mineral can comprise calcium, magnesium, silicon, zirconium, titanium, or combinations thereof. In some instances, the second mineral can comprise calcium in the form of calcite, aragonite, dolomite, tourmaline, or combinations thereof. In other instances, the second mineral can comprise magnesium in the form of magnesia, periclase, magnesite, dolomite, tourmaline, or combinations thereof. In further instances, the second mineral can comprise silicon in the form of quartz, granite, chalcedony, chrysoprase, garnet, phenacite, olivine, mica, kaolinite, feldspar, zeolite, carnelian, agate, onyx, jasper, heliotrope, flint, or combinations thereof. In alternative instances, the second mineral can comprise titanium in the form of rutile, Imenite, titanite, anatase, brookite, or combinations thereof. The second mineral comprising zirconium can be in the form of zircon, allendeite, baddeleyite, eudialyte, loranskite, menezesite, or combinations thereof. In some instances, the second mineral can comprise both zirconium and titanium, for example, but not limited to, in the form of calzirtite, kobeite, lakargiite, lindsleyite, loveringite, mathiasite, tazheranite, zircon, zirconolite, zirkelite, or combinations thereof.

In a further aspect, the disclosed composite fiber can comprise a second cooling salt comprising a Group I salt, a Group II salt, a transition metal salt, or combinations thereof.

In a further aspect, the disclosed composite fiber can comprise a second cooling salt such as a Group I salt, for example, but not limited to, a Group I salt comprising a cation of sodium, potassium or combinations thereof. For example, the disclosed composite fiber can comprise a second cooling salt comprising a Group I salt, such as, but not limited to, a Group I carbonate, a Group I halide, a Group I nitrate, a Group I sulfate, or combinations thereof.

In a further aspect, the disclosed composite fiber can comprise a second cooling salt such as a Group II salt, for example, but not limited to, a Group II salt comprising a cation of calcium, magnesium or combinations thereof. For example, the disclosed composite fiber can comprise a second cooling salt comprising a Group II salt, such as, but not limited to a Group II carbonate, a Group II halide, a Group II nitrate, a Group II sulfate, or combinations thereof.

In a further aspect, the disclosed composite fiber can comprise a second cooling salt such as a transition metal salt, for example, but not limited to, a transition metal salt comprising a cation of silver, copper, titanium, iron, nickel, zinc, gold, or combinations thereof. For example, the disclosed composite fiber can comprise a second cooling salt comprising a transition metal salt, such as, but not limited to a transition metal carbonate, a transition metal halide, a transition metal nitrate, a transition metal sulfate, or combinations thereof.

In a further aspect, the disclosed composite fiber can comprise a second cooling salt such as a Group I sulfate, a Group II sulfate, transition metal sulfate, or combinations thereof. For example, the disclosed composite fiber can comprise a second cooling salt comprising sodium sulfate, potassium sulfate, calcium sulfate, magnesium sulfate, or combinations thereof. In a particular aspect, the second cooling salt can comprise sodium sulfate, potassium sulfate, magnesium sulfate, or combinations thereof.

In a further aspect, the disclosed composite fiber can comprise a second cooling salt such as a Group I halide, a Group II halide, transition metal halide, or combinations thereof. For example, the disclosed composite fiber can comprise a second cooling salt comprising iron (II) chloride, iron (III) chloride, sodium chloride, potassium chloride, calcium chloride, magnesium chloride, or combinations thereof. In a particular aspect, the second cooling salt can comprise potassium chloride.

In a further aspect, the disclosed composite fiber can comprise a second cooling salt such as a Group I carbonate, a Group II carbonate, transition metal carbonate, or combinations thereof. For example, the disclosed composite fiber can comprise a second cooling salt comprising calcium carbonate, magnesium carbonate, or combinations thereof.

In various aspects, the disclosed composite fiber can comprise a second cooling composition that is in the form of a powder, a wire, a filament, a sheet, a particle, or combinations thereof. In a particular aspect, the second cooling composition comprises a particle, a powder, or combinations thereof. In some instances, the second cooling composition comprises a particle, such as a nanoparticle, a microparticle, or combinations thereof. A second cooling composition comprising a nanoparticle can comprise a nanoparticle having a size of about 10 nm to about 100 nm; about 15 nm to about 50 nm; about 20 nm to about 40 nm; about 10 μm to about 200 μm; about 20 μm to about 100 μm; about 30 μm to about 90 μm; about 40 μm to about 80 μm; about 50 μm to about 70 μm; a sub-range within any of the foregoing ranges; or any set of values utilizing values within any of the foregoing ranges.

It is understood herein throughout that reference to a composition comprising an element, e.g., "a composition comprises Al, Ca, Cu, Fe . . . Zr" or "a composition comprises aluminum, calcium, copper, iron . . . zirconium," is intended to be inclusive of any form or valency of the element as appropriate for a given compound or material in which the element is part of the composition of the compound or material, unless otherwise specified. That is, it is understood that a reference to a particular element in a composition or material is inclusive of ionic forms of the element in typical oxidation states for that element if the composition or material comprises the element as an ionic compound; covalently bonded forms of the element if the composition or material comprises the element as an covalent compound; and elemental forms (i.e., oxidation state of 0) as suitable or appropriate for the indicated if the composition or material comprises the element in an oxidation state of 0, e.g., Al as metallic aluminum. Thus, reference to a composition, as discussed above, is intended to comprise ionic, covalent, and elemental forms of the element as disclosed herein.

For example, reference to a composition comprising aluminum refers to forms of aluminum disclosed herein, such as aluminum metal, $Al_2O_3$, tourmaline, and other disclosed aluminum containing minerals and compounds. Similarly, reference to a composition comprising: (a) calcium refers to materials comprising calcium disclosed herein, such as $CaCO_3$, dolomite, tourmaline, and other disclosed calcium containing minerals and compounds; (b) iron refers to materials comprising iron disclosed herein, such as iron metal, alloys comprising iron, $FeCl_2$, FeO, tourmaline, and other disclosed iron containing minerals and compounds; (c) potassium refers to materials comprising potassium disclosed herein, such as $K_2SO_4$, KCl, and other disclosed potassium containing minerals and compounds; (d) magnesium refers to materials comprising magnesium disclosed herein, such as magnesium metal, alloys comprising magnesium, $MgCO_3$, MgO, dolomite, tourmaline, and other disclosed magnesium containing minerals and compounds; (e) sodium refers to forms of sodium disclosed herein, such as sodium salts, tourmaline, and other disclosed sodium containing minerals and compounds; (f) silicon refers to materials comprising silicon disclosed herein, such as SiC, SiO, tourmaline, and other disclosed calcium containing minerals and compounds; and (g) silver refers to materials comprising silver disclosed herein, such as silver, alloys comprising silver, AgO, tourmaline, and other disclosed calcium containing minerals and compounds.

In addition, it is understood herein throughout, that an amount of an element, e.g., weight percent, is the overall weight percent for the element in aggregate as determined by elemental analysis and that the element may be present in one or more chemical and/or physical forms. For example, reference to 5 wt % silver as determined by element analysis refers to the determination that the material comprises 5 wt % silver which may be present in one or more of the disclosed forms of silver such as silver, a silver alloy, and AgO. This understanding extends to other elements that are specified as having been determined to be present at a certain weight percent as determined by elemental analysis.

In a further aspect, the disclosed composite fiber can comprise a first cooling composition comprising aluminum. Aluminum can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed composite fiber can comprise a first cooling composition comprising calcium. Calcium can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed composite fiber can comprise a first cooling composition comprising copper. Copper can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed composite fiber can comprise a first cooling composition comprising iron. Iron can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed composite fiber can comprise a first cooling composition comprising magnesium. Magnesium can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed composite fiber can comprise a first cooling composition comprising potassium. Potassium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed composite fiber can comprise a first cooling composition comprising silver. Silver can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed composite fiber can comprise a first cooling composition comprising sodium. Sodium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed composite fiber can comprise a first cooling composition comprising titanium. Titanium can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed composite fiber can comprise a first cooling composition comprising zirconium. Zirconium can be present in a first cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

In a further aspect, the disclosed composite fiber can comprise a second cooling composition comprising aluminum. Aluminum can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed composite fiber can comprise a second cooling composition comprising calcium. Calcium can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed composite fiber can comprise a second cooling composition comprising copper. Copper can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed composite fiber can comprise a second cooling composition comprising iron. Iron can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed composite fiber can comprise a second cooling composition comprising magnesium. Magnesium can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed composite fiber can comprise a second cooling composition comprising potassium. Potassium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed composite fiber can comprise a second cooling composition comprising silver. Silver can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed composite fiber can comprise a second cooling composition comprising sodium. Sodium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed composite fiber can comprise a second cooling composition comprising titanium. Titanium can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed composite fiber can comprise a second cooling composition comprising zirconium. Zirconium can be present in a second cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

It is to be understood, that in reference that a wt % amount of aluminum, calcium, copper, iron, magnesium, potassium, silicon, silver, sodium, titanium, zirconium, or combinations thereof is the wt % amount of the element as determined by elemental analysis of the polyester polymer and the first cooling composition.

The weight percent for a given element in a disclosed composite fiber, e.g., aluminum, calcium, copper, iron, magnesium, potassium, silicon, silver, sodium, titanium, zirconium, or combinations, can be the weight percent based upon elemental analysis. In a particular instance, the elemental analysis can be carried out using field emission scanning electron microscopy with a segmented backscatter detector, an Everhart-Thornley electron detector, in-lens electron detectors, or combinations thereof. In some specific instances, the elemental analysis can be carried out using field emission scanning electron microscopy with energy-dispersive spectroscopy.

In various aspects, a disclosed composite fiber can have a cross-sectional profile of various geometries or shapes. For example, the disclosed composite fiber can have, but is not limited to a cross sectional profile such as a side-by-side cross-section; an eccentric sheath-core cross-section; an islands-in-the-sea cross-section; a segmented pie cross-section; or a concentric cross-section.

In some aspects, the disclosed composite fiber can have a suitable fiber weight, e.g., a fiber weight of about 100 d/60f to about 200 d/75f.

D. Single-Covered Yarns

In one aspect, the disclosure relates to single-covered yarns that can be utilized in a woven or knit fabric. In various aspects, a disclosed single-covered yarn comprises a core fiber comprising a disclosed composite fiber; and a first fiber comprising a cellulosic fiber. More specifically, in one aspect, the present disclosure relates to single-covered yarn comprising: (a) a core fiber comprising a disclosed composite fiber; and (b) a first fiber comprising a cellulosic fiber; wherein the first yarn is wound around the core yarn to form a single-covered yarn. In a further aspect, a disclosed single-covered yarn comprises a core fiber comprising a disclosed composite fiber; and a first fiber comprising a cellulosic fiber. In a further aspect, a disclosed single-covered yarn comprises a core fiber comprising a disclosed composite fiber; a first fiber comprising a cellulosic fiber; wherein the core fiber is present in an amount of from about 20 wt % to about 50 wt %; wherein the first fiber is present in an amount of from about 40 wt % to about 80 wt %; wherein the weight percent is based upon the total weight of the single-covered yarn, and provided that the total weight percent of the elastic yarn, the first fiber, and the second yarn is from about 90 wt % to about 100 wt %.

In a further aspect, a disclosed single-covered yarn comprises a core fiber comprising a disclosed composite fiber; and a first fiber comprising a cellulosic fiber. In a further aspect, a disclosed single-covered yarn comprises a core fiber comprising a disclosed composite fiber; a first fiber comprising a cellulosic fiber; wherein the core fiber is present in an amount of from about 25 wt % to about 45 wt %; wherein the first fiber is present in an amount of from about 55 wt % to about 80 wt %; wherein the weight percent is based upon the total weight of the single-covered yarn, and provided that the total weight percent of the elastic yarn, the first fiber, and the second yarn is from about 90 wt % to about 100 wt %.

In a further aspect, a disclosed single-covered yarn comprises a core fiber comprising a disclosed composite fiber; and a first fiber comprising a cellulosic fiber. In a further aspect, a disclosed single-covered yarn comprises a core fiber comprising a disclosed composite fiber; a first fiber comprising a cellulosic fiber; wherein the core fiber is present in an amount of from about 27 wt % to about 42 wt %; wherein the first fiber is present in an amount of from about 88 wt % to about 73 wt %; wherein the weight percent is based upon the total weight of the single-covered yarn, and provided that the total weight percent of the elastic yarn, the first fiber, and the second yarn is from about 90 wt % to about 100 wt %.

In a further aspect, a disclosed single-covered yarn comprises a core fiber comprising a disclosed composite fiber; and a first fiber comprising a cellulosic fiber. In a further aspect, a disclosed single-covered yarn comprises a core fiber comprising a disclosed composite fiber; a first fiber comprising a cellulosic fiber; wherein the core fiber is present in an amount of from about 30 wt % to about 40 wt %; wherein the first fiber is present in an amount of from about 60 wt % to about 70 wt %; wherein the weight percent is based upon the total weight of the single-covered yarn, and provided that the total weight percent of the elastic yarn, the first fiber, and the second yarn is from about 90 wt % to about 100 wt %.

In a further aspect, a single-covered yarn comprises a core fiber in a weight percent amount based on the total weight of the single-covered yarn of about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; about 25.1 wt %; about 25.2 wt %; about 25.3 wt %; about 25.4 wt %; about 25.5 wt %; about 25.6 wt %; about 25.7 wt %; about 25.8 wt %; about 25.9 wt %; about 26.0 wt %; about 26.1 wt %; about 26.2 wt %; about 26.3 wt %; about 26.4 wt %; about 26.5 wt %; about 26.6 wt %; about 26.7 wt %; about 26.8 wt %; about 26.9 wt %; about 27.0 wt %; about 27.1 wt %; about 27.2 wt %; about 27.3 wt %; about 27.4 wt %; about 27.5 wt %; about 27.6 wt %; about 27.7 wt %; about 27.8 wt %; about 27.9 wt %; about 28.0 wt %; about 28.1 wt %; about 28.2 wt %; about 28.3 wt %; about 28.4 wt %; about 28.5 wt %; about 28.6 wt %; about 28.7 wt %; about 28.8 wt %; about 28.9 wt %; about 29.0 wt %; about 29.1 wt %; about 29.2 wt %; about 29.3 wt %; about 29.4 wt %; about 29.5 wt %; about 29.6 wt %; about 29.7 wt %; about 29.8 wt %; about 29.9 wt %; about 30.0 wt %; about 30.1 wt %; about 30.2 wt %; about 30.3 wt %; about 30.4 wt %; about 30.5 wt %; about 30.6 wt %; about 30.7 wt %; about 30.8 wt %; about 30.9 wt %; about 31.0 wt %; about 31.1 wt %; about 31.2 wt %; about 31.3 wt %; about 31.4 wt %; about 31.5 wt %; about 31.6 wt %; about 31.7 wt %; about 31.8 wt %; about 31.9 wt %; about 32.0 wt %; about 32.1 wt %; about 32.2 wt %; about 32.3 wt %; about 32.4 wt %; about 32.5 wt %; about 32.6 wt %; about 32.7 wt %; about 32.8 wt %; about 32.9 wt %; about 33.0 wt %; about 33.1 wt %; about 33.2 wt %; about 33.3 wt %; about 33.4 wt %; about 33.5 wt %; about 33.6 wt %; about 33.7 wt %; about 33.8 wt %; about 33.9 wt %; about 34.0 wt %; about 34.1 wt %; about 34.2 wt %; about 34.3 wt %; about 34.4 wt %; about 34.5 wt %; about 34.6 wt %; about 34.7 wt %; about 34.8 wt %; about 34.9 wt %; about 35.0 wt %; about 35.1 wt %; about 35.2 wt %; about 35.3 wt %; about 35.4 wt %; about 35.5 wt %; about 35.6 wt %; about 35.7 wt %; about 35.8 wt %; about 35.9 wt %; about 36.0 wt %; about 36.1 wt %; about 36.2 wt %; about 36.3 wt %; about 36.4 wt %; about 36.5 wt %; about 36.6 wt %; about 36.7 wt %; about 36.8 wt %; about 36.9 wt %; about 37.0 wt %; about 37.1 wt %; about 37.2 wt %; about 37.3 wt %; about 37.4 wt %; about 37.5 wt %; about 37.6 wt %; about 37.7 wt %; about 37.8 wt %; about 37.9 wt %; about 38.0 wt %; about 38.1 wt %; about 38.2 wt %; about 38.3 wt %; about 38.4 wt %; about 38.5 wt %; about 38.6 wt %; about 38.7 wt %; about 38.8 wt %; about 38.9 wt %; about 39.0 wt %; about 39.1 wt %; about 39.2 wt %; about 39.3 wt %; about 39.4 wt %; about 39.5 wt %; about 39.6 wt %; about 39.7 wt %; about 39.8 wt %; about 39.9 wt %; about 40.0 wt %; about 40.1 wt %; about 40.2 wt %; about 40.3 wt %; about 40.4 wt %; about 40.5 wt %; about 40.6 wt %; about 40.7 wt %; about 40.8 wt %; about 40.9 wt %; about 41.0 wt %; about 41.1 wt %; about 41.2 wt %; about 41.3 wt %; about 41.4 wt %; about 41.5 wt %; about 41.6 wt %; about 41.7 wt %; about 41.8 wt %; about 41.9 wt %; about 42.0 wt %; about 42.1 wt %; about 42.2 wt %; about 42.3 wt %; about 42.4 wt %; about 42.5 wt %; about 42.6 wt %; about 42.7 wt %; about 42.8 wt %; about 42.9 wt %; about 43.0 wt %; about 43.1 wt %; about 43.2 wt %; about 43.3 wt %; about 43.4 wt %; about 43.5 wt %; about 43.6 wt %; about 43.7 wt %; about 43.8 wt %; about 43.9 wt %; about 44.0 wt %; about 44.1 wt %; about 44.2 wt %; about 44.3 wt %; about 44.4 wt %; about 44.5 wt %; about 44.6 wt %; about 44.7 wt %; about 44.8 wt %; about 44.9 wt %; about 45.0 wt %; about 45.1 wt %; about 45.2 wt %; about 45.3 wt %; about 45.4 wt %; about 45.5 wt %; about 45.6 wt %; about 45.7 wt %; about 45.8 wt %; about 45.9 wt %; about 46.0 wt %; about 46.1 wt %; about 46.2 wt %; about 46.3 wt %; about 46.4 wt %; about 46.5 wt %; about 46.6 wt %; about 46.7 wt %; about 46.8 wt %; about 46.9 wt %; about 47.0 wt %; about 47.1 wt %; about 47.2 wt %; about 47.3 wt %; about 47.4 wt %; about 47.5 wt %; about 47.6 wt %; about 47.7 wt %; about 47.8 wt %; about 47.9 wt %; about 48.0 wt %; about 48.1 wt %; about 48.2 wt %; about 48.3 wt %; about 48.4 wt %; about 48.5 wt %; about 48.6 wt %; about 48.7 wt %; about 48.8 wt %; about 48.9 wt %; about 49.0 wt %; about 49.1 wt %; about 49.2 wt %; about 49.3 wt %; about 49.4 wt %; about 49.5 wt %; about 49.6 wt %; about 49.7 wt %; about 49.8 wt %; about 49.9 wt %; about 50.0 wt %; a range utilizing any of the foregoing values; a sub-range with a range utilizing any of the foregoing values; or any set of values utilizing the foregoing values, and provided that the total weight percent of the elastic yarn, the first fiber, and the second yarn is from about 90 wt % to about 100 wt %.

In a further aspect, a single-covered yarn comprises a first fiber in a weight percent amount based on the total weight of the single-covered yarn of about 40.0 wt %; about 40.1 wt %; about 40.2 wt %; about 40.3 wt %; about 40.4 wt %; about 40.5 wt %; about 40.6 wt %; about 40.7 wt %; about 40.8 wt %; about 40.9 wt %; about 41.0 wt %; about 41.1 wt %; about 41.2 wt %; about 41.3 wt %; about 41.4 wt %; about 41.5 wt %; about 41.6 wt %; about 41.7 wt %; about 41.8 wt %; about 41.9 wt %; about 42.0 wt %; about 42.1 wt %; about 42.2 wt %; about 42.3 wt %; about 42.4 wt %; about 42.5 wt %; about 42.6 wt %; about 42.7 wt %; about 42.8 wt %; about 42.9 wt %; about 43.0 wt %; about 43.1 wt %; about 43.2 wt %; about 43.3 wt %; about 43.4 wt %; about 43.5 wt %; about 43.6 wt %; about 43.7 wt %; about 43.8 wt %; about 43.9 wt %; about 44.0 wt %; about 44.1 wt %; about 44.2 wt %; about 44.3 wt %; about 44.4 wt %; about 44.5 wt %; about 44.6 wt %; about 44.7 wt %; about 44.8 wt %; about 44.9 wt %; about 45.0 wt %; about 45.1 wt %; about 45.2 wt %; about 45.3 wt %; about 45.4 wt %; about 45.5 wt %; about 45.6 wt %; about 45.7 wt %; about 45.8 wt %; about 45.9 wt %; about 46.0 wt %; about 46.1 wt %; about 46.2 wt %; about 46.3 wt %; about 46.4 wt %; about 46.5 wt %; about 46.6 wt %; about 46.7 wt %; about 46.8 wt %; about 46.9 wt %; about 47.0 wt %; about 47.1 wt %; about 47.2 wt %; about 47.3 wt %; about 47.4 wt %; about 47.5 wt %; about 47.6 wt %; about 47.7 wt %; about 47.8 wt %; about 47.9 wt %; about 48.0 wt %; about 48.1 wt %; about 48.2 wt %; about 48.3 wt %; about 48.4 wt %; about 48.5 wt %; about 48.6 wt %; about 48.7 wt %; about 48.8 wt %; about 48.9 wt %; about 49.0 wt %; about 49.1 wt %; about 49.2 wt %; about 49.3 wt %; about 49.4 wt %; about 49.5 wt %; about 49.6 wt %; about 49.7 wt %; about 49.8 wt %; about 49.9 wt %; about 50.0 wt %; about 50.1 wt %; about 50.2 wt %; about 50.3 wt %; about 50.4 wt %; about 50.5 wt %; about 50.6 wt %; about 50.7 wt %; about 50.8 wt %; about 50.9 wt %; about 51.0 wt %; about 51.1 wt %; about 51.2 wt %; about 51.3 wt %; about 51.4 wt %; about 51.5 wt %; about 51.6 wt %; about 51.7 wt %; about 51.8 wt %; about 51.9 wt %; about 52.0 wt %; about 52.1 wt %; about 52.2 wt %; about 52.3 wt %; about 52.4 wt %; about 52.5 wt %; about 52.6 wt %; about 52.7 wt %; about 52.8 wt %; about 52.9 wt %; about 53.0 wt %; about 53.1 wt %; about 53.2 wt %; about 53.3 wt %; about 53.4 wt %; about 53.5 wt %; about 53.6 wt %; about 53.7 wt %; about 53.8 wt %; about 53.9 wt %; about 54.0 wt %; about 54.1 wt %; about 54.2 wt %; about 54.3 wt %; about 54.4 wt %; about 54.5 wt %; about 54.6 wt %; about 54.7 wt %; about 54.8 wt %; about 54.9 wt %; about 55.0 wt %; about 55.1 wt %; about 55.2 wt %; about 55.3 wt %; about 55.4 wt %; about 55.5 wt %; about 55.6 wt %; about 55.7 wt %; about 55.8 wt %; about 55.9 wt %; about 56.0 wt %; about 56.1 wt %; about 56.2 wt %; about 56.3 wt %; about 56.4 wt %; about 56.5 wt %; about 56.6 wt %; about 56.7 wt %; about 56.8 wt %; about 56.9 wt %; about 57.0 wt %; about 57.1 wt %; about 57.2 wt %; about 57.3 wt %; about 57.4 wt %; about 57.5 wt %; about 57.6 wt %; about 57.7 wt %; about 57.8 wt %; about 57.9 wt %; about 58.0 wt %; about 58.1 wt %; about 58.2 wt %; about 58.3 wt %; about 58.4 wt %; about 58.5 wt %; about 58.6 wt %; about 58.7 wt %; about 58.8 wt %; about 58.9 wt %; about 59.0 wt %; about 59.1 wt %; about 59.2 wt %; about 59.3 wt %; about 59.4 wt %; about 59.5 wt %; about 59.6 wt %; about 59.7 wt %; about 59.8 wt %; about 59.9 wt %; about 60.0 wt %; about 60.1 wt %; about 60.2 wt %; about 60.3 wt %; about 60.4 wt %; about 60.5 wt %; about 60.6 wt %; about 60.7 wt %; about 60.8 wt %; about 60.9 wt %; about 61.0 wt %; about 61.1 wt %; about 61.2 wt %; about 61.3 wt %; about 61.4 wt %; about 61.5 wt %; about 61.6 wt %; about 61.7 wt %; about 61.8 wt %; about 61.9 wt %; about 62.0 wt %; about 62.1 wt %; about 62.2 wt %; about 62.3 wt %; about 62.4 wt %; about 62.5 wt %; about 62.6 wt %; about 62.7 wt %; about 62.8 wt %; about 62.9 wt %; about 63.0 wt %; about 63.1 wt %; about 63.2 wt %; about 63.3 wt %; about 63.4 wt %; about 63.5 wt %; about 63.6 wt %; about 63.7 wt %; about 63.8 wt %; about 63.9 wt %; about 64.0 wt %; about 64.1 wt %; about 64.2 wt %; about 64.3 wt %; about 64.4 wt %; about 64.5 wt %; about 64.6 wt %; about 64.7 wt %; about 64.8 wt %; about 64.9 wt %; about 65.0 wt %; about 65.1 wt %; about 65.2 wt %; about 65.3 wt %; about 65.4 wt %; about 65.5 wt %; about 65.6 wt %; about 65.7 wt %; about 65.8 wt %; about 65.9 wt %; about 66.0 wt %; about 66.1 wt %; about 66.2 wt %; about 66.3 wt %; about 66.4 wt %; about 66.5 wt %; about 66.6 wt %; about 66.7 wt %; about 66.8 wt %; about 66.9 wt %; about 67.0 wt %; about 67.1 wt %; about 67.2 wt %; about 67.3 wt %; about 67.4 wt %; about 67.5 wt %; about 67.6 wt %; about 67.7 wt %; about 67.8 wt %; about 67.9 wt %; about 68.0 wt %; about 68.1 wt %; about 68.2 wt %; about 68.3 wt %; about 68.4 wt %; about 68.5 wt %; about 68.6 wt %; about 68.7 wt %; about 68.8 wt %; about 68.9 wt %; about 69.0 wt %; about 69.1 wt %; about 69.2 wt %; about 69.3 wt %; about 69.4 wt %; about 69.5 wt %; about 69.6 wt %; about 69.7 wt %; about 69.8 wt %; about 69.9 wt %; about 70.0 wt %; about 70.1 wt %; about 70.2 wt %; about 70.3 wt %; about 70.4 wt %; about 70.5 wt %; about 70.6 wt %; about 70.7 wt %; about 70.8 wt %; about 70.9 wt %; about 71.0 wt %; about 71.1 wt %; about 71.2 wt %; about 71.3 wt %; about 71.4 wt %; about 71.5 wt %; about 71.6 wt %; about 71.7 wt %; about 71.8 wt %; about 71.9 wt %; about 72.0 wt %; about 72.1 wt %; about 72.2 wt %; about 72.3 wt %; about 72.4 wt %; about 72.5 wt %; about 72.6 wt %; about 72.7 wt %; about 72.8 wt %; about 72.9 wt %; about 73.0 wt %; about 73.1 wt %; about 73.2 wt %; about 73.3 wt %; about 73.4 wt %; about 73.5 wt %; about 73.6 wt %; about 73.7 wt %; about 73.8 wt %; about 73.9 wt %; about 74.0 wt %; about 74.1 wt %; about 74.2 wt %; about 74.3 wt %; about 74.4 wt %; about 74.5 wt %; about 74.6 wt %; about 74.7 wt %; about 74.8 wt %; about 74.9 wt %; about 75.0 wt %; about 75.1 wt %; about 75.2 wt %; about 75.3 wt %; about 75.4 wt %; about 75.5 wt %; about 75.6 wt %; about 75.7 wt %; about 75.8 wt %; about 75.9 wt %; about 76.0 wt %; about 76.1 wt %; about 76.2 wt %; about 76.3 wt %; about 76.4 wt %; about 76.5 wt %; about 76.6 wt %; about 76.7 wt %; about 76.8 wt %; about 76.9 wt %; about 77.0 wt %; about 77.1 wt %; about 77.2 wt %; about 77.3 wt %; about 77.4 wt %; about 77.5 wt %; about 77.6 wt %; about 77.7 wt %; about 77.8 wt %; about 77.9 wt %; about 78.0 wt %; about 78.1 wt %; about 78.2 wt %; about 78.3 wt %; about 78.4 wt %; about 78.5 wt %; about 78.6 wt %; about 78.7 wt %; about 78.8 wt %; about 78.9 wt %; about 79.0 wt %; about 79.1 wt %; about 79.2 wt %; about 79.3 wt %; about 79.4 wt %; about 79.5 wt %; about 79.6 wt %; about 79.7 wt %; about 79.8 wt %; about 79.9 wt %; about 80.0 wt %; a range utilizing any of the foregoing values; a sub-range with a range utilizing any of the foregoing values; or any set of values utilizing the foregoing values, and provided that the total weight percent of the elastic yarn, the first fiber, and the second yarn is from about 90 wt % to about 100 wt %.

Figure 6A:
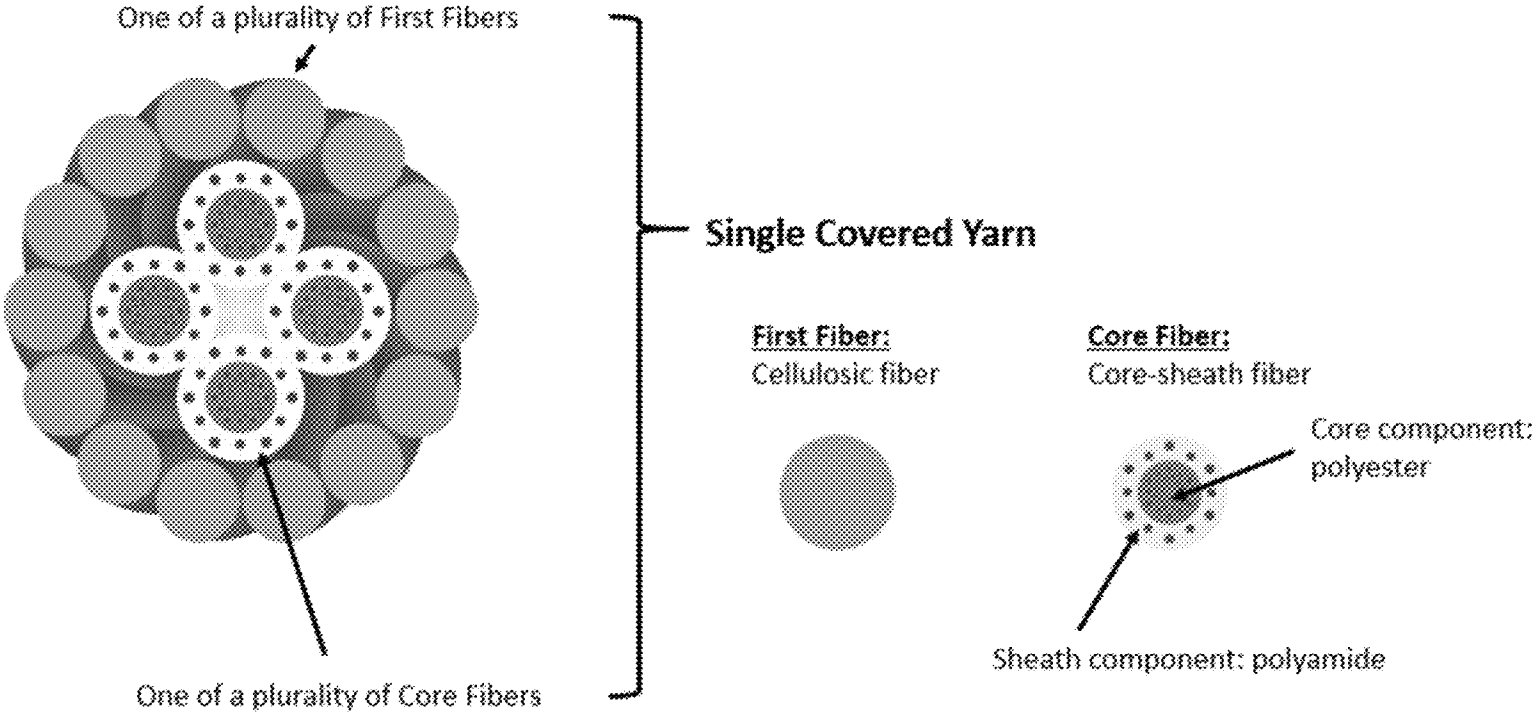
FIGS. 6A-6B show a representative cross-sectional views of disclosed single-covered yarns.
Figure 6B:
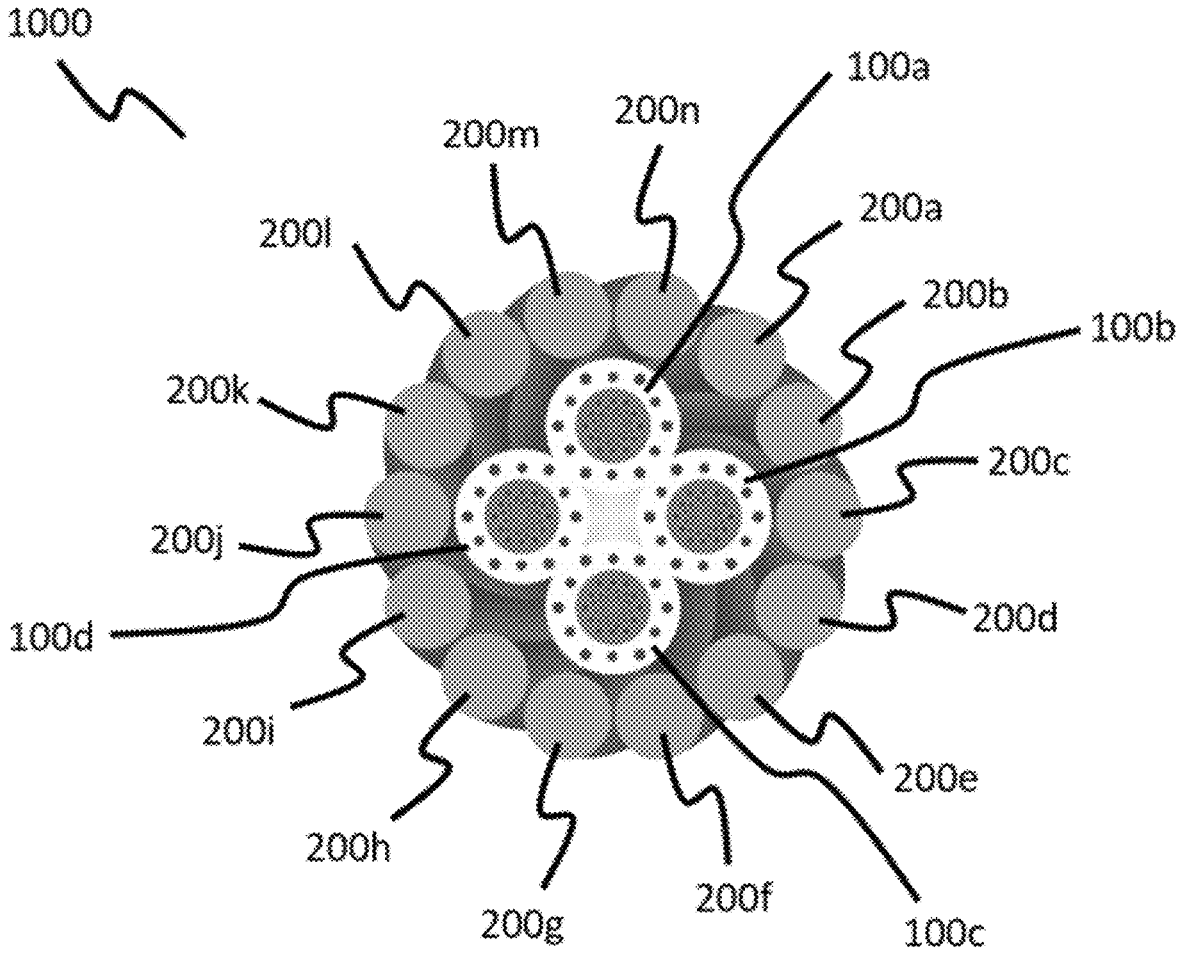

Referring now to FIGS. 6A-6B, which show representative cross-sectional views of disclosed single-covered yarns. FIG. 6A shows a schematic cross-sectional view of a disclosed single-covered yarn comprising a cellulosic fiber (e.g., a viscose rayon) wrapped around one or more composite fibers. FIG. 6B shows a cross-sectional view of a disclosed single-covered yarn, 1000, with aspects specified as follows: (a) a plurality of core fibers, 100*a*-100*d*, each comprising a disclosed composite fiber, such as that shown in FIG. 1B, comprising a core component comprising a polyester polymer and a first cooling composition, and a sheath layer comprising a polyamide polymer and a second cooling composition; and (b) a plurality of first fibers, 200*a*-200*n*, comprising a cellulosic fiber; such that the plurality of first fibers are wound around the plurality of core fibers to form a single-covered yarn.

In various aspects, the single-covered yarn can utilize a core fiber, comprising a disclosed composite fiber, having a weight of about 120 denier to about 600 denier; about 130 denier to about 500 denier; about 140 denier to about 400 denier; a sub-range within the foregoing ranges; or a set of values within any of the foregoing ranges. In a further aspect, the single-covered yarn can utilize a core fiber, comprising a disclosed composite fiber, having a weight of about 120 denier; about 130 denier; about 140 denier; about 150 denier; about 160 denier; about 170 denier; about 180 denier; about 190 denier; about 200 denier; about 210 denier; about 220 denier; about 230 denier; about 240 denier; about 250 denier; about 260 denier; about 270 denier; about 280 denier; about 290 denier; about 300 denier; about 310 denier; about 320 denier; about 330 denier; about 340 denier; about 350 denier; about 360 denier; about 370 denier; about 380 denier; about 390 denier; about 400 denier; about 410 denier; about 420 denier; about 430 denier; about 440 denier; about 450 denier; about 460 denier; about 470 denier; about 480 denier; about 490 denier; about 500 denier; about 510 denier; about 520 denier; about 530 denier; about 540 denier; about 550 denier; about 560 denier; about 570 denier; about 580 denier; about 590 denier; about 600 denier; a range encompassed by any of the foregoing values; or any set of the foregoing values.

In various aspects, the first fiber used in a disclosed single-covered yarn can be a suitable cellulosic fiber. In some instances, the cellulosic fiber of the f fiber is a regenerated cellulosic fiber, such as, but not limited to, a viscose rayon, a high wet modulus rayon, a cuprammonium rayon, a saponified rayon, a modal rayon, a lyocell rayon, or combinations thereof. In a particular instance, the regenerated cellulosic fiber can be a viscose rayon.

In various aspects, the first fiber of the single-covered yarn has a weight of about 105 d/20f to about 130 d/40f; about 110 d/20f to about 130 d/40f; about 115 d/20f to about 130 d/40f; about 105 d/20f to about 130 d/35f; about 110 d/35f to about 130 d/35f; about 115 d/20f to about 130 d/35f; about 105 d/20f to about 130 d/30f; about 110 d/20f to about 130 d/30f; about 115 d/20f to about 130 d/30f; about 105 d/20f to about 130 d/40f; about 115 d/25f to about 135 d/35f; a sub-range within any of the foregoing ranges; or any set of values utilizing values within any of the foregoing ranges.

In a further aspect, the first fiber of the single-covered yarn has a weight of about 120 d/20f±10%; about 120 d/20f±5%; about 120 d/20f±3%; 121 d/20f±10%; about 121 d/20f±5%; about 121 d/20f±3%; 122 d/20f±10%; about 122 d/20f±5%; about 122 d/20f±3%; 123 d/20f±10%; about 123 d/20f±5%; about 123 d/20f±3%; 124 d/20f±10%; about 124 d/20f±5%; about 124 d/20f±3%; 125 d/20f±10%; about 125 d/20f±5%; about 125 d/20f±3%; 126 d/20f±10%; about 126 d/20f±5%; about 126 d/20f±3%; 127 d/20f±10%; about 127 d/20f±5%; about 127 d/20f±3%; 128 d/20f±10%; about 128 d/20f±5%; about 128 d/20f±3%; 129 d/20f±10%; about 129 d/20f±5%; about 129 d/20f±3%; 130 d/20f±10%; about 130 d/20f±5%; about 130 d/20f±3%; about 120 d/25f±10%; about 120 d/25f±5%; about 120 d/25f±3%; 121 d/25f±10%; about 121 d/25f±5%; about 121 d/25f±3%; 122 d/25f±10%; about 122 d/25f±5%; about 122 d/25f±3%; 123 d/25f±10%; about 123 d/25f±5%; about 123 d/25f±3%; 124 d/25f±10%; about 124 d/25f±5%; about 124 d/25f±3%; 125 d/25f±10%; about 125 d/25f±5%; about 125 d/25f±3%; 126 d/25f±10%; about 126 d/25f±5%; about 126 d/25f±3%; 127 d/25f±10%; about 127 d/25f±5%; about 127 d/25f±3%; 128 d/25f±10%; about 128 d/25f±5%; about 128 d/25f±3%; 129 d/25f±10%; about 129 d/25f±5%; about 129 d/25f±3%; 130 d/25f±10%; about 130 d/25f±5%; about 130 d/25f±3%; about 120 d/30f±10%; about 120 d/30f±5%; about 120 d/30f±3%; 121 d/30f±10%; about 121 d/30f±5%; about 121 d/30f±3%; 122 d/30f±10%; about 122 d/30f±5%; about 122 d/30f±3%; 123 d/30f±10%; about 123 d/30f±5%; about 123 d/30f±3%; 124 d/30f±10%; about 124 d/30f±5%; about 124 d/30f±3%; 125 d/30f±10%; about 125 d/30f±5%; about 125 d/30f±3%; 126 d/30f±10%; about 126 d/30f±5%; about 126 d/30f±3%; 127 d/30f±10%; about 127 d/30f±5%; about 127 d/30f±3%; 128 d/30f±10%; about 128 d/30f±5%; about 128 d/30f±3%; 129 d/30f±10%; about 129 d/30f±5%; about 129 d/30f±3%; 130 d/30f±10%; about 130 d/30f±5%; about 130 d/30f±3%; about 120 d/35f±10%; about 120 d/35f±5%; about 120 d/35f±3%; 121 d/35f±10%; about 121 d/35f±5%; about 121 d/35f±3%; 122 d/35f±10%; about 122 d/35f±5%; about 122 d/35f±3%; 123 d/35f±10%; about 123 d/35f±5%; about 123 d/35f±3%; 124 d/35f±10%; about 124 d/35f±5%; about 124 d/35f±3%; 125 d/35f±10%; about 125 d/35f±5%; about 125 d/35f±3%; 126 d/35f±10%; about 126 d/35f±5%; about 126 d/35f±3%; 127 d/35f±10%; about 127 d/35f±5%; about 127 d/35f±3%; 128 d/35f±10%; about 128 d/35f±5%; about 128 d/35f±3%; 129 d/35f±10%; about 129 d/35f±5%; about 129 d/35f±3%; 130 d/35f±10%; about 130 d/35f±5%; about 130 d/35f±3%; about 120 d/40f±10%; about 120 d/40f±5%; about 120 d/40f±3%; 121 d/40f±10%; about 121 d/40f±5%; about 121 d/40f±3%; 122 d/40f±10%; about 122 d/40f±5%; about 122 d/40f±3%; 123 d/40f±10%; about 123 d/40f±5%; about 123 d/40f±3%; 124 d/40f±10%; about 124 d/40f±5%; about 124 d/40f±3%; 125 d/40f±10%; about 125 d/40f±5%; about 125 d/40f±3%; 126 d/40f±10%; about 126 d/40f±5%; about 126 d/40f±3%; 127 d/40f±10%; about 127 d/40f±5%; about 127 d/40f±3%; 128 d/40f±10%; about 128 d/40f±5%; about 128 d/40f±3%; 129 d/40f±10%; about 129 d/40f±5%; about 129 d/40f±3%; 130 d/40f±10%; about 130 d/40f±5%; about 130 d/40f±3%; a range encompassing any of the foregoing value; or any combination of the foregoing values.

In various aspects, the single-covered yarn has a weight of about 250 denier to about 370 denier; about 260 denier to about 370 denier; about 270 denier to about 370 denier; about 280 denier to about 370 denier; about 290 denier to about 370 denier; about 300 denier to about 370 denier; about 310 denier to about 370 denier; about 320 denier to about 370 denier; about 330 denier to about 370 denier; about 340 denier to about 370 denier; about 350 denier to about 370 denier; about 355 denier to about 370 denier; about 360 denier to about 370 denier; about 250 denier to about 360 denier; about 260 denier to about 360 denier; about 270 denier to about 360 denier; about 280 denier to about 360 denier; about 290 denier to about 360 denier; about 300 denier to about 360 denier; about 310 denier to about 360 denier; about 320 denier to about 360 denier; about 330 denier to about 360 denier; about 340 denier to about 360 denier; about 350 denier to about 360 denier; about 250 denier to about 350 denier; about 260 denier to about 350 denier; about 270 denier to about 350 denier; about 280 denier to about 350 denier; about 290 denier to about 350 denier; about 300 denier to about 350 denier; about 310 denier to about 350 denier; about 320 denier to about 350 denier; about 330 denier to about 350 denier; about 340 denier to about 350 denier; about 250 denier to about 340 denier; about 260 denier to about 340 denier; about 270 denier to about 340 denier; about 280 denier to about 340 denier; about 290 denier to about 340 denier; about 300 denier to about 340 denier; about 310 denier to about 340 denier; about 320 denier to about 340 denier; about 330 denier to about 340 denier; about 250 denier to about 330 denier; about 260 denier to about 330 denier; about 270 denier to about 330 denier; about 280 denier to about 330 denier; about 285 denier to about 330 denier; about 290 denier to about 330 denier; about 300 denier to about 330 denier; about 310 denier to about 330 denier; about 320 denier to about 330 denier; about 250 denier to about 320 denier; about 260 denier to about 320 denier; about 270 denier to about 320 denier; about 280 denier to about 320 denier; about 290 denier to about 320 denier; about 300 denier to about 320 denier; about 310 denier to about 320 denier; about 250 denier to about 310 denier; about 260 denier to about 310 denier; about 270 denier to about 310 denier; about 280 denier to about 310 denier; about 290 denier to about 310 denier; about 300 denier to about 310 denier; about 250 denier to about 300 denier; about 260 denier to about 300 denier; about 270 denier to about 300 denier; about 280 denier to about 300 denier; about 290 denier to about 300 denier; about 250 denier to about 350 denier; about 270 denier to about 330 denier; about 280 denier to about 320 denier; about 285 denier to about 310 denier; about 250 denier to about 360 denier; about 270 denier to about 360 denier; about 280 denier to about 360 denier; about 285 denier to about 360 denier; a sub-range within any of the foregoing ranges; or any set of values utilizing values within any of the foregoing ranges.

In a further aspect, the single-covered yarn has a weight of about 270 denier±10%; 270 denier±5%; about 270 denier±3%; about 271 denier±10%; 271 denier±5%; about 271 denier±3%; about 272 denier±10%; 272 denier±5%; about 272 denier±3%; about 273 denier±10%; 273 denier±5%; about 273 denier±3%; about 274 denier±10%; 274 denier±5%; about 274 denier±3%; about 275 denier±10%; 275 denier±5%; about 275 denier±3%; about 276 denier±10%; 276 denier±5%; about 276 denier±3%; about 277 denier±10%; 277 denier±5%; about 277 denier±3%; about 278 denier±10%; 278 denier±5%; about 278 denier±3%; about 279 denier±10%; 279 denier±5%; about 279 denier±3%; about 280 denier±10%; 280 denier±5%; about 280 denier±3%; about 281 denier±10%; 281 denier±5%; about 281 denier±3%; about 282 denier±10%; 282 denier±5%; about 282 denier±3%; about 283 denier±10%; 283 denier±5%; about 283 denier±3%; about 284 denier±10%; 284 denier±5%; about 284 denier±3%; about 285 denier±10%; 285 denier±5%; about 285 denier±3%; about 286 denier±10%; 286 denier±5%; about 286 denier±3%; about 287 denier±10%; 287 denier±5%; about 287 denier±3%; about 288 denier±10%; 288 denier±5%; about 288 denier±3%; about 289 denier±10%; 289 denier±5%; about 289 denier±3%; about 290 denier±10%; 290 denier±5%; about 290 denier±3%; about 291 denier±10%; 291 denier±5%; about 291 denier±3%; about 292 denier±10%; 292 denier±5%; about 292 denier±3%; about 293 denier±10%; 293 denier±5%; about 293 denier±3%; about 294 denier±10%; 294 denier±5%; about 294 denier±3%; about 295 denier±10%; 295 denier±5%; about 295 denier±3%; about 296 denier±10%; 296 denier±5%; about 296 denier±3%; about 297 denier±10%; 297 denier±5%; about 297 denier±3%; about 298 denier±10%; 298 denier±5%; about 298 denier±3%; about 299 denier±10%; 299 denier±5%; about 299 denier±3%; about 300 denier±10%; 300 denier±5%; about 300 denier±3%; about 301 denier±10%; 301 denier±5%; about 301 denier±3%; about 302 denier±10%; 302 denier±5%; about 302 denier±3%; about 303 denier±10%; 303 denier±5%; about 303 denier±3%; about 304 denier±10%; 304 denier±5%; about 304 denier±3%; about 305 denier±10%; 305 denier±5%; about 305 denier±3%; about 306 denier±10%; 306 denier±5%; about 306 denier±3%; about 307 denier±10%; 307 denier±5%; about 307 denier±3%; about 308 denier±10%; 308 denier±5%; about 308 denier±3%; about 309 denier±10%; 309 denier±5%; about 309 denier±3%; about 310 denier±10%; 310 denier±5%; about 310 denier±3%; about 311 denier±10%; 311 denier±5%; about 311 denier±3%; about 312 denier±10%; 312 denier±5%; about 312 denier±3%; about 313 denier±10%; 313 denier±5%; about 313 denier±3%; about 314 denier±10%; 314 denier±5%; about 314 denier±3%; about 315 denier±10%; 315 denier±5%; about 315 denier±3%; about 316 denier±10%; 316 denier±5%; about 316 denier±3%; about 317 denier±10%; 317 denier±5%; about 317 denier±3%; about 318 denier±10%; 318 denier±5%; about 318 denier±3%; about 319 denier±10%; 319 denier±5%; about 319 denier±3%; about 320 denier±10%; 320 denier±5%; about 320 denier±3%; about 321 denier±10%; 321 denier±5%; about 321 denier±3%; about 322 denier±10%; 322 denier±5%; about 322 denier±3%; about 323 denier±10%; 323 denier±5%; about 323 denier±3%; about 324 denier±10%; 324 denier±5%; about 324 denier±3%; about 325 denier±10%; 325 denier±5%; about 325 denier±3%; about 326 denier±10%; 326 denier±5%; about 326 denier±3%; about 327 denier±10%; 327 denier±5%; about 327 denier±3%; about 328 denier±10%; 328 denier±5%; about 328 denier±3%; about 329 denier±10%; 329 denier±5%; about 329 denier±3%; about 330 denier±10%; 330 denier±5%; about 330 denier±3%; about 331 denier±10%; 331 denier±5%; about 331 denier±3%; about 332 denier±10%; 332 denier±5%; about 332 denier±3%; about 333 denier±10%; 333 denier±5%; about 333 denier±3%; about 334 denier±10%; 334 denier±5%; about 334 denier±3%; about 335 denier±10%; 335 denier±5%; about 335 denier±3%; about 336 denier±10%; 336 denier±5%; about 336 denier±3%; about 337 denier±10%; 337 denier±5%; about 337 denier±3%; about 338 denier±10%; 338 denier±5%; about 338 denier±3%; about 339 denier±10%; 339 denier±5%; about 339 denier±3%; about 340 denier±10%; 340 denier±5%; about 340 denier±3%; about 341 denier±10%; 341 denier±5%; about 341 denier±3%; about 342 denier±10%; 342 denier±5%; about 342 denier±3%; about 343 denier±10%; 343 denier±5%; about 343 denier±3%; about 344 denier±10%; 344 denier±5%; about 344 denier±3%; about 345 denier±10%; 345 denier±5%; about 345 denier±3%; about 346 denier±10%; 346 denier±5%; about 346 denier±3%; about 347 denier±10%; 347 denier±5%; about 347 denier±3%; about 348 denier±10%; 348 denier±5%; about 348 denier±3%; about 349 denier±10%; 349 denier±5%; about 349 denier±3%; about 350 denier±10%; 350 denier±5%; about 350 denier±3%; about 351 denier±10%; 351 denier±5%; about 351 denier±3%; about 352 denier±10%; 352 denier±5%; about 352 denier±3%; about 353 denier±10%; 353 denier±5%; about 353 denier±3%; about 354 denier±10%; 354 denier±5%; about 354 denier±3%; about 355 denier±10%; 355 denier±5%; about 355 denier±3%; about 356 denier±10%; 356 denier±5%; about 356 denier±3%; about 357 denier±10%; 357 denier±5%; about 357 denier±3%; about 358 denier±10%; 358 denier±5%; about 358 denier±3%; about 359 denier±10%; 359 denier±5%; about 359 denier±3%; about 360 denier±10%; 360 denier±5%; about 360 denier±3%; about 361 denier±10%; 361 denier±5%; about 361 denier±3%; about 362 denier±10%; 362 denier±5%; about 362 denier±3%; about 363 denier±10%; 363 denier±5%; about 363 denier±3%; about 364 denier±10%; 364 denier±5%; about 364 denier±3%; about 365 denier±10%; 365 denier±5%; about 365 denier±3%; about 366 denier±10%; 366 denier±5%; about 366 denier±3%; about 367 denier±10%; 367 denier±5%; about 367 denier±3%; about 368 denier±10%; 368 denier±5%; about 368 denier±3%; about 369 denier±10%; about 369 denier±5%; about 369 denier±3%; about 370 denier±10%; 370 denier±5%; about 370 denier±3%; about 371 denier±10%; 371 denier±5%; about 371 denier±3%; about 372 denier±10%; 372 denier±5%; about 372 denier±3%; about 373 denier±10%; 373 denier±5%; about 373 denier±3%; about 374 denier±10%; 374 denier±5%; about 374 denier±3%; about 375 denier±10%; 375 denier±5%; about 375 denier±3%; about 376 denier±10%; 376 denier±5%; about 376 denier±3%; about 377 denier±10%; 377 denier±5%; about 377 denier±3%; about 378 denier±10%; 378 denier±5%; about 378 denier±3%; about 379 denier±10%; about 379 denier±5%; about 379 denier±3%; about 380 denier±10%; about 380 denier±5%; about 380 denier±3%; a range encompassing any of the foregoing values; or any combination of the foregoing values.

In an aspect, the first cooling composition can be present in an amount of about 0.01 wt % to about 20 wt % based on the total weight of the single-covered yarn. In a further aspect, the first cooling composition can be present in an amount, based on the total weight of the single-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; a range utilizing any of the foregoing values; a sub-range with a range utilizing any of the foregoing values; or any set of values utilizing the foregoing values.

In an aspect, the second cooling composition can be present in an amount of about 0.01 wt % to about 20 wt % based on the total weight of the single-covered yarn. In a further aspect, the second cooling composition can be present in an amount, based on the total weight of the single-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; a range utilizing any of the foregoing values; a sub-range with a range utilizing any of the foregoing values; or any set of values utilizing the foregoing values.

It is understood herein throughout that reference to a composition comprising an element, e.g., "a composition comprises Al, Ca, Cu, Fe . . . Zr" or "a composition comprises aluminum, calcium, copper, iron . . . zirconium," is intended to be inclusive of any form or valency of the element as appropriate for a given compound or material in which the element is part of the composition of the compound or material, unless otherwise specified. That is, it is understood that a reference to a particular element in a composition or material is inclusive of ionic forms of the element in typical oxidation states for that element if the composition or material comprises the element as an ionic compound; covalently bonded forms of the element if the composition or material comprises the element as an covalent compound; and elemental forms (i.e., oxidation state of 0) as suitable or appropriate for the indicated if the composition or material comprises the element in an oxidation state of 0, e.g., Al as metallic aluminum. Thus, reference to a composition, as discussed above, is intended to comprise ionic, covalent, and elemental forms of the element as disclosed herein.

For example, reference to a composition comprising aluminum refers to forms of aluminum disclosed herein, such as aluminum metal, $Al_2O_3$, tourmaline, and other disclosed aluminum containing minerals and compounds. Similarly, reference to a composition comprising: (a) calcium refers to materials comprising calcium disclosed herein, such as $CaCO_3$, dolomite, tourmaline, and other disclosed calcium containing minerals and compounds; (b) iron refers to materials comprising iron disclosed herein, such as iron metal, alloys comprising iron, $FeCl_2$, FeO, tourmaline, and other disclosed iron containing minerals and compounds; (c) potassium refers to materials comprising potassium disclosed herein, such as $K_2SO_4$, KCl, and other disclosed potassium containing minerals and compounds; (d) magnesium refers to materials comprising magnesium disclosed herein, such as magnesium metal, alloys comprising magnesium, $MgCO_3$, MgO, dolomite, tourmaline, and other disclosed magnesium containing minerals and compounds; (e) sodium refers to forms of sodium disclosed herein, such as sodium salts, tourmaline, and other disclosed sodium containing minerals and compounds; (f) silicon refers to materials comprising silicon disclosed herein, such as SiC, SiO, tourmaline, and other disclosed calcium containing minerals and compounds; and (g) silver refers to materials comprising silver disclosed herein, such as silver, alloys comprising silver, AgO, tourmaline, and other disclosed calcium containing minerals and compounds.

In addition, it is understood herein throughout, that an amount of an element, e.g., weight percent, is the overall weight percent for the element in aggregate as determined by elemental analysis and that the element may be present in one or more chemical and/or physical forms. For example, reference to 5 wt % silver as determined by element analysis refers to the determination that the material comprises 5 wt % silver which may be present in one or more of the disclosed forms of silver such as silver, a silver alloy, and AgO. This understanding extends to other elements that are specified as having been determined to be present at a certain weight percent as determined by elemental analysis.

In a further aspect, the disclosed single covered yarn can comprise a first cooling composition comprising aluminum. Aluminum can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed single covered yarn can comprise a first cooling composition comprising calcium. Calcium can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed single covered yarn can comprise a first cooling composition comprising copper. Copper can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed single covered yarn can comprise a first cooling composition comprising iron. Iron can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed single covered yarn can comprise a first cooling composition comprising magnesium. Magnesium can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed single covered yarn can comprise a first cooling composition comprising potassium. Potassium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed single covered yarn can comprise a first cooling composition comprising silver. Silver can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed single covered yarn can comprise a first cooling composition comprising sodium. Sodium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed single covered yarn can comprise a first cooling composition comprising titanium. Titanium can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed single covered yarn can comprise a first cooling composition comprising zirconium. Zirconium can be present in a first cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

In a further aspect, the disclosed single covered yarn can comprise a second cooling composition comprising aluminum. Aluminum can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed single covered yarn can comprise a second cooling composition comprising calcium. Calcium can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed single covered yarn can comprise a second cooling composition comprising copper. Copper can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed single covered yarn can comprise a second cooling composition comprising iron. Iron can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed single covered yarn can comprise a second cooling composition comprising magnesium. Magnesium can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed single covered yarn can comprise a second cooling composition comprising potassium. Potassium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed single covered yarn can comprise a second cooling composition comprising silver. Silver can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed single covered yarn can comprise a second cooling composition comprising sodium. Sodium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed single covered yarn can comprise a second cooling composition comprising titanium. Titanium can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed single covered yarn can comprise a second cooling composition comprising zirconium. Zirconium can be present in a second cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

The weight percent for a cooling composition in a disclosed single-covered yarn, e.g., a cooling composition comprising aluminum, calcium, copper, iron, magnesium, potassium, silicon, silver, sodium, titanium, zirconium, or combinations, can be the weight percent based upon elemental analysis. In a particular instance, the elemental analysis can be carried out using field emission scanning electron microscopy with a segmented backscatter detector, an Everhart-Thornley electron detector, in-lens electron detectors, or combinations thereof. In some specific instances, the elemental analysis can be carried out using field emission scanning electron microscopy with energy-dispersive spectroscopy.

E. Double-Covered Yarns

In one aspect, the disclosure relates to double-covered yarns that can be utilized in a woven or knit fabric. In various aspects, a disclosed double-covered yarn comprises an elastic core comprising an elastic yarn or fiber; a first fiber comprising a disclosed composite fiber; and a second fiber comprising a cellulosic fiber. More specifically, in one aspect, the present disclosure relates to a double-covered yarn comprising: (a) an elastic core comprising an elastic yarn; (b) a first fiber comprising a disclosed composite fiber; and (c) a second fiber comprising a cellulosic fiber; wherein the first fiber is wound around the elastic core to form a single-covered yarn; and wherein the second fiber is wound around the single-covered yarn to form a double-covered yarn. In a further aspect, a disclosed double-covered yarn double-covered yarn comprising: (a) an elastic core comprising an elastic yarn; (b) a first fiber comprising a disclosed composite fiber; and (c) a second fiber comprising a cellulosic fiber; wherein the first fiber is wound around the elastic core to form a single-covered yarn; and wherein the second fiber is wound around the single-covered yarn to form a double-covered yarn; wherein the elastic core is present in an amount of from about 1 wt % to about 15 wt %; wherein the first fiber is present in an amount of from about 20 wt % to about 80 wt %; wherein the second fiber is present in an amount of from about 80 wt % to about 20 wt %; wherein the weight percent is based upon the total weight of the double-covered yarn, and provided that the total weight percent of the elastic yarn, the first fiber, and the second fiber is from about 90 wt % to about 100 wt %.

In various aspects, a disclosed double-covered yarn comprises about 1 wt % to about 15 wt % of an elastic yarn; about 35 wt % to about 55 wt % of first fiber comprising a disclosed composite fiber; and about 35 wt % to about 60 wt % of a second fiber comprising a cellulosic fiber; and wherein the weight percent is based upon the total weight of the double-covered yarn, and provided that the total weight percent of the elastic yarn, the first fiber, and the second fiber is from about 90 wt % to about 100 wt %. In a further aspect, a disclosed double-covered yarn comprises about 3 wt % to about 12 wt % of an elastic yarn; about 38 wt % to about 52 wt % of first fiber comprising a disclosed composite fiber; and about 40 wt % to about 50 wt % of a second fiber comprising a cellulosic fiber; and wherein the weight percent is based upon the total weight of the double-covered yarn, and provided that the total weight percent of the elastic yarn, the first fiber, and the second fiber is from about 90 wt % to about 100 wt %. In a still further aspect, a disclosed double-covered yarn comprises about 5 wt % to about 10 wt % of an elastic yarn; about 40 wt % to about 50 wt % of first fiber comprising a disclosed composite fiber; and about 42 wt % to about 48 wt % of a second fiber comprising a cellulosic fiber; and wherein the weight percent is based upon the total weight of the double-covered yarn, and provided that the total weight percent of the elastic yarn, the first fiber, and the second fiber is from about 90 wt % to about 100 wt %.

In a further aspect, a double-covered yarn comprises an elastic yarn in a weight percent amount based on the total weight of the double-covered yarn of about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; a range utilizing any of the foregoing values; a sub-range with a range utilizing any of the foregoing values; or any set of values utilizing the foregoing values, and provided that the total weight percent of the elastic yarn, the first fiber, and the second fiber is from about 90 wt % to about 100 wt %.

In a further aspect, a double-covered yarn comprises a first fiber in a weight percent amount based on the total weight of the double-covered yarn of about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; about 25.1 wt %; about 25.2 wt %; about 25.3 wt %; about 25.4 wt %; about 25.5 wt %; about 25.6 wt %; about 25.7 wt %; about 25.8 wt %; about 25.9 wt %; about 26.0 wt %; about 26.1 wt %; about 26.2 wt %; about 26.3 wt %; about 26.4 wt %; about 26.5 wt %; about 26.6 wt %; about 26.7 wt %; about 26.8 wt %; about 26.9 wt %; about 27.0 wt %; about 27.1 wt %; about 27.2 wt %; about 27.3 wt %; about 27.4 wt %; about 27.5 wt %; about 27.6 wt %; about 27.7 wt %; about 27.8 wt %; about 27.9 wt %; about 28.0 wt %; about 28.1 wt %; about 28.2 wt %; about 28.3 wt %; about 28.4 wt %; about 28.5 wt %; about 28.6 wt %; about 28.7 wt %; about 28.8 wt %; about 28.9 wt %; about 29.0 wt %; about 29.1 wt %; about 29.2 wt %; about 29.3 wt %; about 29.4 wt %; about 29.5 wt %; about 29.6 wt %; about 29.7 wt %; about 29.8 wt %; about 29.9 wt %; about 30.0 wt %; about 30.1 wt %; about 30.2 wt %; about 30.3 wt %; about 30.4 wt %; about 30.5 wt %; about 30.6 wt %; about 30.7 wt %; about 30.8 wt %; about 30.9 wt %; about 31.0 wt %; about 31.1 wt %; about 31.2 wt %; about 31.3 wt %; about 31.4 wt %; about 31.5 wt %; about 31.6 wt %; about 31.7 wt %; about 31.8 wt %; about 31.9 wt %; about 32.0 wt %; about 32.1 wt %; about 32.2 wt %; about 32.3 wt %; about 32.4 wt %; about 32.5 wt %; about 32.6 wt %; about 32.7 wt %; about 32.8 wt %; about 32.9 wt %; about 33.0 wt %; about 33.1 wt %; about 33.2 wt %; about 33.3 wt %; about 33.4 wt %; about 33.5 wt %; about 33.6 wt %; about 33.7 wt %; about 33.8 wt %; about 33.9 wt %; about 34.0 wt %; about 34.1 wt %; about 34.2 wt %; about 34.3 wt %; about 34.4 wt %; about 34.5 wt %; about 34.6 wt %; about 34.7 wt %; about 34.8 wt %; about 34.9 wt %; about 35.0 wt %; about 35.1 wt %; about 35.2 wt %; about 35.3 wt %; about 35.4 wt %; about 35.5 wt %; about 35.6 wt %; about 35.7 wt %; about 35.8 wt %; about 35.9 wt %; about 36.0 wt %; about 36.1 wt %; about 36.2 wt %; about 36.3 wt %; about 36.4 wt %; about 36.5 wt %; about 36.6 wt %; about 36.7 wt %; about 36.8 wt %; about 36.9 wt %; about 37.0 wt %; about 37.1 wt %; about 37.2 wt %; about 37.3 wt %; about 37.4 wt %; about 37.5 wt %; about 37.6 wt %; about 37.7 wt %; about 37.8 wt %; about 37.9 wt %; about 38.0 wt %; about 38.1 wt %; about 38.2 wt %; about 38.3 wt %; about 38.4 wt %; about 38.5 wt %; about 38.6 wt %; about 38.7 wt %; about 38.8 wt %; about 38.9 wt %; about 39.0 wt %; about 39.1 wt %; about 39.2 wt %; about 39.3 wt %; about 39.4 wt %; about 39.5 wt %; about 39.6 wt %; about 39.7 wt %; about 39.8 wt %; about 39.9 wt %; about 40.0 wt %; about 40.1 wt %; about 40.2 wt %; about 40.3 wt %; about 40.4 wt %; about 40.5 wt %; about 40.6 wt %; about 40.7 wt %; about 40.8 wt %; about 40.9 wt %; about 41.0 wt %; about 41.1 wt %; about 41.2 wt %; about 41.3 wt %; about 41.4 wt %; about 41.5 wt %; about 41.6 wt %; about 41.7 wt %; about 41.8 wt %; about 41.9 wt %; about 42.0 wt %; about 42.1 wt %; about 42.2 wt %; about 42.3 wt %; about 42.4 wt %; about 42.5 wt %; about 42.6 wt %; about 42.7 wt %; about 42.8 wt %; about 42.9 wt %; about 43.0 wt %; about 43.1 wt %; about 43.2 wt %; about 43.3 wt %; about 43.4 wt %; about 43.5 wt %; about 43.6 wt %; about 43.7 wt %; about 43.8 wt %; about 43.9 wt %; about 44.0 wt %; about 44.1 wt %; about 44.2 wt %; about 44.3 wt %; about 44.4 wt %; about 44.5 wt %; about 44.6 wt %; about 44.7 wt %; about 44.8 wt %; about 44.9 wt %; about 45.0 wt %; about 45.1 wt %; about 45.2 wt %; about 45.3 wt %; about 45.4 wt %; about 45.5 wt %; about 45.6 wt %; about 45.7 wt %; about 45.8 wt %; about 45.9 wt %; about 46.0 wt %; about 46.1 wt %; about 46.2 wt %; about 46.3 wt %; about 46.4 wt %; about 46.5 wt %; about 46.6 wt %; about 46.7 wt %; about 46.8 wt %; about 46.9 wt %; about 47.0 wt %; about 47.1 wt %; about 47.2 wt %; about 47.3 wt %; about 47.4 wt %; about 47.5 wt %; about 47.6 wt %; about 47.7 wt %; about 47.8 wt %; about 47.9 wt %; about 48.0 wt %; about 48.1 wt %; about 48.2 wt %; about 48.3 wt %; about 48.4 wt %; about 48.5 wt %; about 48.6 wt %; about 48.7 wt %; about 48.8 wt %; about 48.9 wt %; about 49.0 wt %; about 49.1 wt %; about 49.2 wt %; about 49.3 wt %; about 49.4 wt %; about 49.5 wt %; about 49.6 wt %; about 49.7 wt %; about 49.8 wt %; about 49.9 wt %; about 50.0 wt %; about 50.1 wt %; about 50.2 wt %; about 50.3 wt %; about 50.4 wt %; about 50.5 wt %; about 50.6 wt %; about 50.7 wt %; about 50.8 wt %; about 50.9 wt %; about 51.0 wt %; about 51.1 wt %; about 51.2 wt %; about 51.3 wt %; about 51.4 wt %; about 51.5 wt %; about 51.6 wt %; about 51.7 wt %; about 51.8 wt %; about 51.9 wt %; about 52.0 wt %; about 52.1 wt %; about 52.2 wt %; about 52.3 wt %; about 52.4 wt %; about 52.5 wt %; about 52.6 wt %; about 52.7 wt %; about 52.8 wt %; about 52.9 wt %; about 53.0 wt %; about 53.1 wt %; about 53.2 wt %; about 53.3 wt %; about 53.4 wt %; about 53.5 wt %; about 53.6 wt %; about 53.7 wt %; about 53.8 wt %; about 53.9 wt %; about 54.0 wt %; about 54.1 wt %; about 54.2 wt %; about 54.3 wt %; about 54.4 wt %; about 54.5 wt %; about 54.6 wt %; about 54.7 wt %; about 54.8 wt %; about 54.9 wt %; about 55.0 wt %; about 55.1 wt %; about 55.2 wt %; about 55.3 wt %; about 55.4 wt %; about 55.5 wt %; about 55.6 wt %; about 55.7 wt %; about 55.8 wt %; about 55.9 wt %; about 56.0 wt %; about 56.1 wt %; about 56.2 wt %; about 56.3 wt %; about 56.4 wt %; about 56.5 wt %; about 56.6 wt %; about 56.7 wt %; about 56.8 wt %; about 56.9 wt %; about 57.0 wt %; about 57.1 wt %; about 57.2 wt %; about 57.3 wt %; about 57.4 wt %; about 57.5 wt %; about 57.6 wt %; about 57.7 wt %; about 57.8 wt %; about 57.9 wt %; about 58.0 wt %; about 58.1 wt %; about 58.2 wt %; about 58.3 wt %; about 58.4 wt %; about 58.5 wt %; about 58.6 wt %; about 58.7 wt %; about 58.8 wt %; about 58.9 wt %; about 59.0 wt %; about 59.1 wt %; about 59.2 wt %; about 59.3 wt %; about 59.4 wt %; about 59.5 wt %; about 59.6 wt %; about 59.7 wt %; about 59.8 wt %; about 59.9 wt %; about 60.0 wt %; about 60.1 wt %; about 60.2 wt %; about 60.3 wt %; about 60.4 wt %; about 60.5 wt %; about 60.6 wt %; about 60.7 wt %; about 60.8 wt %; about 60.9 wt %; about 61.0 wt %; about 61.1 wt %; about 61.2 wt %; about 61.3 wt %; about 61.4 wt %; about 61.5 wt %; about 61.6 wt %; about 61.7 wt %; about 61.8 wt %; about 61.9 wt %; about 62.0 wt %; about 62.1 wt %; about 62.2 wt %; about 62.3 wt %; about 62.4 wt %; about 62.5 wt %; about 62.6 wt %; about 62.7 wt %; about 62.8 wt %; about 62.9 wt %; about 63.0 wt %; about 63.1 wt %; about 63.2 wt %; about 63.3 wt %; about 63.4 wt %; about 63.5 wt %; about 63.6 wt %; about 63.7 wt %; about 63.8 wt %; about 63.9 wt %; about 64.0 wt %; about 64.1 wt %; about 64.2 wt %; about 64.3 wt %; about 64.4 wt %; about 64.5 wt %; about 64.6 wt %; about 64.7 wt %; about 64.8 wt %; about 64.9 wt %; about 65.0 wt %; about 65.1 wt %; about 65.2 wt %; about 65.3 wt %; about 65.4 wt %; about 65.5 wt %; about 65.6 wt %; about 65.7 wt %; about 65.8 wt %; about 65.9 wt %; about 66.0 wt %; about 66.1 wt %; about 66.2 wt %; about 66.3 wt %; about 66.4 wt %; about 66.5 wt %; about 66.6 wt %; about 66.7 wt %; about 66.8 wt %; about 66.9 wt %; about 67.0 wt %; about 67.1 wt %; about 67.2 wt %; about 67.3 wt %; about 67.4 wt %; about 67.5 wt %; about 67.6 wt %; about 67.7 wt %; about 67.8 wt %; about 67.9 wt %; about 68.0 wt %; about 68.1 wt %; about 68.2 wt %; about 68.3 wt %; about 68.4 wt %; about 68.5 wt %; about 68.6 wt %; about 68.7 wt %; about 68.8 wt %; about 68.9 wt %; about 69.0 wt %; about 69.1 wt %; about 69.2 wt %; about 69.3 wt %; about 69.4 wt %; about 69.5 wt %; about 69.6 wt %; about 69.7 wt %; about 69.8 wt %; about 69.9 wt %; about 70.0 wt %; about 70.1 wt %; about 70.2 wt %; about 70.3 wt %; about 70.4 wt %; about 70.5 wt %; about 70.6 wt %; about 70.7 wt %; about 70.8 wt %; about 70.9 wt %; about 71.0 wt %; about 71.1 wt %; about 71.2 wt %; about 71.3 wt %; about 71.4 wt %; about 71.5 wt %; about 71.6 wt %; about 71.7 wt %; about 71.8 wt %; about 71.9 wt %; about 72.0 wt %; about 72.1 wt %; about 72.2 wt %; about 72.3 wt %; about 72.4 wt %; about 72.5 wt %; about 72.6 wt %; about 72.7 wt %; about 72.8 wt %; about 72.9 wt %; about 73.0 wt %; about 73.1 wt %; about 73.2 wt %; about 73.3 wt %; about 73.4 wt %; about 73.5 wt %; about 73.6 wt %; about 73.7 wt %; about 73.8 wt %; about 73.9 wt %; about 74.0 wt %; about 74.1 wt %; about 74.2 wt %; about 74.3 wt %; about 74.4 wt %; about 74.5 wt %; about 74.6 wt %; about 74.7 wt %; about 74.8 wt %; about 74.9 wt %; about 75.0 wt %; about 75.1 wt %; about 75.2 wt %; about 75.3 wt %; about 75.4 wt %; about 75.5 wt %; about 75.6 wt %; about 75.7 wt %; about 75.8 wt %; about 75.9 wt %; about 76.0 wt %; about 76.1 wt %; about 76.2 wt %; about 76.3 wt %; about 76.4 wt %; about 76.5 wt %; about 76.6 wt %; about 76.7 wt %; about 76.8 wt %; about 76.9 wt %; about 77.0 wt %; about 77.1 wt %; about 77.2 wt %; about 77.3 wt %; about 77.4 wt %; about 77.5 wt %; about 77.6 wt %; about 77.7 wt %;

about 77.8 wt %; about 77.9 wt %; about 78.0 wt %; about 78.1 wt %; about 78.2 wt %; about 78.3 wt %; about 78.4 wt %; about 78.5 wt %; about 78.6 wt %; about 78.7 wt %; about 78.8 wt %; about 78.9 wt %; about 79.0 wt %; about 79.1 wt %; about 79.2 wt %; about 79.3 wt %; about 79.4 wt %; about 79.5 wt %; about 79.6 wt %; about 79.7 wt %; about 79.8 wt %; about 79.9 wt %; about 80.0 wt %; a range utilizing any of the foregoing values; a sub-range with a range utilizing any of the foregoing values; or any set of values utilizing the foregoing values, and provided that the total weight percent of the elastic yarn, the second fiber, and the second yarn is from about 90 wt % to about 100 wt %.

In a further aspect, a double-covered yarn comprises a second fiber in a weight percent amount based on the total weight of the double-covered yarn of about 20.0 wt %; about 20.1 wt %; about 20.2 wt %; about 20.3 wt %; about 20.4 wt %; about 20.5 wt %; about 20.6 wt %; about 20.7 wt %; about 20.8 wt %; about 20.9 wt %; about 21.0 wt %; about 21.1 wt %; about 21.2 wt %; about 21.3 wt %; about 21.4 wt %; about 21.5 wt %; about 21.6 wt %; about 21.7 wt %; about 21.8 wt %; about 21.9 wt %; about 22.0 wt %; about 22.1 wt %; about 22.2 wt %; about 22.3 wt %; about 22.4 wt %; about 22.5 wt %; about 22.6 wt %; about 22.7 wt %; about 22.8 wt %; about 22.9 wt %; about 23.0 wt %; about 23.1 wt %; about 23.2 wt %; about 23.3 wt %; about 23.4 wt %; about 23.5 wt %; about 23.6 wt %; about 23.7 wt %; about 23.8 wt %; about 23.9 wt %; about 24.0 wt %; about 24.1 wt %; about 24.2 wt %; about 24.3 wt %; about 24.4 wt %; about 24.5 wt %; about 24.6 wt %; about 24.7 wt %; about 24.8 wt %; about 24.9 wt %; about 25.0 wt %; about 25.1 wt %; about 25.2 wt %; about 25.3 wt %; about 25.4 wt %; about 25.5 wt %; about 25.6 wt %; about 25.7 wt %; about 25.8 wt %; about 25.9 wt %; about 26.0 wt %; about 26.1 wt %; about 26.2 wt %; about 26.3 wt %; about 26.4 wt %; about 26.5 wt %; about 26.6 wt %; about 26.7 wt %; about 26.8 wt %; about 26.9 wt %; about 27.0 wt %; about 27.1 wt %; about 27.2 wt %; about 27.3 wt %; about 27.4 wt %; about 27.5 wt %; about 27.6 wt %; about 27.7 wt %; about 27.8 wt %; about 27.9 wt %; about 28.0 wt %; about 28.1 wt %; about 28.2 wt %; about 28.3 wt %; about 28.4 wt %; about 28.5 wt %; about 28.6 wt %; about 28.7 wt %; about 28.8 wt %; about 28.9 wt %; about 29.0 wt %; about 29.1 wt %; about 29.2 wt %; about 29.3 wt %; about 29.4 wt %; about 29.5 wt %; about 29.6 wt %; about 29.7 wt %; about 29.8 wt %; about 29.9 wt %; about 30.0 wt %; about 30.1 wt %; about 30.2 wt %; about 30.3 wt %; about 30.4 wt %; about 30.5 wt %; about 30.6 wt %; about 30.7 wt %; about 30.8 wt %; about 30.9 wt %; about 31.0 wt %; about 31.1 wt %; about 31.2 wt %; about 31.3 wt %; about 31.4 wt %; about 31.5 wt %; about 31.6 wt %; about 31.7 wt %; about 31.8 wt %; about 31.9 wt %; about 32.0 wt %; about 32.1 wt %; about 32.2 wt %; about 32.3 wt %; about 32.4 wt %; about 32.5 wt %; about 32.6 wt %; about 32.7 wt %; about 32.8 wt %; about 32.9 wt %; about 33.0 wt %; about 33.1 wt %; about 33.2 wt %; about 33.3 wt %; about 33.4 wt %; about 33.5 wt %; about 33.6 wt %; about 33.7 wt %; about 33.8 wt %; about 33.9 wt %; about 34.0 wt %; about 34.1 wt %; about 34.2 wt %; about 34.3 wt %; about 34.4 wt %; about 34.5 wt %; about 34.6 wt %; about 34.7 wt %; about 34.8 wt %; about 34.9 wt %; about 35.0 wt %; about 35.1 wt %; about 35.2 wt %; about 35.3 wt %; about 35.4 wt %; about 35.5 wt %; about 35.6 wt %; about 35.7 wt %; about 35.8 wt %; about 35.9 wt %; about 36.0 wt %; about 36.1 wt %; about 36.2 wt %; about 36.3 wt %; about 36.4 wt %; about 36.5 wt %; about 36.6 wt %; about 36.7 wt %; about 36.8 wt %; about 36.9 wt %; about 37.0 wt %; about 37.1 wt %; about 37.2 wt %; about 37.3 wt %; about 37.4 wt %; about 37.5 wt %; about 37.6 wt %; about 37.7 wt %; about 37.8 wt %; about 37.9 wt %; about 38.0 wt %; about 38.1 wt %; about 38.2 wt %; about 38.3 wt %; about 38.4 wt %; about 38.5 wt %; about 38.6 wt %; about 38.7 wt %; about 38.8 wt %; about 38.9 wt %; about 39.0 wt %; about 39.1 wt %; about 39.2 wt %; about 39.3 wt %; about 39.4 wt %; about 39.5 wt %; about 39.6 wt %; about 39.7 wt %; about 39.8 wt %; about 39.9 wt %; about 40.0 wt %; about 40.1 wt %; about 40.2 wt %; about 40.3 wt %; about 40.4 wt %; about 40.5 wt %; about 40.6 wt %; about 40.7 wt %; about 40.8 wt %; about 40.9 wt %; about 41.0 wt %; about 41.1 wt %; about 41.2 wt %; about 41.3 wt %; about 41.4 wt %; about 41.5 wt %; about 41.6 wt %; about 41.7 wt %; about 41.8 wt %; about 41.9 wt %; about 42.0 wt %; about 42.1 wt %; about 42.2 wt %; about 42.3 wt %; about 42.4 wt %; about 42.5 wt %; about 42.6 wt %; about 42.7 wt %; about 42.8 wt %; about 42.9 wt %; about 43.0 wt %; about 43.1 wt %; about 43.2 wt %; about 43.3 wt %; about 43.4 wt %; about 43.5 wt %; about 43.6 wt %; about 43.7 wt %; about 43.8 wt %; about 43.9 wt %; about 44.0 wt %; about 44.1 wt %; about 44.2 wt %; about 44.3 wt %; about 44.4 wt %; about 44.5 wt %; about 44.6 wt %; about 44.7 wt %; about 44.8 wt %; about 44.9 wt %; about 45.0 wt %; about 45.1 wt %; about 45.2 wt %; about 45.3 wt %; about 45.4 wt %; about 45.5 wt %; about 45.6 wt %; about 45.7 wt %; about 45.8 wt %; about 45.9 wt %; about 46.0 wt %; about 46.1 wt %; about 46.2 wt %; about 46.3 wt %; about 46.4 wt %; about 46.5 wt %; about 46.6 wt %; about 46.7 wt %; about 46.8 wt %; about 46.9 wt %; about 47.0 wt %; about 47.1 wt %; about 47.2 wt %; about 47.3 wt %; about 47.4 wt %; about 47.5 wt %; about 47.6 wt %; about 47.7 wt %; about 47.8 wt %; about 47.9 wt %; about 48.0 wt %; about 48.1 wt %; about 48.2 wt %; about 48.3 wt %; about 48.4 wt %; about 48.5 wt %; about 48.6 wt %; about 48.7 wt %; about 48.8 wt %; about 48.9 wt %; about 49.0 wt %; about 49.1 wt %; about 49.2 wt %; about 49.3 wt %; about 49.4 wt %; about 49.5 wt %; about 49.6 wt %; about 49.7 wt %; about 49.8 wt %; about 49.9 wt %; about 50.0 wt %; about 50.1 wt %; about 50.2 wt %; about 50.3 wt %; about 50.4 wt %; about 50.5 wt %; about 50.6 wt %; about 50.7 wt %; about 50.8 wt %; about 50.9 wt %; about 51.0 wt %; about 51.1 wt %; about 51.2 wt %; about 51.3 wt %; about 51.4 wt %; about 51.5 wt %; about 51.6 wt %; about 51.7 wt %; about 51.8 wt %; about 51.9 wt %; about 52.0 wt %; about 52.1 wt %; about 52.2 wt %; about 52.3 wt %; about 52.4 wt %; about 52.5 wt %; about 52.6 wt %; about 52.7 wt %; about 52.8 wt %; about 52.9 wt %; about 53.0 wt %; about 53.1 wt %; about 53.2 wt %; about 53.3 wt %; about 53.4 wt %; about 53.5 wt %; about 53.6 wt %; about 53.7 wt %; about 53.8 wt %; about 53.9 wt %; about 54.0 wt %; about 54.1 wt %; about 54.2 wt %; about 54.3 wt %; about 54.4 wt %; about 54.5 wt %; about 54.6 wt %; about 54.7 wt %; about 54.8 wt %; about 54.9 wt %; about 55.0 wt %; about 55.1 wt %; about 55.2 wt %; about 55.3 wt %; about 55.4 wt %; about 55.5 wt %; about 55.6 wt %; about 55.7 wt %; about 55.8 wt %; about 55.9 wt %; about 56.0 wt %; about 56.1 wt %; about 56.2 wt %; about 56.3 wt %; about 56.4 wt %; about 56.5 wt %; about 56.6 wt %; about 56.7 wt %; about 56.8 wt %; about 56.9 wt %; about 57.0 wt %; about 57.1 wt %; about 57.2 wt %; about 57.3 wt %; about 57.4 wt %; about 57.5 wt %; about 57.6 wt %; about 57.7 wt %; about 57.8 wt %; about 57.9 wt %; about 58.0 wt %; about 58.1 wt %; about 58.2 wt %; about 58.3 wt %; about 58.4 wt %; about 58.5 wt %; about 58.6 wt %; about 58.7 wt %; about 58.8 wt %; about 58.9 wt %; about 59.0 wt %; about 59.1 wt %; about 59.2 wt %; about 59.3 wt %; about 59.4 wt %; about 59.5 wt %; about 59.6 wt %; about 59.7 wt %;

about 59.8 wt %; about 59.9 wt %; about 60.0 wt %; about 60.1 wt %; about 60.2 wt %; about 60.3 wt %; about 60.4 wt %; about 60.5 wt %; about 60.6 wt %; about 60.7 wt %; about 60.8 wt %; about 60.9 wt %; about 61.0 wt %; about 61.1 wt %; about 61.2 wt %; about 61.3 wt %; about 61.4 wt %; about 61.5 wt %; about 61.6 wt %; about 61.7 wt %; about 61.8 wt %; about 61.9 wt %; about 62.0 wt %; about 62.1 wt %; about 62.2 wt %; about 62.3 wt %; about 62.4 wt %; about 62.5 wt %; about 62.6 wt %; about 62.7 wt %; about 62.8 wt %; about 62.9 wt %; about 63.0 wt %; about 63.1 wt %; about 63.2 wt %; about 63.3 wt %; about 63.4 wt %; about 63.5 wt %; about 63.6 wt %; about 63.7 wt %; about 63.8 wt %; about 63.9 wt %; about 64.0 wt %; about 64.1 wt %; about 64.2 wt %; about 64.3 wt %; about 64.4 wt %; about 64.5 wt %; about 64.6 wt %; about 64.7 wt %; about 64.8 wt %; about 64.9 wt %; about 65.0 wt %; about 65.1 wt %; about 65.2 wt %; about 65.3 wt %; about 65.4 wt %; about 65.5 wt %; about 65.6 wt %; about 65.7 wt %; about 65.8 wt %; about 65.9 wt %; about 66.0 wt %; about 66.1 wt %; about 66.2 wt %; about 66.3 wt %; about 66.4 wt %; about 66.5 wt %; about 66.6 wt %; about 66.7 wt %; about 66.8 wt %; about 66.9 wt %; about 67.0 wt %; about 67.1 wt %; about 67.2 wt %; about 67.3 wt %; about 67.4 wt %; about 67.5 wt %; about 67.6 wt %; about 67.7 wt %; about 67.8 wt %; about 67.9 wt %; about 68.0 wt %; about 68.1 wt %; about 68.2 wt %; about 68.3 wt %; about 68.4 wt %; about 68.5 wt %; about 68.6 wt %; about 68.7 wt %; about 68.8 wt %; about 68.9 wt %; about 69.0 wt %; about 69.1 wt %; about 69.2 wt %; about 69.3 wt %; about 69.4 wt %; about 69.5 wt %; about 69.6 wt %; about 69.7 wt %; about 69.8 wt %; about 69.9 wt %; about 70.0 wt %; about 70.1 wt %; about 70.2 wt %; about 70.3 wt %; about 70.4 wt %; about 70.5 wt %; about 70.6 wt %; about 70.7 wt %; about 70.8 wt %; about 70.9 wt %; about 71.0 wt %; about 71.1 wt %; about 71.2 wt %; about 71.3 wt %; about 71.4 wt %; about 71.5 wt %; about 71.6 wt %; about 71.7 wt %; about 71.8 wt %; about 71.9 wt %; about 72.0 wt %; about 72.1 wt %; about 72.2 wt %; about 72.3 wt %; about 72.4 wt %; about 72.5 wt %; about 72.6 wt %; about 72.7 wt %; about 72.8 wt %; about 72.9 wt %; about 73.0 wt %; about 73.1 wt %; about 73.2 wt %; about 73.3 wt %; about 73.4 wt %; about 73.5 wt %; about 73.6 wt %; about 73.7 wt %; about 73.8 wt %; about 73.9 wt %; about 74.0 wt %; about 74.1 wt %; about 74.2 wt %; about 74.3 wt %; about 74.4 wt %; about 74.5 wt %; about 74.6 wt %; about 74.7 wt %; about 74.8 wt %; about 74.9 wt %; about 75.0 wt %; about 75.1 wt %; about 75.2 wt %; about 75.3 wt %; about 75.4 wt %; about 75.5 wt %; about 75.6 wt %; about 75.7 wt %; about 75.8 wt %; about 75.9 wt %; about 76.0 wt %; about 76.1 wt %; about 76.2 wt %; about 76.3 wt %; about 76.4 wt %; about 76.5 wt %; about 76.6 wt %; about 76.7 wt %; about 76.8 wt %; about 76.9 wt %; about 77.0 wt %; about 77.1 wt %; about 77.2 wt %; about 77.3 wt %; about 77.4 wt %; about 77.5 wt %; about 77.6 wt %; about 77.7 wt %; about 77.8 wt %; about 77.9 wt %; about 78.0 wt %; about 78.1 wt %; about 78.2 wt %; about 78.3 wt %; about 78.4 wt %; about 78.5 wt %; about 78.6 wt %; about 78.7 wt %; about 78.8 wt %; about 78.9 wt %; about 79.0 wt %; about 79.1 wt %; about 79.2 wt %; about 79.3 wt %; about 79.4 wt %; about 79.5 wt %; about 79.6 wt %; about 79.7 wt %; about 79.8 wt %; about 79.9 wt %; about 80.0 wt %; a range utilizing any of the foregoing values; a sub-range with a range utilizing any of the foregoing values; or any set of values utilizing the foregoing values, and provided that the total weight percent of the elastic yarn, the second fiber, and the second yarn is from about 90 wt % to about 100 wt %.

In a further aspect, the elastic core of the double-covered yarn comprises an elastic yarn such as a spandex yarn, a polyester yarn, or combinations thereof. The polyester yarn in the elastic core of the double-covered yarn can comprise polyethylene terephthalate, a polytrimethylene terephthalate, or combinations thereof. In some aspects, the elastic core of the double-covered yarn can comprise a composite filament of polyethylene terephthalate and polytrimethylene terephthalate; and wherein the filament has the polyethylene terephthalate and polytrimethylene terephthalate arranged side-by-side. In a still further aspect, the elastic core of the double-covered yarn can comprise a spandex yarn and a polyester yarn comprising polyethylene terephthalate, a polytrimethylene terephthalate, or combinations thereof.

Figure 7A:
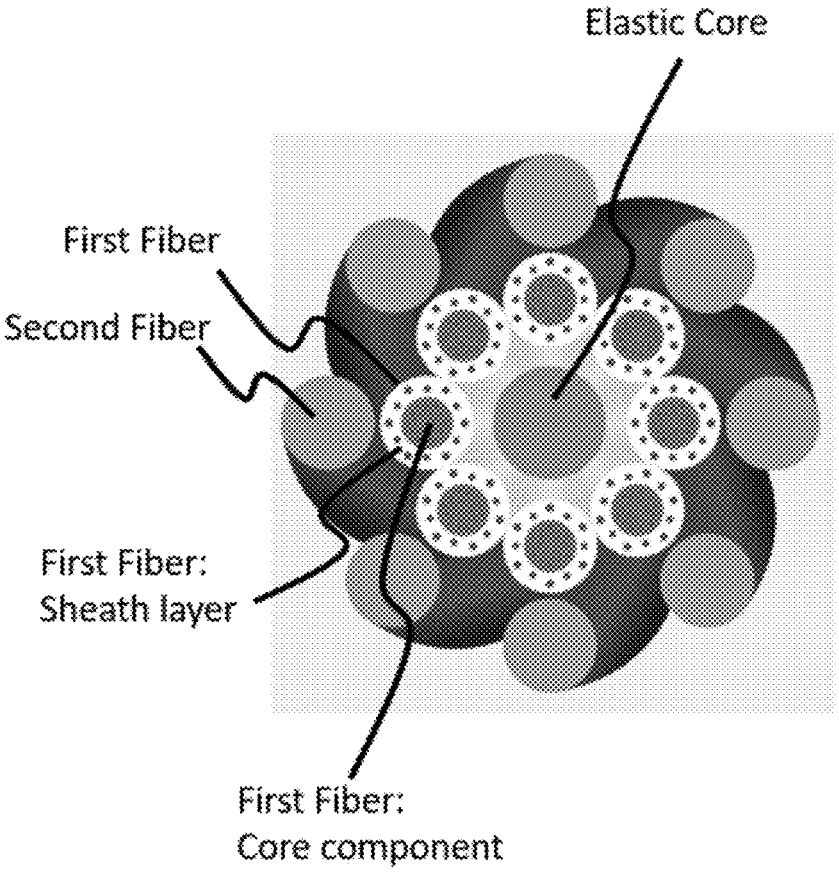
FIGS. 7A-7B show a representative cross-sectional views of disclosed double-covered yarns.
Figure 7B:
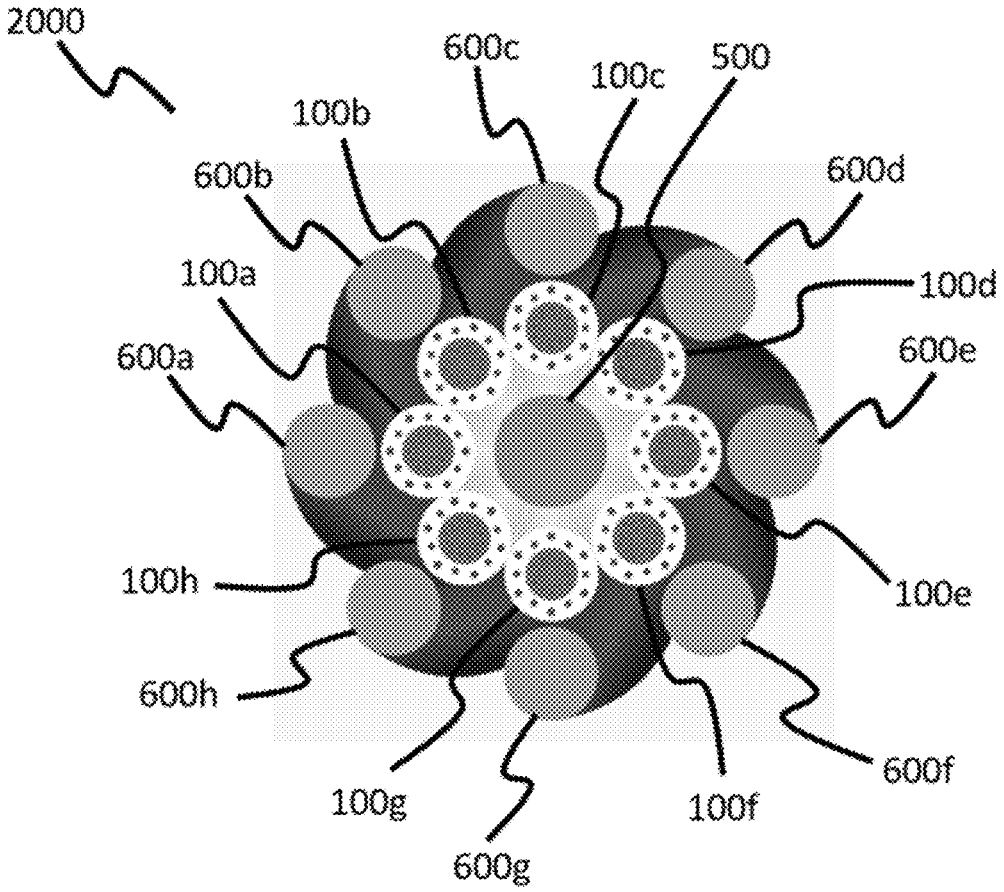

Referring now to FIGS. 7A-7B, which show representative cross-sectional views of disclosed double-covered yarns. FIG. 7A shows a schematic cross-sectional view of a disclosed double-covered yarn comprising a cellulosic fiber (e.g., a viscose rayon), a composite fiber, and an elastic core (e.g., a spandex yarn). FIG. 7B shows a cross-sectional view of a disclosed double-covered yarn, 2000, with aspects specified as follows: (a) an elastic core, 500, comprising an elastic yarn; (b) a plurality of first fibers, 100*a*-100*h*, each comprising a disclosed composite fiber, such as that shown in FIG. 1B, comprising a core component comprising a polyester polymer and a first cooling composition, and a sheath layer comprising a polyamide polymer and a second cooling composition; and (c) a plurality of second fibers, 600*a*-600*h*, comprising a cellulosic fiber; such that the plurality of first fibers are wound around the elastic core to form a single-covered yarn; and the plurality of second fibers are wound around the single-covered yarn to form a double-covered yarn.

In various aspects, the elastic yarn in the elastic corn of the double-covered yarn has a weight of about 30 denier to about 50 denier; about 35 denier to about 45 denier; about 36 denier to about 44 denier; about 37 denier to about 43 denier; about 38 denier to about 42 denier; about 39 denier to about 41 denier; or a sub-range within any of the foregoing ranges.

In a further aspect, the elastic yarn in the elastic corn of the double-covered yarn has a stretch rate is about 2.5 to about 5; about 3 to about 4; about 3.2 to about 3.8; or a sub-range within any of the foregoing ranges.

In various aspects, the double-covered yarn can utilize a first fiber, comprising a disclosed composite fiber, having a weight of about 120 denier to about 600 denier; about 130 denier to about 500 denier; about 140 denier to about 400 denier; a sub-range within the foregoing ranges; or a set of values within any of the foregoing ranges. In a further aspect, the double-covered yarn can utilize a first fiber, comprising a disclosed composite fiber, having a weight of about 120 denier; about 130 denier; about 140 denier; about 150 denier; about 160 denier; about 170 denier; about 180 denier; about 190 denier; about 200 denier; about 210 denier; about 220 denier; about 230 denier; about 240 denier; about 250 denier; about 260 denier; about 270 denier; about 280 denier; about 290 denier; about 300 denier; about 310 denier; about 320 denier; about 330 denier; about 340 denier; about 350 denier; about 360 denier; about 370 denier; about 380 denier; about 390 denier; about 400 denier; about 410 denier; about 420 denier; about 430 denier; about 440 denier; about 450 denier; about 460 denier; about 470 denier; about 480 denier; about 490 denier; about 500 denier; about 510 denier; about 520 denier; about 530 denier; about 540 denier; about 550 denier; about 560 denier; about 570 denier; about 580 denier; about 590 denier; about 600 denier; a range encompassed by any of the foregoing values; or any set of the foregoing values.

In various aspects, the second fiber used in a disclosed double-covered yarn can be a suitable cellulosic fiber. In some instances, the cellulosic fiber of the second fiber is a regenerated cellulosic fiber, such as, but not limited to, a viscose rayon, a high wet modulus rayon, a cuprammonium rayon, a saponified rayon, a modal rayon, a lyocell rayon, or combinations thereof. In a particular instance, the regenerated cellulosic fiber can be a viscose rayon.

In various aspects, the second fiber of the double-covered yarn has a weight of about 105 d/20f to about 130 d/40f; about 110 d/20f to about 130 d/40f; about 115 d/20f to about 130 d/40f; about 105 d/20f to about 130 d/35f; about 110 d/35f to about 130 d/35f; about 115 d/20f to about 130 d/35f; about 105 d/20f to about 130 d/30f; about 110 d/20f to about 130 d/30f; about 115 d/20f to about 130 d/30f; or a sub-range within the foregoing ranges.

In a further aspect, the second fiber of the double-covered yarn has a weight of about 120 d/20f±10%; about 120 d/20f±5%; about 120 d/20f±3%; 121 d/20f±10%; about 121 d/20f±5%; about 121 d/20f±3%; 122 d/20f±10%; about 122 d/20f±5%; about 122 d/20f±3%; 123 d/20f±10%; about 123 d/20f±5%; about 123 d/20f±3%; 124 d/20f±10%; about 124 d/20f±5%; about 124 d/20f±3%; 125 d/20f±10%; about 125 d/20f±5%; about 125 d/20f±3%; 126 d/20f±10%; about 126 d/20f±5%; about 126 d/20f±3%; 127 d/20f±10%; about 127 d/20f±5%; about 127 d/20f±3%; 128 d/20f±10%; about 128 d/20f±5%; about 128 d/20f±3%; 129 d/20f±10%; about 129 d/20f±5%; about 129 d/20f±3%; 130 d/20f±10%; about 130 d/20f±5%; about 130 d/20f±3%; about 120 d/25f±10%; about 120 d/25f±5%; about 120 d/25f±3%; 121 d/25f±10%; about 121 d/25f±5%; about 121 d/25f±3%; 122 d/25f±10%; about 122 d/25f±5%; about 122 d/25f±3%; 123 d/25f±10%; about 123 d/25f±5%; about 123 d/25f±3%; 124 d/25f±10%; about 124 d/25f±5%; about 124 d/25f±3%; 125 d/25f±10%; about 125 d/25f±5%; about 125 d/25f±3%; 126 d/25f±10%; about 126 d/25f±5%; about 126 d/25f±3%; 127 d/25f±10%; about 127 d/25f±5%; about 127 d/25f±3%; 128 d/25f±10%; about 128 d/25f±5%; about 128 d/25f±3%; 129 d/25f±10%; about 129 d/25f±5%; about 129 d/25f±3%; 130 d/25f±10%; about 130 d/25f±5%; about 130 d/25f±3%; about 120 d/30f±10%; about 120 d/30f±5%; about 120 d/30f±3%; 121 d/30f±10%; about 121 d/30f±5%; about 121 d/30f±3%; 122 d/30f±10%; about 122 d/30f±5%; about 122 d/30f±3%; 123 d/30f±10%; about 123 d/30f±5%; about 123 d/30f±3%; 124 d/30f±10%; about 124 d/30f±5%; about 124 d/30f±3%; 125 d/30f±10%; about 125 d/30f±5%; about 125 d/30f±3%; 126 d/30f±10%; about 126 d/30f±5%; about 126 d/30f±3%; 127 d/30f±10%; about 127 d/30f±5%; about 127 d/30f±3%; 128 d/30f±10%; about 128 d/30f±5%; about 128 d/30f±3%; 129 d/30f±10%; about 129 d/30f±5%; about 129 d/30f±3%; 130 d/30f±10%; about 130 d/30f±5%; about 130 d/30f±3%; about 120 d/35f±10%; about 120 d/35f±5%; about 120 d/35f±3%; 121 d/35f±10%; about 121 d/35f±5%; about 121 d/35f±3%; 122 d/35f±10%; about 122 d/35f±5%; about 122 d/35f±3%; 123 d/35f±10%; about 123 d/35f±5%; about 123 d/35f±3%; 124 d/35f±10%; about 124 d/35f±5%; about 124 d/35f±3%; 125 d/35f±10%; about 125 d/35f±5%; about 125 d/35f±3%; 126 d/35f±10%; about 126 d/35f±5%; about 126 d/35f±3%; 127 d/35f±10%; about 127 d/35f±5%; about 127 d/35f±3%; 128 d/35f±10%; about 128 d/35f±5%; about 128 d/35f±3%; 129 d/35f±10%; about 129 d/35f±5%; about 129 d/35f±3%; 130 d/35f±10%; about 130 d/35f±5%; about 130 d/35f±3%; about 120 d/40f±10%; about 120 d/40f±5%; about 120 d/40f±3%; 121 d/40f±10%; about 121 d/40f±5%; about 121 d/40f±3%; 122 d/40f±10%; about 122 d/40f±5%; about 122 d/40f±3%; 123 d/40f±10%; about 123 d/40f±5%; about 123 d/40f±3%; 124 d/40f±10%; about 124 d/40f±5%; about 124 d/40f±3%; 125 d/40f±10%; about 125 d/40f±5%; about 125 d/40f±3%; 126 d/40f±10%; about 126 d/40f±5%; about 126 d/40f±3%; 127 d/40f±10%; about 127 d/40f±5%; about 127 d/40f±3%; 128 d/40f±10%; about 128 d/40f±5%; about 128 d/40f±3%; 129 d/40f±10%; about 129 d/40f±5%; about 129 d/40f±3%; 130 d/40f±10%; about 130 d/40f±5%; about 130 d/40f±3%; a range encompassing any of the foregoing value; or any combination of the foregoing values.

In various aspects, the double-covered yarn has a weight of about 250 denier to about 370 denier; about 260 denier to about 370 denier; about 270 denier to about 370 denier; about 280 denier to about 370 denier; about 290 denier to about 370 denier; about 300 denier to about 370 denier; about 310 denier to about 370 denier; about 320 denier to about 370 denier; about 330 denier to about 370 denier; about 340 denier to about 370 denier; about 350 denier to about 370 denier; about 355 denier to about 370 denier; about 360 denier to about 370 denier; about 250 denier to about 360 denier; about 260 denier to about 360 denier; about 270 denier to about 360 denier; about 280 denier to about 360 denier; about 290 denier to about 360 denier; about 300 denier to about 360 denier; about 310 denier to about 360 denier; about 320 denier to about 360 denier; about 330 denier to about 360 denier; about 340 denier to about 360 denier; about 350 denier to about 360 denier; about 250 denier to about 350 denier; about 260 denier to about 350 denier; about 270 denier to about 350 denier; about 280 denier to about 350 denier; about 290 denier to about 350 denier; about 300 denier to about 350 denier; about 310 denier to about 350 denier; about 320 denier to about 350 denier; about 330 denier to about 350 denier; about 340 denier to about 350 denier; about 250 denier to about 340 denier; about 260 denier to about 340 denier; about 270 denier to about 340 denier; about 280 denier to about 340 denier; about 290 denier to about 340 denier; about 300 denier to about 340 denier; about 310 denier to about 340 denier; about 320 denier to about 340 denier; about 330 denier to about 340 denier; about 250 denier to about 330 denier; about 260 denier to about 330 denier; about 270 denier to about 330 denier; about 280 denier to about 330 denier; about 285 denier to about 330 denier; about 290 denier to about 330 denier; about 300 denier to about 330 denier; about 310 denier to about 330 denier; about 320 denier to about 330 denier; about 250 denier to about 320 denier; about 260 denier to about 320 denier; about 270 denier to about 320 denier; about 280 denier to about 320 denier; about 290 denier to about 320 denier; about 300 denier to about 320 denier; about 310 denier to about 320 denier; about 250 denier to about 310 denier; about 260 denier to about 310 denier; about 270 denier to about 310 denier; about 280 denier to about 310 denier; about 290 denier to about 310 denier; about 300 denier to about 310 denier; about 250 denier to about 300 denier; about 260 denier to about 300 denier; about 270 denier to about 300 denier; about 280 denier to about 300 denier; about 290 denier to about 300 denier; or a value, set of values, or sub-range within any of the foregoing ranges.

In a further aspect, the double-covered yarn has a weight of about 270 denier±10%; 270 denier±5%; about 270 denier±3%; about 271 denier±10%; 271 denier±5%; about 271 denier±3%; about 272 denier±10%; 272 denier±5%; about 272 denier±3%; about 273 denier±10%; 273 denier±5%; about 273 denier±3%; about 274 denier±10%; 274 denier±5%; about 274 denier±3%; about 275 denier±10%; 275 denier±5%; about 275 denier±3%; about 276 denier±10%; 276 denier±5%; about 276 denier±3%; about 277 denier±10%; 277 denier±5%; about 277 denier±3%; about 278 denier±10%; 278 denier±5%; about 278 denier±3%; about 279 denier±10%; 279 denier±5%; about 279 denier±3%; about 280 denier±10%; 280 denier±5%; about 280 denier±3%; about 281 denier±10%; 281 denier±5%; about 281 denier±3%; about 282 denier±10%; 282 denier±5%; about 282 denier±3%; about 283 denier±10%; 283 denier±5%; about 283 denier±3%; about 284 denier±10%; 284 denier±5%; about 284 denier±3%; about 285 denier±10%; 285 denier±5%; about 285 denier±3%; about 286 denier±10%; 286 denier±5%; about 286 denier±3%; about 287 denier±10%; 287 denier±5%; about 287 denier±3%; about 288 denier±10%; 288 denier±5%; about 288 denier±3%; about 289 denier±10%; 289 denier±5%; about 289 denier±3%; about 290 denier±10%; 290 denier±5%; about 290 denier±3%; about 291 denier±10%; 291 denier±5%; about 291 denier±3%; about 292 denier±10%; 292 denier±5%; about 292 denier±3%; about 293 denier±10%; 293 denier±5%; about 293 denier±3%; about 294 denier±10%; 294 denier±5%; about 294 denier±3%; about 295 denier±10%; 295 denier±5%; about 295 denier±3%; about 296 denier±10%; 296 denier±5%; about 296 denier±3%; about 297 denier±10%; 297 denier±5%; about 297 denier±3%; about 298 denier±10%; 298 denier±5%; about 298 denier±3%; about 299 denier±10%; 299 denier±5%; about 299 denier±3%; about 300 denier±10%; 300 denier±5%; about 300 denier±3%; about 301 denier±10%; 301 denier±5%; about 301 denier±3%; about 302 denier±10%; 302 denier±5%; about 302 denier±3%; about 303 denier±10%; 303 denier±5%; about 303 denier±3%; about 304 denier±10%; 304 denier±5%; about 304 denier±3%; about 305 denier±10%; 305 denier±5%; about 305 denier±3%; about 306 denier±10%; 306 denier±5%; about 306 denier±3%; about 307 denier±10%; 307 denier±5%; about 307 denier±3%; about 308 denier±10%; 308 denier±5%; about 308 denier±3%; about 309 denier±10%; 309 denier±5%; about 309 denier±3%; about 310 denier±10%; 310 denier±5%; about 310 denier±3%; about 311 denier±10%; 311 denier±5%; about 311 denier±3%; about 312 denier±10%; 312 denier±5%; about 312 denier±3%; about 313 denier±10%; 313 denier±5%; about 313 denier±3%; about 314 denier±10%; 314 denier±5%; about 314 denier±3%; about 315 denier±10%; 315 denier±5%; about 315 denier±3%; about 316 denier±10%; 316 denier±5%; about 316 denier±3%; about 317 denier±10%; 317 denier±5%; about 317 denier±3%; about 318 denier±10%; 318 denier±5%; about 318 denier±3%; about 319 denier±10%; 319 denier±5%; about 319 denier±3%; about 320 denier±10%; 320 denier±5%; about 320 denier±3%; about 321 denier±10%; 321 denier±5%; about 321 denier±3%; about 322 denier±10%; 322 denier±5%; about 322 denier±3%; about 323 denier±10%; 323 denier±5%; about 323 denier±3%; about 324 denier±10%; 324 denier±5%; about 324 denier±3%; about 325 denier±10%; 325 denier±5%; about 325 denier±3%; about 326 denier±10%; 326 denier±5%; about 326 denier±3%; about 327 denier±10%; 327 denier±5%; about 327 denier±3%; about 328 denier±10%; 328 denier±5%; about 328 denier±3%; about 329 denier±10%; 329 denier±5%; about 329 denier±3%; about 330 denier±10%; 330 denier±5%; about 330 denier±3%; about 331 denier±10%; 331 denier±5%; about 331 denier±3%; about 332 denier±10%; 332 denier±5%; about 332 denier±3%; about 333 denier±10%; 333 denier±5%; about 333 denier±3%; about 334 denier±10%; 334 denier±5%; about 334 denier±3%; about 335 denier±10%; 335 denier±5%; about 335 denier±3%; about 336 denier±10%; 336 denier±5%; about 336 denier±3%; about 337 denier±10%; 337 denier±5%; about 337 denier±3%; about 338 denier±10%; 338 denier±5%; about 338 denier±3%; about 339 denier±10%; 339 denier±5%; about 339 denier±3%; about 340 denier±10%; 340 denier±5%; about 340 denier±3%; about 341 denier±10%; 341 denier±5%; about 341 denier±3%; about 342 denier±10%; 342 denier±5%; about 342 denier±3%; about 343 denier±10%; 343 denier±5%; about 343 denier±3%; about 344 denier±10%; 344 denier±5%; about 344 denier±3%; about 345 denier±10%; 345 denier±5%; about 345 denier±3%; about 346 denier±10%; 346 denier±5%; about 346 denier±3%; about 347 denier±10%; 347 denier±5%; about 347 denier±3%; about 348 denier±10%; 348 denier±5%; about 348 denier±3%; about 349 denier±10%; 349 denier±5%; about 349 denier±3%; about 350 denier±10%; 350 denier±5%; about 350 denier±3%; about 351 denier±10%; 351 denier±5%; about 351 denier±3%; about 352 denier±10%; 352 denier±5%; about 352 denier±3%; about 353 denier±10%; 353 denier±5%; about 353 denier±3%; about 354 denier±10%; 354 denier±5%; about 354 denier±3%; about 355 denier±10%; 355 denier±5%; about 355 denier±3%; about 356 denier±10%; 356 denier±5%; about 356 denier±3%; about 357 denier±10%; 357 denier±5%; about 357 denier±3%; about 358 denier±10%; 358 denier±5%; about 358 denier±3%; about 359 denier±10%; 359 denier±5%; about 359 denier±3%; about 360 denier±10%; 360 denier±5%; about 360 denier±3%; about 361 denier±10%; 361 denier±5%; about 361 denier±3%; about 362 denier±10%; 362 denier±5%; about 362 denier±3%; about 363 denier±10%; 363 denier±5%; about 363 denier±3%; about 364 denier±10%; 364 denier±5%; about 364 denier±3%; about 365 denier±10%; 365 denier±5%; about 365 denier±3%; about 366 denier±10%; 366 denier±5%; about 366 denier±3%; about 367 denier±10%; 367 denier±5%; about 367 denier±3%; about 368 denier±10%; 368 denier±5%; about 368 denier±3%; about 369 denier±10%; about 369 denier±5%; about 369 denier±3%; about 370 denier±10%; 370 denier±5%; about 370 denier±3%; about 371 denier±10%; 371 denier±5%; about 371 denier±3%; about 372 denier±10%; 372 denier±5%; about 372 denier±3%; about 373 denier±10%; 373 denier±5%; about 373 denier±3%; about 374 denier±10%; 374 denier±5%; about 374 denier±3%; about 375 denier±10%; 375 denier±5%; about 375 denier±3%; about 376 denier±10%; 376 denier±5%; about 376 denier±3%; about 377 denier±10%; 377 denier±5%; about 377 denier±3%; about 378 denier±10%; 378 denier±5%; about 378 denier±3%; about 379 denier±10%; about 379 denier±5%; about 379 denier±3%; about 380 denier±10%; about 380 denier±5%; about 380 denier±3%; a range encompassing any of the foregoing values; or any combination of the foregoing values.

In an aspect, the first cooling composition can be present in an amount of about 0.01 wt % to about 20 wt % based on the total weight of the double-covered yarn. In a further aspect, the first cooling composition can be present in an amount, based on the total weight of the double-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; a range utilizing any of the foregoing values; a sub-range with a range utilizing any of the foregoing values; or any set of values utilizing the foregoing values.

In an aspect, the second cooling composition can be present in an amount of about 0.01 wt % to about 20 wt % based on the total weight of the double-covered yarn. In a further aspect, the second cooling composition can be present in an amount, based on the total weight of the double-covered yarn of about 0.01 wt %; about 0.02 wt %; about 0.03 wt %; about 0.04 wt %; about 0.05 wt %; about 0.06 wt %; about 0.07 wt %; about 0.08 wt %; about 0.09 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %;

about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; about 10.1 wt %; about 10.2 wt %; about 10.3 wt %; about 10.4 wt %; about 10.5 wt %; about 10.6 wt %; about 10.7 wt %; about 10.8 wt %; about 10.9 wt %; about 11.0 wt %; about 11.1 wt %; about 11.2 wt %; about 11.3 wt %; about 11.4 wt %; about 11.5 wt %; about 11.6 wt %; about 11.7 wt %; about 11.8 wt %; about 11.9 wt %; about 12.0 wt %; about 12.1 wt %; about 12.2 wt %; about 12.3 wt %; about 12.4 wt %; about 12.5 wt %; about 12.6 wt %; about 12.7 wt %; about 12.8 wt %; about 12.9 wt %; about 13.0 wt %; about 13.1 wt %; about 13.2 wt %; about 13.3 wt %; about 13.4 wt %; about 13.5 wt %; about 13.6 wt %; about 13.7 wt %; about 13.8 wt %; about 13.9 wt %; about 14.0 wt %; about 14.1 wt %; about 14.2 wt %; about 14.3 wt %; about 14.4 wt %; about 14.5 wt %; about 14.6 wt %; about 14.7 wt %; about 14.8 wt %; about 14.9 wt %; about 15.0 wt %; about 15.1 wt %; about 15.2 wt %; about 15.3 wt %; about 15.4 wt %; about 15.5 wt %; about 15.6 wt %; about 15.7 wt %; about 15.8 wt %; about 15.9 wt %; about 16.0 wt %; about 16.1 wt %; about 16.2 wt %; about 16.3 wt %; about 16.4 wt %; about 16.5 wt %; about 16.6 wt %; about 16.7 wt %; about 16.8 wt %; about 16.9 wt %; about 17.0 wt %; about 17.1 wt %; about 17.2 wt %; about 17.3 wt %; about 17.4 wt %; about 17.5 wt %; about 17.6 wt %; about 17.7 wt %; about 17.8 wt %; about 17.9 wt %; about 18.0 wt %; about 18.1 wt %; about 18.2 wt %; about 18.3 wt %; about 18.4 wt %; about 18.5 wt %; about 18.6 wt %; about 18.7 wt %; about 18.8 wt %; about 18.9 wt %; about 19.0 wt %; about 19.1 wt %; about 19.2 wt %; about 19.3 wt %; about 19.4 wt %; about 19.5 wt %; about 19.6 wt %; about 19.7 wt %; about 19.8 wt %; about 19.9 wt %; about 20.0 wt %; a range utilizing any of the foregoing values; a sub-range with a range utilizing any of the foregoing values; or any set of values utilizing the foregoing values.

It is understood herein throughout that reference to a composition comprising an element, e.g., "a composition comprises Al, Ca, Cu, Fe . . . Zr" or "a composition comprises aluminum, calcium, copper, iron . . . zirconium," is intended to be inclusive of any form or valency of the element as appropriate for a given compound or material in which the element is part of the composition of the compound or material, unless otherwise specified. That is, it is understood that a reference to a particular element in a composition or material is inclusive of ionic forms of the element in typical oxidation states for that element if the composition or material comprises the element as an ionic compound; covalently bonded forms of the element if the composition or material comprises the element as an covalent compound; and elemental forms (i.e., oxidation state of 0) as suitable or appropriate for the indicated if the composition or material comprises the element in an oxidation state of 0, e.g., Al as metallic aluminum. Thus, reference to a composition, as discussed above, is intended to comprise ionic, covalent, and elemental forms of the element as disclosed herein.

For example, reference to a composition comprising aluminum refers to forms of aluminum disclosed herein, such as aluminum metal, $Al_2O_3$, tourmaline, and other disclosed aluminum containing minerals and compounds. Similarly, reference to a composition comprising: (a) calcium refers to materials comprising calcium disclosed herein, such as $CaCO_3$, dolomite, tourmaline, and other disclosed calcium containing minerals and compounds; (b) iron refers to materials comprising iron disclosed herein, such as iron metal, alloys comprising iron, $FeCl_2$, FeO, tourmaline, and other disclosed iron containing minerals and compounds; (c) potassium refers to materials comprising potassium disclosed herein, such as $K_2SO_4$, KCl, and other disclosed potassium containing minerals and compounds; (d) magnesium refers to materials comprising magnesium disclosed herein, such as magnesium metal, alloys comprising magnesium, $MgCO_3$, MgO, dolomite, tourmaline, and other disclosed magnesium containing minerals and compounds; (e) sodium refers to forms of sodium disclosed herein, such as sodium salts, tourmaline, and other disclosed sodium containing minerals and compounds; (f) silicon refers to materials comprising silicon disclosed herein, such as SiC, SiO, tourmaline, and other disclosed calcium containing minerals and compounds; and (g) silver refers to materials comprising silver disclosed herein, such as silver, alloys comprising silver, AgO, tourmaline, and other disclosed calcium containing minerals and compounds.

In addition, it is understood herein throughout, that an amount of an element, e.g., weight percent, is the overall weight percent for the element in aggregate as determined by elemental analysis and that the element may be present in one or more chemical and/or physical forms. For example, reference to 5 wt % silver as determined by element analysis refers to the determination that the material comprises 5 wt % silver which may be present in one or more of the disclosed forms of silver such as silver, a silver alloy, and AgO. This understanding extends to other elements that are specified as having been determined to be present at a certain weight percent as determined by elemental analysis.

In a further aspect, the disclosed double covered yarn can comprise a first cooling composition comprising aluminum. Aluminum can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed double covered yarn can comprise a first cooling composition comprising calcium. Calcium can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed double covered yarn can comprise a first cooling composition comprising copper. Copper can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed double covered yarn can comprise a first cooling composition comprising iron. Iron can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed double covered yarn can comprise a first cooling composition comprising magnesium. Magnesium can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed double covered yarn can comprise a first cooling composition comprising potassium. Potassium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed double covered yarn can comprise a first cooling composition comprising silver. Silver can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %;

about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed double covered yarn can comprise a first cooling composition comprising sodium. Sodium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed double covered yarn can comprise a first cooling composition comprising titanium. Titanium can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed double covered yarn can comprise a first cooling composition comprising zirconium. Zirconium can be present in a first cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

In a further aspect, the disclosed double covered yarn can comprise a second cooling composition comprising aluminum. Aluminum can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed double covered yarn can comprise a second cooling composition comprising calcium. Calcium can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed double covered yarn can comprise a second cooling composition comprising copper. Copper can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed double covered yarn can comprise a second cooling composition comprising iron. Iron can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed double covered yarn can comprise a second cooling composition comprising magnesium. Magnesium can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed double covered yarn can comprise a second cooling composition comprising potassium. Potassium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed double covered yarn can comprise a second cooling composition comprising silver. Silver can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed double covered yarn can comprise a second cooling composition comprising sodium. Sodium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed double covered yarn can comprise a second cooling composition comprising titanium. Titanium can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed double covered yarn can comprise a second cooling composition comprising zirconium. Zirconium can be present in a second cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

The weight percent for a cooling composition in a disclosed double-covered yarn, e.g., a cooling composition comprising aluminum, calcium, copper, iron, magnesium, potassium, silicon, silver, sodium, titanium, zirconium, or combinations, can be the weight percent based upon elemental analysis. In a particular instance, the elemental analysis can be carried out using field emission scanning electron microscopy with a segmented backscatter detector, an Everhart-Thornley electron detector, in-lens electron detectors, or combinations thereof. In some specific instances, the elemental analysis can be carried out using field emission scanning electron microscopy with energy-dispersive spectroscopy.

F. Fabrics

In various aspects, the disclosure relates to a knit or a woven fabric comprising a disclosed single-covered yarn, a disclosed double-covered yarn, or combinations thereof. More specifically, in one aspect, the present disclosure relates to a woven fabric comprising: a weft yarn comprising a disclosed double-covered yarn; and a warp yarn comprising cotton fibers. In a further aspect, the disclosed woven fabric is a denim fabric.

In various aspects, the woven fabric can be a warp-faced fabric. In some aspects, the disclosed woven fabric is a right-handed twill weave; and wherein the right-handed twill weave has diagonals run from the left to the right of the fabric. The disclosed woven fabric can have a weave pattern that is a 3 by 1 weave; and wherein 3 warp yarns are woven over and under a weft yarn.

In various aspects, a disclosed woven fabric comprises about 50 wt % to about 90 wt % cotton yarn; about 0.5 wt % to about 10 wt % of an elastic yarn; about 5 wt % to about 30 wt % of first yarn comprising a disclosed composite fiber; and about 5 wt % to about 30 wt % of a second yarn comprising a woven fabric-covered yarn. In a further aspect, a disclosed woven fabric comprises about 60 wt % to about 80 wt % cotton yarn; about 0.5 wt % to about 7.5 wt % of an elastic yarn; about 5 wt % to about 20 wt % of first yarn comprising a disclosed composite fiber; and about 5 wt % to about 20 wt % of a second yarn comprising a cellulosic fiber; and wherein the weight percent is based upon the total weight of the woven fabric. In a still further aspect, a disclosed woven fabric comprises about 65 wt % to about 80 wt % cotton yarn; about 0.5 wt % to about 5.0 wt % of an elastic yarn; about 5 wt % to about 15 wt % of first yarn comprising a disclosed composite fiber; and about 7.5 wt % to about 20 wt % of a second yarn comprising a cellulosic fiber; and wherein the weight percent is based upon the total weight of the woven fabric.

In a further aspect, a disclosed woven fabric comprises a cotton in a weight percent amount based on the total weight of the disclosed woven fabric of about 50 wt %; about 51 wt %; about 52 wt %; about 53 wt %; about 54 wt %; about 55 wt %; about 56 wt %; about 57 wt %; about 58 wt %; about 59 wt %; about 60 wt %; about 61 wt %; about 62 wt %; about 63 wt %; about 64 wt %; about 65 wt %; about 66 wt %; about 67 wt %; about 68 wt %; about 69 wt %; about 70 wt %; about 71 wt %; about 72 wt %; about 73 wt %; about 74 wt %; about 75 wt %; about 76 wt %; about 77 wt %; about 78 wt %; about 79 wt %; about 80 wt %; about 81 wt %; about 82 wt %; about 83 wt %; about 84 wt %; about 85 wt %; about 86 wt %; about 87 wt %; about 88 wt %; about 89 wt %; about 90 wt %; a range utilizing any of the foregoing values; a sub-range with a range utilizing any of the foregoing values; or any set of values utilizing the foregoing values.

In a further aspect, a disclosed woven fabric comprises an elastic yarn in a weight percent amount based on the total weight of the disclosed woven fabric of about 0.5 wt %; about 0.6 wt %; about 0.7 wt %; about 0.8 wt %; about 0.9 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; about 5.1 wt %; about 5.2 wt %; about 5.3 wt %; about 5.4 wt %; about 5.5 wt %; about 5.6 wt %; about 5.7 wt %; about 5.8 wt %; about 5.9 wt %; about 6.0 wt %; about 6.1 wt %; about 6.2 wt %; about 6.3 wt %; about 6.4 wt %; about 6.5 wt %; about 6.6 wt %; about 6.7 wt %; about 6.8 wt %; about 6.9 wt %; about 7.0 wt %; about 7.1 wt %; about 7.2 wt %; about 7.3 wt %; about 7.4 wt %; about 7.5 wt %; about 7.6 wt %; about 7.7 wt %; about 7.8 wt %; about 7.9 wt %; about 8.0 wt %; about 8.1 wt %; about 8.2 wt %; about 8.3 wt %; about 8.4 wt %; about 8.5 wt %; about 8.6 wt %; about 8.7 wt %; about 8.8 wt %; about 8.9 wt %; about 9.0 wt %; about 9.1 wt %; about 9.2 wt %; about 9.3 wt %; about 9.4 wt %; about 9.5 wt %; about 9.6 wt %; about 9.7 wt %; about 9.8 wt %; about 9.9 wt %; about 10.0 wt %; a range utilizing any of the foregoing values; a sub-range with a range utilizing any of the foregoing values; or any set of values utilizing the foregoing values.

In a further aspect, a disclosed woven fabric comprises a first yarn in a weight percent amount based on the total weight of the disclosed woven fabric of about 5 wt %; about 6 wt %; about 7 wt %; about 8 wt %; about 9 wt %; about 10 wt %; about 11 wt %; about 12 wt %; about 13 wt %; about 14 wt %; about 15 wt %; about 16 wt %; about 17 wt %; about 18 wt %; about 19 wt %; about 20 wt %; about 21 wt %; about 22 wt %; about 23 wt %; about 24 wt %; about 25 wt %; about 26 wt %; about 27 wt %; about 28 wt %; about 29 wt %; about 30 wt %; a range utilizing any of the foregoing values; a sub-range with a range utilizing any of the foregoing values; or any set of values utilizing the foregoing values.

In a further aspect, a disclosed woven fabric comprises a second yarn in a weight percent amount based on the total weight of the disclosed woven fabric of about 5 wt %; about 6 wt %; about 7 wt %; about 8 wt %; about 9 wt %; about 10 wt %; about 11 wt %; about 12 wt %; about 13 wt %; about 14 wt %; about 15 wt %; about 16 wt %; about 17 wt %; about 18 wt %; about 19 wt %; about 20 wt %; about 21 wt %; about 22 wt %; about 23 wt %; about 24 wt %; about 25 wt %; about 26 wt %; about 27 wt %; about 28 wt %; about 29 wt %; about 30 wt %; a range utilizing any of the foregoing values; a sub-range with a range utilizing any of the foregoing values; or any set of values utilizing the foregoing values.

In a further aspect, the warp yarn of the disclosed woven fabric can comprise a cotton yarn having a weight of about 8's to about 50's. In a further aspect, the cotton yarn can have a weight of about 8's, about 9's, about 10's, about 11's, about 12's, about 13's, about 14's, about 15's, about 16's, about 17's, about 18's, about 19's, about 20's, about 21's, about 22's, about 23's, about 24's, about 25's, about 26's, about 27's, about 28's, about 29's, about 30's, about 31's, about 32's, about 33's, about 34's, about 35's, about 36's, about 37's, about 38's, about 39's, about 40's, about 41's, about 42's, about 43's, about 44's, about 45's, about 46's, about 47's, about 48's, about 49's, about 50's, any combination of the foregoing values, or any range encompassed by two or more of the foregoing values.

In various aspects, the disclosed woven fabric comprises about 50 wt % to about 70 wt % cotton fibers; about 1 wt % to about 15 wt % of a polyester polymer; about 1 wt % to about 10 wt % of a polyamide polymer; and about 0.1 wt % to about 5 wt % of an elastic fiber or elastic filament. In a further aspect, the disclosed woven fabric comprises about 55 wt % to about 70 wt % cotton fibers; about 8 wt % to about 12 wt % of a polyester polymer; about 4 wt % to about 8 wt % of a polyamide polymer; and about 1 wt % to about 4 wt % of an elastic fiber or elastic filament. In a still further aspect, the disclosed woven fabric comprises about 60 wt % to about 70 wt % cotton fibers; about 8 wt % to about 10 wt % of a polyester polymer; about 4 wt % to about 7 wt % of a polyamide polymer; and about 2 wt % to about 4 wt % of an elastic fiber or elastic filament.

In a further aspect, the disclosed woven fabric has a weight of about 4 oz/sy to about 10 oz/sy; about 5 oz/sy to about 8 oz/sy; about 5 oz/sy to about 7 oz/sy; about 5.5 oz/sy to about 6.5 oz/sy; or a sub-range within or overlapping any of the foregoing ranges.

In a further aspect, the disclosed woven fabric has a weight of about 6.20 oz/sy±10%; about 6.20 oz/sy±5%; about 6.20 oz/sy±3%; about 6.21 oz/sy±10%; about 6.21 oz/sy±5%; about 6.21 oz/sy±3%; about 6.22 oz/sy±10%; about 6.22 oz/sy±5%; about 6.22 oz/sy±3%; about 6.23 oz/sy±10%; about 6.23 oz/sy±5%; about 6.23 oz/sy±3%; about 6.24 oz/sy±10%; about 6.24 oz/sy±5%; about 6.24 oz/sy±3%; about 6.25 oz/sy±10%; about 6.25 oz/sy±5%; about 6.25 oz/sy±3%; about 6.27 oz/sy±10%; about 6.27 oz/sy±5%; about 6.27 oz/sy±3%; about 6.28 oz/sy±10%; about 6.28 oz/sy±5%; about 6.28 oz/sy±3%; about 6.29 oz/sy±10%; about 6.29 oz/sy±5%; about 6.29 oz/sy±3%; about 6.30 oz/sy±10%; about 6.30 oz/sy±5%; about 6.30 oz/sy±3%; about 6.40 oz/sy±10%; about 6.40 oz/sy±5%;

about 6.40 oz/sy±3%; about 6.50 oz/sy±10%; about 6.50 oz/sy±5%; about 6.50 oz/sy±3%; about 6.60 oz/sy±10%; about 6.60 oz/sy±5%; about 6.60 oz/sy±3%; about 6.70 oz/sy±10%; about 6.70 oz/sy±5%; about 6.70 oz/sy±3%; about 6.80 oz/sy±10%; about 6.80 oz/sy±5%; about 6.80 oz/sy±3%; about 6.90 oz/sy±10%; about 6.90 oz/sy±5%; about 6.90 oz/sy±3%; about 7.00 oz/sy±10%; about 7.00 oz/sy±5%; about 7.00 oz/sy±3%; a range utilizing any of the foregoing values; a sub-range with a range utilizing any of the foregoing values; or any set of values utilizing the foregoing values.

In a further aspect, the disclosed woven fabric has a Qmax value of about 0.15 to about 0.50 when determined in accordance with FTTS-FA-019 as specified by Committee of Conformity Assessment of Accreditation and Certification on Functional and Technical Textiles (Taiwan). In a still further aspect, the disclosed woven fabric has a Qmax value of about 0.17 to about 0.25 when determined in accordance with FTTS-FA-019 as specified by Committee of Conformity Assessment of Accreditation and Certification on Functional and Technical Textiles (Taiwan).

In a further aspect, the disclosed woven fabric has a Qmax value, when determined in accordance with FTTS-FA-019 as specified by Committee of Conformity Assessment of Accreditation and Certification on Functional and Technical Textiles (Taiwan), of about 0.10±10%; about 0.10±5%; about 0.10±3%; about 0.11±10%; about 0.11±5%; about 0.11±3%; about 0.12±10%; about 0.12±5%; about 0.12±3%; about 0.13±10%; about 0.13±5%; about 0.13±3%; about 0.14±10%; about 0.14±5%; about 0.14±3%; about 0.15±10%; about 0.15±5%; about 0.15±3%; about 0.16±10%; about 0.16±5%; about 0.16±3%; about 0.17±10%; about 0.17±5%; about 0.17±3%; about 0.18±10%; about 0.18±5%; about 0.18±3%; about 0.19±10%; about 0.19±5%; about 0.19±3%; about 0.20±10%; about 0.20±5%; about 0.20±3%; about 0.21±10%; about 0.21±5%; about 0.21±3%; about 0.22±10%; about 0.22±5%; about 0.22±3%; about 0.23±10%; about 0.23±5%; about 0.23±3%; about 0.24±10%; about 0.24±5%; about 0.24±3%; about 0.25±10%; about 0.25±5%; about 0.25±3%; about 0.26±10%; about 0.26±5%; about 0.26±3%; about 0.27±10%; about 0.27±5%; about 0.27±3%; about 0.28±10%; about 0.28±5%; about 0.28±3%; about 0.29±10%; about 0.29±5%; about 0.29±3%; about 0.30±10%; about 0.30±5%; about 0.30±3%; a range utilizing any of the foregoing values; a sub-range with a range utilizing any of the foregoing values; or any set of values utilizing the foregoing values.

In a further aspect, the disclosed woven fabric has a Qmax value, when determined in accordance with FTTS-FA-019 as specified by Committee of Conformity Assessment of Accreditation and Certification on Functional and Technical Textiles (Taiwan), that is about 20% greater than the Qmax value for a reference denim fabric. In this context, it is to be understood that the reference denim fabric consists essentially of cotton yarn, having a fabric weight that is ±10% of the fabric, and the same weave pattern as the fabric. In a still further aspect, the disclosed woven fabric has a Qmax value, when determined in accordance with FTTS-FA-019 as specified by Committee of Conformity Assessment of Accreditation and Certification on Functional and Technical Textiles (Taiwan), that is about 25% greater than the Qmax value for a reference denim fabric. In a yet further aspect, the disclosed woven fabric has a Qmax value, when determined in accordance with FTTS-FA-019 as specified by Committee of Conformity Assessment of Accreditation and Certification on Functional and Technical Textiles (Taiwan), that is about 30% greater than the Qmax value for a reference denim fabric.

In a further aspect, the disclosed woven fabric has a wicking time, when determined in accordance with AATCC Test Method 197, of less than about 5 minutes. In a still further aspect, the disclosed woven fabric has a wicking time, when determined in accordance with AATCC Test Method 197, of less than about 4.9 minutes, less than about 4.8 minutes, less than about 4.7 minutes, less than about 4.6 minutes, less than about 4.5 minutes, less than about 4.4 minutes, less than about 4.3 minutes, less than about 4.2 minutes, less than about 4.1 minutes, less than about 4.0 minutes, less than about 3.9 minutes, less than about 3.8 minutes, less than about 3.7 minutes, less than about 3.6 minutes, less than about 3.5 minutes, less than about 3.4 minutes, less than about 3.3 minutes, less than about 3.2 minutes, less than about 3.1 minutes, less than about 3.0 minutes, less than about 2.9 minutes, less than about 2.8 minutes, less than about 2.7 minutes, less than about 2.6 minutes, less than about 2.5 minutes, less than about 2.4 minutes, less than about 2.3 minutes, less than about 2.2 minutes, less than about 2.1 minutes, less than about 2.0 minutes, less than about 1.9 minutes, less than about 1.8 minutes, less than about 1.7 minutes, less than about 1.6 minutes, less than about 1.5 minutes, less than about 1.4 minutes, less than about 1.3 minutes, less than about 1.2 minutes, less than about 1.1 minutes, or less than about 1.0 minutes.

In a further aspect, the disclosed woven fabric has a wicking time, when determined in accordance with AATCC Test Method 197, from about 0.5 minutes to about 4.9 minutes, about 0.5 minutes to about 4.8 minutes, about 0.5 minutes to about 4.7 minutes, about 0.5 minutes to about 4.6 minutes, about 0.5 minutes to about 4.5 minutes, about 0.5 minutes to about 4.4 minutes, about 0.5 minutes to about 4.3 minutes, about 0.5 minutes to about 4.2 minutes, about 0.5 minutes to about 4.1 minutes, about 0.5 minutes to about 4.0 minutes, about 0.5 minutes to about 3.9 minutes, about 0.5 minutes to about 3.8 minutes, about 0.5 minutes to about 3.7 minutes, about 0.5 minutes to about 3.6 minutes, about 0.5 minutes to about 3.5 minutes, about 0.5 minutes to about 3.4 minutes, about 0.5 minutes to about 3.3 minutes, about 0.5 minutes to about 3.2 minutes, about 0.5 minutes to about 3.1 minutes, about 0.5 minutes to about 3.0 minutes, about 0.5 minutes to about 2.9 minutes, about 0.5 minutes to about 2.8 minutes, about 0.5 minutes to about 2.7 minutes, about 0.5 minutes to about 2.6 minutes, about 0.5 minutes to about 2.5 minutes, about 0.5 minutes to about 2.4 minutes, about 0.5 minutes to about 2.3 minutes, about 0.5 minutes to about 2.2 minutes, about 0.5 minutes to about 2.1 minutes, about 0.5 minutes to about 2.0 minutes, about 0.5 minutes to about 1.9 minutes, about 0.5 minutes to about 1.8 minutes, about 0.5 minutes to about 1.7 minutes, about 0.5 minutes to about 1.6 minutes, about 0.5 minutes to about 1.5 minutes, about 0.5 minutes to about 1.4 minutes, about 0.5 minutes to about 1.3 minutes, about 0.5 minutes to about 1.2 minutes, about 0.5 minutes to about 1.1 minutes, about 0.5 minutes to about 1.0 minutes, a sub-range of any of the foregoing ranges, or any value or set of values within the foregoing ranges.

In a further aspect, the disclosed woven fabric has a wicking time, when determined in accordance with AATCC Test Method 197, from about 1.0 minutes to about 4.9 minutes, about 1.0 minutes to about 4.8 minutes, about 1.0 minutes to about 4.7 minutes, about 1.0 minutes to about 4.6 minutes, about 1.0 minutes to about 4.5 minutes, about 1.0 minutes to about 4.4 minutes, about 1.0 minutes to about 4.3 minutes, about 1.0 minutes to about 4.2 minutes, about 1.0 minutes to about 4.1 minutes, about 1.0 minutes to about 4.0 minutes, about 1.0 minutes to about 3.9 minutes, about 1.0 minutes to about 3.8 minutes, about 1.0 minutes to about 3.7 minutes, about 1.0 minutes to about 3.6 minutes, about 1.0 minutes to about 3.5 minutes, about 1.0 minutes to about 3.4 minutes, about 1.0 minutes to about 3.3 minutes, about 1.0 minutes to about 3.2 minutes, about 1.0 minutes to about 3.1 minutes, about 1.0 minutes to about 3.0 minutes, about 1.0 minutes to about 2.9 minutes, about 1.0 minutes to about 2.8 minutes, about 1.0 minutes to about 2.7 minutes, about 1.0 minutes to about 2.6 minutes, about 1.0 minutes to about 2.5 minutes, about 1.0 minutes to about 2.4 minutes, about 1.0 minutes to about 2.3 minutes, about 1.0 minutes to about 2.2 minutes, about 1.0 minutes to about 2.1 minutes, about 1.0 minutes to about 2.0 minutes, about 1.0 minutes to about 1.9 minutes, about 1.0 minutes to about 1.8 minutes, about 1.0 minutes to about 1.7 minutes, about 1.0 minutes to about 1.6 minutes, about 1.0 minutes to about 1.5 minutes, about 1.0 minutes to about 1.4 minutes, about 1.0 minutes to about 1.3 minutes, about 1.0 minutes to about 1.2 minutes, about 1.0 minutes to about 1.1 minutes, a sub-range of any of the foregoing ranges, or any value or set of values within the foregoing ranges.

In a further aspect, the disclosed woven fabric has a wicking time, when determined in accordance with AATCC Test Method 197, from about 1.5 minutes to about 4.9 minutes, about 1.5 minutes to about 4.8 minutes, about 1.5 minutes to about 4.7 minutes, about 1.5 minutes to about 4.6 minutes, about 1.5 minutes to about 4.5 minutes, about 1.5 minutes to about 4.4 minutes, about 1.5 minutes to about 4.3 minutes, about 1.5 minutes to about 4.2 minutes, about 1.5 minutes to about 4.1 minutes, about 1.5 minutes to about 4.0 minutes, about 1.5 minutes to about 3.9 minutes, about 1.5 minutes to about 3.8 minutes, about 1.5 minutes to about 3.7 minutes, about 1.5 minutes to about 3.6 minutes, about 1.5 minutes to about 3.5 minutes, about 1.5 minutes to about 3.4 minutes, about 1.5 minutes to about 3.3 minutes, about 1.5 minutes to about 3.2 minutes, about 1.5 minutes to about 3.1 minutes, about 1.5 minutes to about 3.0 minutes, about 1.5 minutes to about 2.9 minutes, about 1.5 minutes to about 2.8 minutes, about 1.5 minutes to about 2.7 minutes, about 1.5 minutes to about 2.6 minutes, about 1.5 minutes to about 2.5 minutes, about 1.5 minutes to about 2.4 minutes, about 1.5 minutes to about 2.3 minutes, about 1.5 minutes to about 2.2 minutes, about 1.5 minutes to about 2.1 minutes, about 1.5 minutes to about 2.0 minutes, about 1.5 minutes to about 1.9 minutes, about 1.5 minutes to about 1.8 minutes, about 1.5 minutes to about 1.7 minutes, about 1.5 minutes to about 1.6 minutes, a sub-range of any of the foregoing ranges, or any value or set of values within the foregoing ranges.

In a further aspect, the disclosed woven fabric has a wicking time, when determined in accordance with AATCC Test Method 197, from about 2.0 minutes to about 4.9 minutes, about 2.0 minutes to about 4.8 minutes, about 2.0 minutes to about 4.7 minutes, about 2.0 minutes to about 4.6 minutes, about 2.0 minutes to about 4.5 minutes, about 2.0 minutes to about 4.4 minutes, about 2.0 minutes to about 4.3 minutes, about 2.0 minutes to about 4.2 minutes, about 2.0 minutes to about 4.1 minutes, about 2.0 minutes to about 4.0 minutes, about 2.0 minutes to about 3.9 minutes, about 2.0 minutes to about 3.8 minutes, about 2.0 minutes to about 3.7 minutes, about 2.0 minutes to about 3.6 minutes, about 2.0 minutes to about 3.5 minutes, about 2.0 minutes to about 3.4 minutes, about 2.0 minutes to about 3.3 minutes, about 2.0 minutes to about 3.2 minutes, about 2.0 minutes to about 3.1 minutes, about 2.0 minutes to about 3.0 minutes, about 2.0 minutes to about 2.9 minutes, about 2.0 minutes to about 2.8 minutes, about 2.0 minutes to about 2.7 minutes, about 2.0 minutes to about 2.6 minutes, about 2.0 minutes to about 2.5 minutes, about 2.0 minutes to about 2.4 minutes, about 2.0 minutes to about 2.3 minutes, about 2.0 minutes to about 2.2 minutes, about 2.0 minutes to about 2.1 minutes, a sub-range of any of the foregoing ranges, or any value or set of values within the foregoing ranges.

In various aspects, the disclosed woven fabric has a wicking time, when determined in accordance with AATCC Test Method 197, at least about 100% faster than the wicking time for a reference denim fabric. In this context, it is to be understood that the reference denim fabric consists essentially of cotton yarn, having a fabric weight that is ±10% of the fabric, and the same weave pattern as the fabric.

In a further aspect, the disclosed woven fabric has a wicking time, when determined in accordance with AATCC Test Method 197, that is at least about 50% faster than the wicking time for a reference denim fabric; at least about 55% faster than the wicking time for a reference denim fabric; at least about 60% faster than the wicking time for a reference denim fabric; at least about 65% faster than the wicking time for a reference denim fabric; at least about 70% faster than the wicking time for a reference denim fabric; at least about 75% faster than the wicking time for a reference denim fabric; at least about 80% faster than the wicking time for a reference denim fabric; at least about 85% faster than the wicking time for a reference denim fabric; at least about 90% faster than the wicking time for a reference denim fabric; at least about 95% faster than the wicking time for a reference denim fabric; at least about 100% faster than the wicking time for a reference denim fabric; at least about 110% faster than the wicking time for a reference denim fabric; at least about 115% faster than the wicking time for a reference denim fabric; at least about 120% faster than the wicking time for a reference denim fabric; at least about 125% faster than the wicking time for a reference denim fabric; at least about 130% faster than the wicking time for a reference denim fabric; at least about 135% faster than the wicking time for a reference denim fabric; at least about 140% faster than the wicking time for a reference denim fabric; at least about 145% faster than the wicking time for a reference denim fabric; at least about 150% faster than the wicking time for a reference denim fabric; at least about 155% faster than the wicking time for a reference denim fabric; at least about 160% faster than the wicking time for a reference denim fabric; at least about 165% faster than the wicking time for a reference denim fabric; at least about 170% faster than the wicking time for a reference denim fabric; at least about 175% faster than the wicking time for a reference denim fabric; at least about 180% faster than the wicking time for a reference denim fabric; at least about 185% faster than the wicking time for a reference denim fabric; at least about 190% faster than the wicking time for a reference denim fabric; at least about 195% faster than the wicking time for a reference denim fabric; or at least about 200% faster than the wicking time for a reference denim fabric.

In a further aspect, the disclosed woven fabric has a drying time, when determined in accordance with AATCC Test Method 79, of less than about 60 secs. In a still further aspect, the disclosed woven fabric has a drying time, when determined in accordance with AATCC Test Method 79, of about 8 secs to about 30 secs; about 10 secs to about 20 secs; about 10 secs to about 15 secs; or a sub-range of within any of the foregoing ranges.

In a further aspect, the disclosed woven fabric has a drying time, when determined in accordance with AATCC Test Method 79 that is at least about 100% faster than the drying time for a reference denim fabric. In this context, it is to be understood that the reference denim fabric consists essentially of cotton yarn, having a fabric weight that is ±10% of the fabric, and the same weave pattern as the fabric. In a still further aspect, the disclosed woven fabric has a drying time, when determined in accordance with AATCC Test Method 79, that is faster than the drying time for the reference denim fabric by about 100%; about 200%; about 300%, about 400%; about 500%; or range encompassed by any combination of the foregoing values.

In a further aspect, the disclosed woven fabric has a drying rate, when determined in accordance with AATCC Test Method 201 that is less than about 2.5 ml/hr. In a still further aspect, the disclosed woven fabric has a drying rate, when determined in accordance with AATCC Test Method 201 that is about 0.5 ml/hr to about 1.5 ml/hr; about 0.5 ml/hr to about 1.0 ml/hr; about 0.5 ml/hr to about 0.7 ml/hr; or a sub-range within any of the foregoing ranges.

In a further aspect, the disclosed woven fabric has a UPF test value, when tested in accordance with AATCC Test Method 183, of at least about 1500 for dry evaluation and of at least about 3500 for wet evaluation. In a still further aspect, the disclosed woven fabric has a UPF test value, when tested in accordance with AATCC Test Method 183, of about 1500 to about 3000 for dry evaluation and of about 3500 to about 4500 for wet evaluation; about 1700 to about 2800 for dry evaluation and of about 3700 to about 4300 for wet evaluation; about 2000 to about 2700 for dry evaluation and of about 3800 to about 4200 for wet evaluation; or a sub-range within any of the foregoing ranges. In a yet further aspect, the disclosed woven fabric has a UPF test value, when tested in accordance with AATCC Test Method 183, of about 2500±10% for dry evaluation and of about 4100±10% for wet evaluation; about 2500±5% for dry evaluation and of about 4100±5% for wet evaluation; about 2500±3% for dry evaluation and of about 4100±3% for wet evaluation.

In a further aspect, the disclosed woven fabric has a UPF test value, when tested in accordance with AATCC Test Method 183, that is about 100% greater and for wet evaluation that is about 100% greater than for a reference denim fabric. In this context, it is understood that the reference denim fabric consists essentially of cotton yarn, having a fabric weight that is ±10% of the fabric, and the same weave pattern as the fabric. In a still further aspect, the disclosed woven fabric has a UPF test value, when tested in accordance with AATCC Test Method 183, that is about 150% greater and for wet evaluation that is about 150% greater than for the reference denim fabric. In a yet further aspect, the disclosed woven fabric has a UPF test value, when tested in accordance with AATCC Test Method 183, that is about 200% greater and for wet evaluation that is about 200% greater than for the reference denim fabric. In an even further aspect, the disclosed woven fabric has a UPF test value, when tested in accordance with AATCC Test Method 183, that is about 250% greater and for wet evaluation that is about 250% greater than for the reference denim fabric. In a still further aspect, the disclosed woven fabric has a UPF test value, when tested in accordance with AATCC Test Method 183, that is about 300% greater and for wet evaluation that is about 300% greater than for the reference denim fabric.

In an aspect, the first cooling composition can be present in a disclosed fabric in an amount of about 0.001 wt % to about 5 wt % based on the total weight of the fabric. In a further aspect, the first cooling composition can be present in an amount, based on the total weight of the fabric of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %;

about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

In an aspect, the second cooling composition can be present in a disclosed fabric in an amount of about 0.001 wt % to about 5 wt % based on the total weight of the fabric. In a further aspect, the second cooling composition can be present in an amount, based on the total weight of the fabric of about 0.001 wt %; about 0.002 wt %; about 0.003 wt %; about 0.004 wt %; about 0.005 wt %; about 0.006 wt %; about 0.007 wt %; about 0.008 wt %; about 0.009 wt %; about 0.010 wt %; about 0.011 wt %; about 0.012 wt %; about 0.013 wt %; about 0.014 wt %; about 0.015 wt %; about 0.016 wt %; about 0.017 wt %; about 0.018 wt %; about 0.019 wt %; about 0.020 wt %; about 0.021 wt %; about 0.022 wt %; about 0.023 wt %; about 0.024 wt %; about 0.025 wt %; about 0.026 wt %; about 0.027 wt %; about 0.028 wt %; about 0.029 wt %; 0.030 wt %; about 0.031 wt %; about 0.032 wt %; about 0.033 wt %; about 0.034 wt %; about 0.035 wt %; about 0.036 wt %; about 0.037 wt %; about 0.038 wt %; about 0.039 wt %; about 0.040 wt %; about 0.041 wt %; about 0.042 wt %; about 0.043 wt %; about 0.044 wt %; about 0.045 wt %; about 0.046 wt %; about 0.047 wt %; about 0.048 wt %; about 0.049 wt %; about 0.050 wt %; about 0.051 wt %; about 0.052 wt %; about 0.053 wt %; about 0.054 wt %; about 0.055 wt %; about 0.056 wt %; about 0.057 wt %; about 0.058 wt %; about 0.059 wt %; about 0.060 wt %; about 0.061 wt %; about 0.062 wt %; about 0.063 wt %; about 0.064 wt %; about 0.065 wt %; about 0.066 wt %; about 0.067 wt %; about 0.068 wt %; about 0.069 wt %; about 0.070 wt %; about 0.071 wt %; about 0.072 wt %; about 0.073 wt %; about 0.074 wt %; about 0.075 wt %; about 0.076 wt %; about 0.077 wt %; about 0.078 wt %; about 0.079 wt %; about 0.080 wt %; about 0.081 wt %; about 0.082 wt %; about 0.083 wt %; about 0.084 wt %; about 0.085 wt %; about 0.086 wt %; about 0.087 wt %; about 0.088 wt %; about 0.089 wt %; about 0.090 wt %; about 0.091 wt %; about 0.092 wt %; about 0.093 wt %; about 0.094 wt %; about 0.095 wt %; about 0.096 wt %; about 0.097 wt %; about 0.098 wt %; about 0.099 wt %; about 0.10 wt %; about 0.11 wt %; about 0.12 wt %; about 0.13 wt %; about 0.14 wt %; about 0.15 wt %; about 0.16 wt %; about 0.17 wt %; about 0.18 wt %; about 0.19 wt %; about 0.20 wt %; about 0.21 wt %; about 0.22 wt %; about 0.23 wt %; about 0.24 wt %; about 0.25 wt %; about 0.26 wt %; about 0.27 wt %; about 0.28 wt %; about 0.29 wt %; 0.30 wt %; about 0.31 wt %; about 0.32 wt %; about 0.33 wt %; about 0.34 wt %; about 0.35 wt %; about 0.36 wt %; about 0.37 wt %; about 0.38 wt %; about 0.39 wt %; about 0.40 wt %; about 0.41 wt %; about 0.42 wt %; about 0.43 wt %; about 0.44 wt %; about 0.45 wt %; about 0.46 wt %; about 0.47 wt %; about 0.48 wt %; about 0.49 wt %; about 0.50 wt %; about 0.51 wt %; about 0.52 wt %; about 0.53 wt %; about 0.54 wt %; about 0.55 wt %; about 0.56 wt %; about 0.57 wt %; about 0.58 wt %; about 0.59 wt %; about 0.60 wt %; about 0.61 wt %; about 0.62 wt %; about 0.63 wt %; about 0.64 wt %; about 0.65 wt %; about 0.66 wt %; about 0.67 wt %; about 0.68 wt %; about 0.69 wt %; about 0.70 wt %; about 0.71 wt %; about 0.72 wt %; about 0.73 wt %; about 0.74 wt %; about 0.75 wt %; about 0.76 wt %; about 0.77 wt %; about 0.78 wt %; about 0.79 wt %; about 0.80 wt %; about 0.81 wt %; about 0.82 wt %; about 0.83 wt %; about 0.84 wt %; about 0.85 wt %; about 0.86 wt %; about 0.87 wt %; about 0.88 wt %; about 0.89 wt %; about 0.90 wt %; about 0.91 wt %; about 0.92 wt %; about 0.93 wt %; about 0.94 wt %; about 0.95 wt %; about 0.96 wt %; about 0.97 wt %; about 0.98 wt %; about 0.99 wt %; about 1.0 wt %; about 1.1 wt %; about 1.2 wt %; about 1.3 wt %; about 1.4 wt %; about 1.5 wt %; about 1.6 wt %; about 1.7 wt %; about 1.8 wt %; about 1.9 wt %; about 2.0 wt %; about 2.1 wt %; about 2.2 wt %; about 2.3 wt %; about 2.4 wt %; about 2.5 wt %; about 2.6 wt %; about 2.7 wt %; about 2.8 wt %; about 2.9 wt %; about 3.0 wt %; about 3.1 wt %; about 3.2 wt %; about 3.3 wt %; about 3.4 wt %; about 3.5 wt %; about 3.6 wt %; about 3.7 wt %; about 3.8 wt %; about 3.9 wt %; about 4.0 wt %; about 4.1 wt %; about 4.2 wt %; about 4.3 wt %; about 4.4 wt %; about 4.5 wt %; about 4.6 wt %; about 4.7 wt %; about 4.8 wt %; about 4.9 wt %; about 5.0 wt %; a range utilizing any of the foregoing values; a sub-range with a range utilizing any of the foregoing values; or any set of values utilizing the foregoing values.

It is understood herein throughout that reference to a composition comprising an element, e.g., "a composition comprises Al, Ca, Cu, Fe . . . Zr" or "a composition comprises aluminum, calcium, copper, iron . . . zirconium," is intended to be inclusive of any form or valency of the element as appropriate for a given compound or material in which the element is part of the composition of the compound or material, unless otherwise specified. That is, it is understood that a reference to a particular element in a composition or material is inclusive of ionic forms of the element in typical oxidation states for that element if the composition or material comprises the element as an ionic compound; covalently bonded forms of the element if the composition or material comprises the element as an covalent compound; and elemental forms (i.e., oxidation state of 0) as suitable or appropriate for the indicated if the composition or material comprises the element in an oxidation state of 0, e.g., Al as metallic aluminum. Thus, reference to a composition, as discussed above, is intended to comprise ionic, covalent, and elemental forms of the element as disclosed herein.

For example, reference to a composition comprising aluminum refers to forms of aluminum disclosed herein, such as aluminum metal, $Al_2O_3$, tourmaline, and other disclosed aluminum containing minerals and compounds. Similarly, reference to a composition comprising: (a) calcium refers to materials comprising calcium disclosed herein, such as $CaCO_3$, dolomite, tourmaline, and other disclosed calcium containing minerals and compounds; (b) iron refers to materials comprising iron disclosed herein, such as iron metal, alloys comprising iron, $FeCl_2$, FeO, tourmaline, and other disclosed iron containing minerals and compounds; (c) potassium refers to materials comprising potassium disclosed herein, such as $K_2SO_4$, KCl, and other disclosed potassium containing minerals and compounds; (d) magnesium refers to materials comprising magnesium disclosed herein, such as magnesium metal, alloys comprising magnesium, $MgCO_3$, MgO, dolomite, tourmaline, and other disclosed magnesium containing minerals and compounds; (e) sodium refers to forms of sodium disclosed herein, such as sodium salts, tourmaline, and other disclosed sodium containing minerals and compounds; (f) silicon refers to materials comprising silicon disclosed herein, such as SiC, SiO, tourmaline, and other disclosed calcium containing minerals and compounds; and (g) silver refers to materials comprising silver disclosed herein, such as silver, alloys comprising silver, AgO, tourmaline, and other disclosed calcium containing minerals and compounds.

In addition, it is understood herein throughout, that an amount of an element, e.g., weight percent, is the overall weight percent for the element in aggregate as determined by elemental analysis and that the element may be present in one or more chemical and/or physical forms. For example, reference to 5 wt % silver as determined by element analysis refers to the determination that the material comprises 5 wt % silver which may be present in one or more of the disclosed forms of silver such as silver, a silver alloy, and AgO. This understanding extends to other elements that are specified as having been determined to be present at a certain weight percent as determined by elemental analysis.

In a further aspect, the disclosed fabric can comprise a first cooling composition comprising aluminum. Aluminum can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed fabric can comprise a first cooling composition comprising calcium. Calcium can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed fabric can comprise a first cooling composition comprising copper. Copper can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed fabric can comprise a first cooling composition comprising iron. Iron can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed fabric can comprise a first cooling composition comprising magnesium. Magnesium can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %;

about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed fabric can comprise a first cooling composition comprising potassium. Potassium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed fabric can comprise a first cooling composition comprising silver. Silver can be present in a first cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed fabric can comprise a first cooling composition comprising sodium. Sodium can be present in a first cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed fabric can comprise a first cooling composition comprising titanium. Titanium can be present in a first cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed fabric can comprise a first cooling composition comprising zirconium. Zirconium can be present in a first cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

In a further aspect, the disclosed fabric can comprise a second cooling composition comprising aluminum. Aluminum can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 0.9 wt %; about 0.05 wt % to about 0.8 wt %; about 0.05 wt % to about 0.7 wt %; about 0.10 wt % to about 1.0 wt %; about 0.15 wt % to about 1.0 wt %; about 0.20 wt % to about 1.0 wt %; a sub-range within any of the foregoing ranges; or any set of values utilizing values within any of the foregoing ranges.

In a further aspect, the disclosed fabric can comprise a second cooling composition comprising calcium. Calcium can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.1 wt % to about 4.0 wt %; about 0.1 wt % to about 3.0 wt %; about 0.1 wt % to about 2.0 wt %; about 1.0 wt % to about 5.0 wt %; about 1.0 wt % to about 4.0 wt %; about 1.0 wt % to about 3.0 wt %; a sub-range within any of the foregoing ranges; or any set of values utilizing values within any of the foregoing ranges.

In a further aspect, the disclosed fabric can comprise a second cooling composition comprising copper. Copper can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 9.0 wt %; about 1.0 wt % to about 8.0 wt %; about 1.0 wt % to about 7.0 wt %; about 1.0 wt % to about 6.0 wt %; about 0.5 wt % to about 5.0 wt %; about 0.5 wt % to about 4.0 wt %; about 0.5 wt % to about 3.0 wt %; a sub-range within any of the foregoing ranges; or any set of values utilizing values within any of the foregoing ranges.

In a further aspect, the disclosed fabric can comprise a second cooling composition comprising iron. Iron can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; about 0.1 wt % to about 2.0 wt %; a sub-range within any of the foregoing ranges; or any set of values utilizing values within any of the foregoing ranges.

In a further aspect, the disclosed fabric can comprise a second cooling composition comprising magnesium. Magnesium can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 15 wt %; about 0.05 wt % to about 1.0 wt %; about 0.05 wt % to about 0.7 wt %; about 0.05 wt % to about 0.5 wt %; about 0.05 wt % to about 0.3 wt %; about 1.0 wt % to about 15.0 wt %; about 1.0 wt % to about 14.0 wt %; about 1.0 wt % to about 13.0 wt %; about 1.0 wt % to about 12.0 wt %; about 1.0 wt % to about 11.0 wt %; about 1.0 wt % to about 10.0 wt %; about 5.0 wt % to about 15.0 wt %; a sub-range within any of the foregoing ranges; or any set of values utilizing values within any of the foregoing ranges.

In a further aspect, the disclosed fabric can comprise a second cooling composition comprising potassium. Potassium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt; about 0.05 wt % to about 0.5 wt %; about 0.1 wt % to about 5.0 wt %; about 0.1 wt % to about 4.0 wt %; about 0.1 wt % to about 3.0 wt %; about 1.0 wt % to about 2.0 wt %; about 1.0 wt % to about 4.0 wt %; about 2.0 wt % to about 5.0 wt %; a sub-range within any of the foregoing ranges; or any set of values utilizing values within any of the foregoing ranges.

In a further aspect, the disclosed fabric can comprise a second cooling composition comprising silver. Silver can be present in a second cooling composition in an amount of about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; about 0.01 wt % to about 10 wt %; about 0.05 wt % to about 1.0 wt %; about 0.05 wt % to about 0.7 wt %; about 0.05 wt % to about 0.5 wt %; about 0.05 wt % to about 0.3 wt %; about 0.1 wt % to about 10.0 wt %; about 0.1 wt % to about 9.0 wt %; about 0.1 wt % wt % to about 8.0 wt %; about 0.1 wt % to about 7.0 wt %; about 0.1 wt % to about 6.0 wt %; about 0.1 wt % to about 5.0 wt %; about 1.0 wt % to about 5.0 wt %; a sub-range within any of the foregoing ranges; or any set of values utilizing values within any of the foregoing ranges.

In a further aspect, the disclosed fabric can comprise a second cooling composition comprising sodium. Sodium can be present in a second cooling composition in an amount of about 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %; a sub-range within any of the foregoing ranges; or any set of values utilizing values within any of the foregoing ranges.

In a further aspect, the disclosed fabric can comprise a second cooling composition comprising titanium. Titanium can be present in a second cooling composition in an amount of about about 0.005 wt % to about 0.010 wt %; about 0.005 wt % to about 0.020 wt %; about 0.005 wt % to about 0.030 wt %; about 0.005 wt % to about 0.040 wt %; about 0.005 wt % to about 0.050 wt %; about 0.005 wt % to about 0.060 wt %; about 0.005 wt % to about 0.070 wt %; about 0.005 wt % to about 0.080 wt %; about 0.005 wt % to about 0.090 wt %; about 0.005 wt % to about 0.100 wt %; about 0.05 wt % to about 0.10 wt %; about 0.05 wt % to about 0.20 wt %; about 0.05 wt % to about 0.30 wt %; about 0.05 wt % to about 0.40 wt %; about 0.05 wt % to about 0.50 wt %; about 0.05 wt % to about 0.60 wt %; about 0.05 wt % to about 0.70 wt %; about 0.05 wt % to about 0.80 wt %; about 0.05 wt % to about 0.90 wt %; about 0.05 wt % to about 1.000 wt %; about 0.10 wt % to about 1.10 wt %; about 0.10 wt % to about 1.20 wt %; about 0.10 wt % to about 1.30 wt %; about 0.10 wt % to about 1.40 wt %; about 0.10 wt % to about 1.50 wt %; about 0.10 wt % to about 1.60 wt %; about 0.10 wt % to about 1.70 wt %; about 0.10 wt % to about 1.80 wt %; about 0.10 wt % to about 1.90 wt %; about 0.10 wt % to about 2.00 wt %; about 0.10 wt % to about 2.10 wt %; about 0.10 wt % to about 2.20 wt %; about 0.10 wt % to about 2.30 wt %; about 0.10 wt % to about 2.40 wt %; about 0.10 wt % to about 2.50 wt %; about 0.10 wt % to about 2.60 wt %; about 0.10 wt % to about 2.70 wt %; about 0.10 wt % to about 2.80 wt %; about 0.10 wt % to about 2.90 wt %; about 0.10 wt % to about 3.00 wt %; about 0.10 wt % to about 3.00 wt %; about 0.10 wt % to about 3.10 wt %; about 0.10 wt % to about 3.20 wt %; about 0.10 wt % to about 3.30 wt %; about 0.10 wt % to about 3.40 wt %; about 0.10 wt % to about 3.50 wt %; about 0.10 wt % to about 3.60 wt %; about 0.10 wt % to about 3.70 wt %; about 0.10 wt % to about 3.80 wt %; about 0.10 wt % to about 3.90 wt %; about 0.10 wt % to about 4.00 wt %; about 0.10 wt % to about 4.10 wt %; about 0.10 wt % to about 4.20 wt %; about 0.10 wt % to about 4.30 wt %; about 0.10 wt % to about 4.40 wt %; about 0.10 wt % to about 4.50 wt %; about 0.10 wt % to about 4.60 wt %; about 0.10 wt % to about 4.70 wt %; about 0.10 wt % to about 4.80 wt %; about 0.10 wt % to about 4.90 wt %; about 0.10 wt % to about 5.00 wt %; 0.01 wt % to about 5 wt %; about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.05 wt % to about 0.4 wt %; about 0.05 wt % to about 0.3 wt %; about 0.05 wt % to about 0.2 wt %; about 0.1 wt % to about 5.0 wt %; about 0.1 wt % to about 4.0 wt %; about 0.1 wt % to about 3.0 wt %; about 0.01 wt % to about 5 wt %; a sub-range within any of the foregoing ranges; or any set of values utilizing values within any of the foregoing ranges.

In a further aspect, the disclosed fabric can comprise a second cooling composition comprising zirconium. Zirconium can be present in a second cooling composition in an amount of about 0.05 wt % to about 1.0 wt %; about 0.05 wt % to about 0.9 wt %; about 0.05 wt % to about 0.8 wt %; about 0.05 wt % to about 0.7 wt %; about 0.05 wt % to about 0.6 wt %; about 0.05 wt % to about 0.5 wt %; about 0.1 wt % to about 5.0 wt %; about 0.1 wt % to about 4.0 wt %; about 0.1 wt % to about 3.0 wt %.

The weight percent for a cooling composition in a disclosed fabric, e.g., a cooling composition comprising aluminum, calcium, copper, iron, magnesium, potassium, silicon, silver, sodium, titanium, zirconium, or combinations, can be the weight percent based upon elemental analysis. In a particular instance, the elemental analysis can be carried out using field emission scanning electron microscopy with a segmented backscatter detector, an Everhart-Thornley electron detector, in-lens electron detectors, or combinations thereof. In some specific instances, the elemental analysis can be carried out using field emission scanning electron microscopy with energy-dispersive spectroscopy.

G. Articles

In one aspect, the disclosure relates to articles comprising a disclosed composite fiber. In a further aspect, the article comprising the disclosed composite fiber is an article of clothing, including, but not limited to a pair of pants, a shirt, a jacket, a dress, a glove, a skirt, T-shirt, vest, poly top, pullover, male or female brief, underwear, long-john, nightwear such as pajamas, intimate apparel, bra, cardigan, skit, dress, blouse, trousers, tracksuit bottom, shorts, sock, tie, pair of jeans, pair of gloves, coat, jacket, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed composite fiber is an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed composite fiber an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed composite fiber a floor covering. In a yet further aspect, the article comprising the disclosed composite fiber is a tote bag, a furniture cover, a tarpaulin, or a vehicle seat.

In one aspect, the disclosure relates to articles comprising a disclosed double-covered yarn. In a further aspect, the article comprising the disclosed double-covered yarn is an article of clothing, including, but not limited to a pair of pants, a shirt, a jacket, a dress, a glove, a skirt, T-shirt, vest, poly top, pullover, male or female brief, underwear, long-john, nightwear such as pajamas, bra, cardigan, skit, dress, blouse, trousers, tracksuit bottom, shorts, sock, tie, pair of jeans, pair of gloves, coat, jacket, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed double-covered yarn an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed double-covered yarn an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed double-covered yarn a floor covering. In a yet further aspect, the article comprising the disclosed double-covered yarn is a tote bag, a furniture cover, a tarpaulin, or a vehicle seat.

In one aspect, the disclosure relates to articles comprising a disclosed fabric. In a further aspect, the article comprising the disclosed fabric is an article of clothing, including, but not limited to a pair of pants, a shirt, a jacket, a dress, a glove, a skirt, T-shirt, vest, poly top, pullover, male or female brief, underwear, long-john, nightwear such as pajamas, bra, cardigan, skit, dress, blouse, trousers, tracksuit bottom, shorts, sock, tie, pair of jeans, pair of gloves, coat, jacket, boxing glove, mitt, hat, cap, skull cap, helmet, dressing gown, baby clothing, garments such as gowns, drapes, overalls, masks, uniforms such as chefs jackets and aprons, and an inner lining of clothing and towels. In a still further aspect, the article comprising the disclosed fabric an article of sportswear. Clothing includes footwear, for example, insoles, shoes, sandals and trainers. The fabric comprising the disclosed yarns and fabrics can constitute part of or, preferably, all of a garment fabric. For instance, it is possible to construct trousers, shirts, t-shirts where the fabric of each was the fabric of the present disclosure. Alternatively, only part of a garment may comprise the fabric of the present disclosure. For example, a garment such as a t-shirt or shirt, may comprise the fabric of the present disclosure in locations commonly associate with greater heating and/or generation of moisture, such as the 'armpits' or back of the garment.

In a further aspect, the article comprising the disclosed fabric an article of drapery, home textile, home furnishing, upholstery cover, mattress pad, mattress cover, mattress ticking, blanket, bed linen, table linen, sheet, duvet cover, throw, sleeping bag, or combinations of the foregoing articles. An article in the form of upholstery covers, includes, but is not limited to, upholstery covers for furniture for home, institutional and commercial markets, and for transportation seating. In a still further aspect, the article comprising the disclosed fabric a floor covering. In a yet further aspect, the article comprising the disclosed fabric is a tote bag, a furniture cover, a tarpaulin, or a vehicle seat.

H. Aspects

The following listing of exemplary aspects supports and is supported by the disclosure provided herein.

Aspect 1. A composite fiber comprising a core component and a sheath component, wherein: (a) the core component comprises a polyester polymer and a first cooling composition; and (b) the sheath component comprises a polyamide polymer and a second cooling composition; wherein the first cooling composition is present in an amount from about 0.1 wt % to about 25 wt % based on the total weight of the polyester polymer and the first cooling composition; wherein the first cooling composition comprises aluminum, calcium, copper, iron, magnesium, potassium, silicon, silver, sodium, titanium, zirconium, and combinations thereof; wherein the second cooling composition is present in an amount from about 0.1 wt % to about 35 wt % based on the total weight of the polyamide polymer and the second cooling composition; and wherein the second cooling composition comprises aluminum, calcium, copper, iron, magnesium, potassium, silicon, silver, sodium, titanium, zirconium, and combinations thereof.

Aspect 2. The composite fiber of 1, wherein the polyester polymer is a polyethylene terephthalate, a polytrimethylene terephthalate, or combinations thereof.

Aspect 3. The composite fiber of Aspect 2, wherein the polyester polymer is a polyethylene terephthalate.

Aspect 4. The composite fiber of any one of 1-Aspect 3, wherein the polyamide polymer is a nylon 6, nylon 4/6, nylon 6/6, nylon 6/10, nylon 6/12, nylon 11, nylon 12, or combinations thereof.

Aspect 5. The composite fiber of Aspect 4, wherein the polyamide polymer is a nylon 6/6.

Aspect 6. The composite fiber of any one of 1-Aspect 5, wherein the first cooling composition is present in an amount of about 0.1 wt % to about 20 wt % based on the total weight of the polyester polymer and the first cooling composition.

Aspect 7. The composite fiber of Aspect 6, wherein the first cooling composition is present in an amount of about 1 wt % to about 20 wt % based on the total weight of the polyester polymer and the first cooling composition.

Aspect 8. The composite fiber of Aspect 6, wherein the first cooling composition is present in an amount of about 5 wt % to about 20 wt % based on the total weight of the polyester polymer and the first cooling composition.

Aspect 9. The composite fiber of Aspect 6, wherein the first cooling composition is present in an amount of about 10 wt % to about 20 wt % based on the total weight of the polyester polymer and the first cooling composition.

Aspect 10. The composite fiber of any one of 1-Aspect 9, wherein the first cooling composition comprises a first ceramic material, a first cooling compound, a first metal, a first metal alloy, a first metal oxide, a first mineral, a first salt, or combinations thereof.

Aspect 11. The composite fiber of Aspect 10, wherein the first ceramic material comprises aluminum oxide, aluminum titanate, zirconium oxide, aluminum nitride, silicon carbide, silicon nitride, silicon alumina nitride, or combinations thereof.

Aspect 12. The composite fiber of Aspect 10, wherein the first cooling compound comprises a transition metal oxide, a Group 1 oxide, a Group 2 oxide, a Group 13 oxide, a Group 14 oxide, a transition metal carbide, a Group 13 carbide, Group 14 carbide, a transition metal nitride, a Group 13 nitride, Group 14 nitride, or mixtures thereof.

Aspect 13. The composite fiber of Aspect 12, wherein the first cooling compound comprises aluminum oxide, magnesium oxide, silicon carbide, silicon dioxide, silicon carbide, silicon dioxide, titanium oxide, titanium dioxide, titanium trioxide, zirconium dioxide, or combinations thereof.

Aspect 14. The composite fiber of Aspect 13, wherein the first cooling compound comprises aluminum oxide, magnesium oxide, silicon dioxide, titanium dioxide, or combinations thereof.

Aspect 15. The composite fiber of Aspect 14, wherein the first cooling compound comprises titanium dioxide.

Aspect 16. The composite fiber of Aspect 10, wherein the first metal comprises silver, aluminum, copper, or combinations thereof.

Aspect 17. The composite fiber of Aspect 16, wherein the first metal comprises silver.

Aspect 18. The composite fiber of Aspect 16, wherein the first metal comprises copper.

Aspect 19. The composite fiber of Aspect 16, wherein the first metal comprises a mixture of copper and silver.

Aspect 20. The composite fiber of Aspect 10, wherein the first metal alloy comprises silver, aluminum, copper, or combinations thereof.

Aspect 21. The composite fiber of Aspect 20, wherein in the first metal alloy comprises silver.

Aspect 22. The composite fiber of Aspect 20, wherein in the first metal alloy comprises copper.

Aspect 23. The composite fiber of Aspect 20, wherein in the first metal alloy comprises silver and copper.

Aspect 24. The composite fiber of Aspect 10, wherein the first metal oxide comprises gold (II) oxide, gold (Ill) oxide, silver (I) oxide, silver (II) oxide, silver (I, Ill) oxide, magnesium oxide, iron (II) oxide, iron (Ill) oxide, copper (I) oxide, copper (II) oxide, or combinations thereof.

Aspect 25. The composite fiber of Aspect 24, wherein the first metal oxide comprises silver (I) oxide, copper (I) oxide, copper (II) oxide, or combinations thereof.

Aspect 26. The composite fiber of Aspect 24, wherein the first metal oxide comprises silver (I) oxide.

Aspect 27. The composite fiber of Aspect 10, wherein the first mineral comprises dolomite, tourmaline, zircon, magnesia, magnesite, calcite, aragonite, zircon, limestone, allendeite, periclase, baddeleyite, eudialyte, loranskite, menezesite, rutile, ilmenite, titanite, anatase, brookite, is quartz, granite, chalcedony, chrysoprase, garnet, phenacite, olivine, mica, kaolinite, feldspar, zeolite, carnelian, agate, onyx, jasper, heliotrope, flint, calzirtite, kobeite, lakargiite, lindsleyite, loveringite, mathiasite, tazheranite, zircon, zirconolite, zirkelite, or combinations thereof.

Aspect 28. The composite fiber of Aspect 27, wherein the first mineral comprises dolomite, tourmaline, zircon, magnesia, magnesite, calcite, periclase, limestone, aragonite, quartz, or combinations thereof.

Aspect 29. The composite fiber of Aspect 10, wherein the first mineral comprises calcium, magnesium, silicon, zirconium, titanium, or combinations thereof.

Aspect 30. The composite fiber of Aspect 29, wherein the first mineral comprising calcium is calcite, aragonite, dolomite, tourmaline, or combinations thereof.

Aspect 31. The composite fiber of Aspect 29, wherein the first mineral comprising magnesium is magnesia, periclase, magnesite, dolomite, tourmaline, or combinations thereof.

Aspect 32. The composite fiber of Aspect 29, wherein the first mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof.

Aspect 33. The composite fiber of Aspect 29, wherein the first mineral comprising titanium is rutile, ilmenite, titanite, anatase, brookite, or combinations thereof.

Aspect 34. The composite fiber of Aspect 29, wherein the first mineral comprising zirconium is zircon, allendeite, baddeleyite, eudialyte, loranskite, menezesite, or combinations thereof.

Aspect 35. The composite fiber of Aspect 29, wherein the first mineral comprises zirconium and titanium; and wherein the mineral is calzirtite, kobeite, lakargiite, lindsleyite, loveringite, mathiasite, tazheranite, zircon, zirconolite, zirkelite, or combinations thereof.

Aspect 36. The composite fiber of Aspect 10, wherein the first cooling salt is a Group I salt, a Group II salt, a transition metal salt, or combinations thereof.

Aspect 37. The composite fiber of Aspect 36, wherein the first cooling salt is a Group I salt.

Aspect 38. The composite fiber of Aspect 37, wherein the first cooling salt is a Group I salt comprising a cation of sodium, potassium or combinations thereof.

Aspect 39. The composite fiber of any one of Aspect 36-Aspect 38, wherein the first cooling salt comprises a Group I carbonate, a Group I halide, a Group I nitrate, a Group I sulfate, or combinations thereof.

Aspect 40. The composite fiber of Aspect 36, wherein the first cooling salt is a Group II salt.

Aspect 41. The composite fiber of Aspect 40, wherein the first cooling salt is a Group II salt comprising a cation of calcium, magnesium or combinations thereof.

Aspect 42. The composite fiber of any one of Aspect 36, Aspect 40, or Aspect 41, wherein the first cooling salt comprises a Group II carbonate, a Group II halide, a Group II nitrate, a Group II sulfate, or combinations thereof.

Aspect 43. The composite fiber of Aspect 36, wherein the first cooling salt is a transition metal salt.

Aspect 44. The composite fiber of Aspect 43, wherein the first cooling salt is a transition metal salt comprising a cation of silver, copper, titanium, iron, nickel, zinc, gold, or combinations thereof.

Aspect 45. The composite fiber of any one of Aspect 36, Aspect 43, or Aspect 44, wherein the first cooling salt comprises a transition metal carbonate, a transition metal halide, a transition metal nitrate, a transition metal sulfate, or combinations thereof.

Aspect 46. The composite fiber of any one of Aspect 36-Aspect 45, wherein the first cooling salt comprises a Group I sulfate, a Group II sulfate, transition metal sulfate, or combinations thereof.

Aspect 47. The composite fiber of Aspect 46, wherein the first cooling salt comprises sodium sulfate, potassium sulfate, calcium sulfate, magnesium sulfate, or combinations thereof.

Aspect 48. The composite fiber of any one of Aspect 36-Aspect 45, wherein the first cooling salt comprises a Group I halide, a Group II halide, transition metal halide, or combinations thereof.

Aspect 49. The composite fiber of Aspect 48, wherein the first cooling salt comprises iron (II) chloride, iron (III) chloride, sodium chloride, potassium chloride, calcium chloride, magnesium chloride, or combinations thereof.

Aspect 50. The composite fiber of Aspect 49, wherein the first cooling salt comprises potassium chloride.

Aspect 51. The composite fiber of any one of Aspect 36-Aspect 45, wherein the first cooling salt comprises a Group I carbonate, a Group II carbonate, transition metal carbonate, or combinations thereof.

Aspect 52. The composite fiber of Aspect 51, wherein the first cooling salt comprises calcium carbonate, magnesium carbonate, or combinations thereof.

Aspect 53. The composite fiber of any one of 1-Aspect 52, wherein the first cooling material is a powder, a wire, a filament, a sheet, a particle, or combinations thereof.

Aspect 54. The composite fiber of Aspect 53, wherein the first cooling composition comprises a particle, a powder, or combinations thereof.

Aspect 55. The composite fiber of Aspect 54, where the first cooling composition comprises a particle.

Aspect 56. The composite fiber of Aspect 55, wherein the first cooling composition comprises a nanoparticle, a microparticle, or combinations thereof.

Aspect 57. The composite fiber of Aspect 56, wherein the nanoparticle has a size of about 10 nm to about 100 nm.

Aspect 58. The composite fiber of Aspect 56, wherein the nanoparticle has a size of about 15 nm to about 50 nm.

Aspect 59. The composite fiber of Aspect 56, wherein the nanoparticle has a size of about 20 nm to about 40 nm.

Aspect 60. The composite fiber of Aspect 56, wherein the microparticle has a size of about 10 μm to about 200 μm.

Aspect 61. The composite fiber of Aspect 56, wherein the microparticle has a size of about 20 μm to about 100 μm.

Aspect 62. The composite fiber of Aspect 56, wherein the microparticle has a size of about 30 μm to about 90 μm.

Aspect 63. The composite fiber of Aspect 56, wherein the microparticle has a size of about 40 μm to about 80 μm.

Aspect 64. The composite fiber of Aspect 56, wherein the microparticle has a size of about 50 μm to about 70 μm.

Aspect 65. The composite fiber of any one of 1-Aspect 64, wherein the aluminum is present in the first cooling composition in an amount of about 0.01 wt % to about 5 wt %.

Aspect 66. The composite fiber of Aspect 65, wherein the aluminum is present in the first cooling composition in an amount of about 0.05 wt % to about 0.9 wt %.

Aspect 67. The composite fiber of Aspect 65, wherein the aluminum is present in the first cooling composition in an amount of about 0.05 wt % to about 0.8 wt %.

Aspect 68. The composite fiber of Aspect 65, wherein the aluminum is present in the first cooling composition in an amount of about 0.05 wt % to about 0.7 wt %.

Aspect 69. The composite fiber of Aspect 65, wherein the aluminum is present in the first cooling composition in an amount of about 0.10 wt % to about 1.0 wt %.

Aspect 70. The composite fiber of Aspect 65, wherein the aluminum is present in the first cooling composition in an amount of about 0.15 wt % to about 1.0 wt %.

Aspect 71. The composite fiber of Aspect 65, wherein the aluminum is present in the first cooling composition in an amount of about 0.20 wt % to about 1.0 wt %.

Aspect 72. The composite fiber of any one of 1-Aspect 71, wherein the calcium is present in the first cooling composition in an amount of about 0.01 wt % to about 5 wt %.

Aspect 73. The composite fiber of Aspect 72, wherein the calcium is present in the first cooling composition in an amount of about 0.05 wt % to about 1.0 wt %.

Aspect 74. The composite fiber of Aspect 72, wherein the calcium is present in the first cooling composition in an amount of about 0.05 wt % to about 0.9 wt %.

Aspect 75. The composite fiber of Aspect 72, wherein the calcium is present in the first cooling composition in an amount of about 0.05 wt % to about 0.8 wt %.

Aspect 76. The composite fiber of Aspect 72, wherein the calcium is present in the first cooling composition in an amount of about 0.05 wt % to about 0.7 wt %.

Aspect 77. The composite fiber of Aspect 72, wherein the calcium is present in the first cooling composition in an amount of about 0.1 wt % to about 4.0 wt %.

Aspect 78. The composite fiber of Aspect 72, wherein the calcium is present in the first cooling composition in an amount of about 0.1 wt % to about 3.0 wt %.

Aspect 79. The composite fiber of Aspect 72, wherein the calcium is present in the first cooling composition in an amount of about 0.1 wt % to about 2.0 wt %.

Aspect 80. The composite fiber of Aspect 72, wherein the calcium is present in the first cooling composition in an amount of about 1.0 wt % to about 5.0 wt %.

Aspect 81. The composite fiber of Aspect 72, wherein the calcium is present in the first cooling composition in an amount of about 1.0 wt % to about 4.0 wt %.

Aspect 82. The composite fiber of Aspect 72, wherein the calcium is present in the first cooling composition in an amount of about 1.0 wt % to about 3.0 wt %.

Aspect 83. The composite fiber of any one of 1-Aspect 82, wherein the copper is present in the first cooling composition in an amount of about 0.01 wt % to about 10 wt %.

Aspect 84. The composite fiber of Aspect 83, wherein the copper is present in the first cooling composition in an amount of about 0.05 wt % to about 1.0 wt %.

Aspect 85. The composite fiber of Aspect 83, wherein the copper is present in the first cooling composition in an amount of about 0.05 wt % to about 0.7 wt %.

Aspect 86. The composite fiber of Aspect 83, wherein the copper is present in the first cooling composition in an amount of about 0.05 wt % to about 0.5 wt %.

Aspect 87. The composite fiber of Aspect 83, wherein the copper is present in the first cooling composition in an amount of about 0.05 wt % to about 0.3 wt %.

Aspect 88. The composite fiber of Aspect 83, wherein the copper is present in the first cooling composition in an amount of about 1.0 wt % to about 9.0 wt %.

Aspect 89. The composite fiber of Aspect 83, wherein the copper is present in the first cooling composition in an amount of about 1.0 wt % to about 8.0 wt %.

Aspect 90. The composite fiber of Aspect 83, wherein the copper is present in the first cooling composition in an amount of about 1.0 wt % to about 7.0 wt %.

Aspect 91. The composite fiber of Aspect 83, wherein the copper is present in the first cooling composition in an amount of about 1.0 wt % to about 6.0 wt %.

Aspect 92. The composite fiber of Aspect 83, wherein the copper is present in the first cooling composition in an amount of about 0.5 wt % to about 5.0 wt %.

Aspect 93. The composite fiber of Aspect 83, wherein the copper is present in the first cooling composition in an amount of about 0.5 wt % to about 4.0 wt %.

Aspect 94. The composite fiber of Aspect 83, wherein the copper is present in the first cooling composition in an amount of about 0.5 wt % to about 3.0 wt %.

Aspect 95. The composite fiber of any one of 1-Aspect 94, wherein the iron is present in the first cooling composition in an amount of about 0.01 wt % to about 5 wt %.

Aspect 96. The composite fiber of Aspect 95, wherein the iron is present in the first cooling composition in an amount of about 0.05 wt % to about 1.0 wt %.

Aspect 97. The composite fiber of Aspect 95, wherein the iron is present in the first cooling composition in an amount of about 0.05 wt % to about 0.9 wt %.

Aspect 98. The composite fiber of Aspect 95, wherein the iron is present in the first cooling composition in an amount of about 0.05 wt % to about 0.8 wt %.

Aspect 99. The composite fiber of Aspect 95, wherein the iron is present in the first cooling composition in an amount of about 0.05 wt % to about 0.7 wt %.

Aspect 100. The composite fiber of Aspect 95, wherein the iron is present in the first cooling composition in an amount of about 0.05 wt % to about 0.6 wt %.

Aspect 101. The composite fiber of Aspect 95, wherein the iron is present in the first cooling composition in an amount of about 0.05 wt % to about 0.5 wt %.

Aspect 102. The composite fiber of Aspect 95, wherein the iron is present in the first cooling composition in an amount of about 0.1 wt % to about 5.0 wt %.

Aspect 103. The composite fiber of Aspect 95, wherein the iron is present in the first cooling composition in an amount of about 0.1 wt % to about 4.0 wt %.

Aspect 104. The composite fiber of Aspect 95, wherein the iron is present in the first cooling composition in an amount of about 0.1 wt % to about 3.0 wt %.

Aspect 105. The composite fiber of Aspect 95, wherein the iron is present in the first cooling composition in an amount of about 0.1 wt % to about 2.0 wt %.

Aspect 106. The composite fiber of any one of 1-Aspect 105, wherein the magnesium is present in the first cooling composition in an amount of about 0.01 wt % to about 15 wt %.

Aspect 107. The composite fiber of Aspect 106, wherein the magnesium is present in the first cooling composition in an amount of about 0.05 wt % to about 1.0 wt %.

Aspect 108. The composite fiber of Aspect 106, wherein the magnesium is present in the first cooling composition in an amount of about 0.05 wt % to about 0.7 wt %.

Aspect 109. The composite fiber of Aspect 106, wherein the magnesium is present in the first cooling composition in an amount of about 0.05 wt % to about 0.5 wt %.

Aspect 110. The composite fiber of Aspect 106, wherein the magnesium is present in the first cooling composition in an amount of about 0.05 wt % to about 0.3 wt %.

Aspect 111. The composite fiber of Aspect 106, wherein the magnesium is present in the first cooling composition in an amount of about 1.0 wt % to about 15.0 wt %.

Aspect 112. The composite fiber of Aspect 106, wherein the magnesium is present in the first cooling composition in an amount of about 1.0 wt % to about 14.0 wt %.

Aspect 113. The composite fiber of Aspect 106, wherein the magnesium is present in the first cooling composition in an amount of about 1.0 wt % to about 13.0 wt %.

Aspect 114. The composite fiber of Aspect 106, wherein the magnesium is present in the first cooling composition in an amount of about 1.0 wt % to about 12.0 wt %.

Aspect 115. The composite fiber of Aspect 106, wherein the magnesium is present in the first cooling composition in an amount of about 1.0 wt % to about 11.0 wt %.

Aspect 116. The composite fiber of Aspect 106, wherein the magnesium is present in the first cooling composition in an amount of about 1.0 wt % to about 10.0 wt %.

Aspect 117. The composite fiber of Aspect 106, wherein the magnesium is present in the first cooling composition in an amount of about 5.0 wt % to about 15.0 wt %.

Aspect 118. The composite fiber of any one of 1-Aspect 117, wherein the potassium is present in the first cooling composition in an amount of about 0.01 wt % to about 5 wt %.

Aspect 119. The composite fiber of Aspect 118, wherein the potassium is present in the first cooling composition in an amount of about 0.05 wt % to about 1.0 wt %.

Aspect 120. The composite fiber of Aspect 118, wherein the potassium is present in the first cooling composition in an amount of about 0.05 wt % to about 0.9 wt %.

Aspect 121. The composite fiber of Aspect 118, wherein the potassium is present in the first cooling composition in an amount of about 0.05 wt % to about 0.8 wt %.

Aspect 122. The composite fiber of Aspect 118, wherein the potassium is present in the first cooling composition in an amount of about 0.05 wt % to about 0.7 wt %.

Aspect 123. The composite fiber of Aspect 118, wherein the potassium is present in the first cooling composition in an amount of about 0.05 wt % to about 0.6 wt %.

Aspect 124. The composite fiber of Aspect 118, wherein the potassium is present in the first cooling composition in an amount of about 0.05 wt % to about 0.5 wt %.

Aspect 125. The composite fiber of Aspect 118, wherein the potassium is present in the first cooling composition in an amount of about 0.1 wt % to about 5.0 wt %.

Aspect 126. The composite fiber of Aspect 118, wherein the potassium is present in the first cooling composition in an amount of about 0.1 wt % to about 4.0 wt %.

Aspect 127. The composite fiber of Aspect 118, wherein the potassium is present in the first cooling composition in an amount of about 0.1 wt % to about 3.0 wt %.

Aspect 128. The composite fiber of Aspect 118, wherein the potassium is present in the first cooling composition in an amount of about 1.0 wt % to about 2.0 wt %.

Aspect 129. The composite fiber of Aspect 118, wherein the potassium is present in the first cooling composition in an amount of about 1.0 wt % to about 4.0 wt %.

Aspect 130. The composite fiber of Aspect 118, wherein the potassium is present in the first cooling composition in an amount of about 2.0 wt % to about 5.0 wt %.

Aspect 131. The composite fiber of any one of 1-Aspect 130, wherein the silver is present in the first cooling composition in an amount of about 0.01 wt % to about 10 wt %.

Aspect 132. The composite fiber of Aspect 131, wherein the silver is present in the first cooling composition in an amount of about 0.05 wt % to about 1.0 wt %.

Aspect 133. The composite fiber of Aspect 131, wherein the silver is present in the first cooling composition in an amount of about 0.05 wt % to about 0.7 wt %.

Aspect 134. The composite fiber of Aspect 131, wherein the silver is present in the first cooling composition in an amount of about 0.05 wt % to about 0.5 wt %.

Aspect 135. The composite fiber of Aspect 131, wherein the silver is present in the first cooling composition in an amount of about 0.05 wt % to about 0.3 wt %.

Aspect 136. The composite fiber of Aspect 131, wherein the silver is present in the first cooling composition in an amount of about 0.1 wt % to about 10.0 wt %.

Aspect 137. The composite fiber of Aspect 131, wherein the silver is present in the first cooling composition in an amount of about 0.1 wt % to about 9.0 wt %.

Aspect 138. The composite fiber of Aspect 131, wherein the silver is present in the first cooling composition in an amount of about 0.1 wt % wt % to about 8.0 wt %.

Aspect 139. The composite fiber of Aspect 131, wherein the silver is present in the first cooling composition in an amount of about 0.1 wt % to about 7.0 wt %.

Aspect 140. The composite fiber of Aspect 131, wherein the silver is present in the first cooling composition in an amount of about 0.1 wt % to about 6.0 wt %.

Aspect 141. The composite fiber of Aspect 131, wherein the silver is present in the first cooling composition in an amount of about 0.1 wt % to about 5.0 wt %.

Aspect 142. The composite fiber of Aspect 131, wherein the silver is present in the first cooling composition in an amount of about 1.0 wt % to about 5.0 wt %.

Aspect 143. The composite fiber of any one of 1-Aspect 142, wherein the sodium is present in the first cooling composition in an amount of about 0.01 wt % to about 5 wt %.

Aspect 144. The composite fiber of Aspect 143, wherein the sodium is present in the first cooling composition in an amount of about 0.05 wt % to about 1.0 wt %.

Aspect 145. The composite fiber of Aspect 143, wherein the sodium is present in the first cooling composition in an amount of about 0.05 wt % to about 0.9 wt %.

Aspect 146. The composite fiber of Aspect 143, wherein the sodium is present in the first cooling composition in an amount of about 0.05 wt % to about 0.8 wt %.

Aspect 147. The composite fiber of Aspect 143, wherein the sodium is present in the first cooling composition in an amount of about 0.05 wt % to about 0.7 wt %.

Aspect 148. The composite fiber of Aspect 143, wherein the sodium is present in the first cooling composition in an amount of about 0.05 wt % to about 0.6 wt %.

Aspect 149. The composite fiber of Aspect 143, wherein the sodium is present in the first cooling composition in an amount of about 0.05 wt % to about 0.5 wt %.

Aspect 150. The composite fiber of Aspect 143, wherein the sodium is present in the first cooling composition in an amount of about 0.1 wt % to about 5.0 wt %.

Aspect 151. The composite fiber of Aspect 143, wherein the sodium is present in the first cooling composition in an amount of about 0.1 wt % to about 4.0 wt %.

Aspect 152. The composite fiber of Aspect 143, wherein the sodium is present in the first cooling composition in an amount of about 0.1 wt % to about 3.0 wt %.

Aspect 153. The composite fiber of any one of 1-Aspect 152, wherein the titanium is present in the first cooling composition in an amount of about 0.01 wt % to about 5 wt %.

Aspect 154. The composite fiber of Aspect 153, wherein the titanium is present in the first cooling composition in an amount of about 0.05 wt % to about 1.0 wt %.

Aspect 155. The composite fiber of Aspect 153, wherein the titanium is present in the first cooling composition in an amount of about 0.05 wt % to about 0.9 wt %.

Aspect 156. The composite fiber of Aspect 153, wherein the titanium is present in the first cooling composition in an amount of about 0.05 wt % to about 0.8 wt %.

Aspect 157. The composite fiber of Aspect 153, wherein the titanium is present in the first cooling composition in an amount of about 0.05 wt % to about 0.7 wt %.

Aspect 158. The composite fiber of Aspect 153, wherein the titanium is present in the first cooling composition in an amount of about 0.05 wt % to about 0.6 wt %.

Aspect 159. The composite fiber of Aspect 153, wherein the titanium is present in the first cooling composition in an amount of about 0.05 wt % to about 0.5 wt %.

Aspect 160. The composite fiber of Aspect 153, wherein the titanium is present in the first cooling composition in an amount of about 0.05 wt % to about 0.4 wt %.

Aspect 161. The composite fiber of Aspect 153, wherein the titanium is present in the first cooling composition in an amount of about 0.05 wt % to about 0.3 wt %.

Aspect 162. The composite fiber of Aspect 153, wherein the titanium is present in the first cooling composition in an amount of about 0.05 wt % to about 0.2 wt %.

Aspect 163. The composite fiber of Aspect 153, wherein the titanium is present in the first cooling composition in an amount of about 0.1 wt % to about 5.0 wt %.

Aspect 164. The composite fiber of Aspect 153, wherein the titanium is present in the first cooling composition in an amount of about 0.1 wt % to about 4.0 wt %.

Aspect 165. The composite fiber of Aspect 153, wherein the titanium is present in the first cooling composition in an amount of about 0.1 wt % to about 3.0 wt %.

Aspect 166. The composite fiber of any one of 1-Aspect 165, wherein the zirconium is present in the first cooling composition in an amount of about 0.01 wt % to about 5 wt %.

Aspect 167. The composite fiber of Aspect 166, wherein the zirconium is present in the first cooling composition in an amount of about 0.05 wt % to about 1.0 wt %.

Aspect 168. The composite fiber of Aspect 166, wherein the zirconium is present in the first cooling composition in an amount of about 0.05 wt % to about 0.9 wt %.

Aspect 169. The composite fiber of Aspect 166, wherein the zirconium is present in the first cooling composition in an amount of about 0.05 wt % to about 0.8 wt %.

Aspect 170. The composite fiber of Aspect 166, wherein the zirconium is present in the first cooling composition in an amount of about 0.05 wt % to about 0.7 wt %.

Aspect 171. The composite fiber of Aspect 166, wherein the zirconium is present in the first cooling composition in an amount of about 0.05 wt % to about 0.6 wt %.

Aspect 172. The composite fiber of Aspect 166, wherein the zirconium is present in the first cooling composition in an amount of about 0.05 wt % to about 0.5 wt %.

Aspect 173. The composite fiber of Aspect 166, wherein the zirconium is present in the first cooling composition in an amount of about 0.1 wt % to about 5.0 wt %.

Aspect 174. The composite fiber of Aspect 166, wherein the zirconium is present in the first cooling composition in an amount of about 0.1 wt % to about 4.0 wt %.

Aspect 175. The composite fiber of Aspect 166, wherein the zirconium is present in the first cooling composition in an amount of about 0.1 wt % to about 3.0 wt %.

Aspect 176. The composite fiber of any one of Aspect 65-Aspect 175, wherein a wt % amount of aluminum, calcium, copper, iron, magnesium, potassium, silicon, silver, sodium, titanium, zirconium, or combinations thereof is the wt % amount of the element as determined by elemental analysis of the polyester polymer and the first cooling composition.

Aspect 177. The composite fiber of Aspect 176, wherein the elemental analysis is carried out using field emission scanning electron microscopy with a segmented backscatter detector, a Everhart-Thornley electron detector, in-lens electron detectors, or combinations thereof.

Aspect 178. The composite fiber of Aspect 176, wherein the elemental analysis is carried out using field emission scanning electron microscopy with energy-dispersive spectroscopy.

Aspect 179. The composite fiber of any one of 1-Aspect 178, wherein the second cooling composition is present in an amount of about 0.1 wt % to about 30 wt % based on the total weight of the polyamide polymer and the second cooling composition.

Aspect 180. The composite fiber of Aspect 179, wherein the second cooling composition is present in an amount of about 1 wt % to about 30 wt % based on the total weight of the polyamide polymer and the second cooling composition.

Aspect 181. The composite fiber of Aspect 179, wherein the second cooling composition is present in an amount of about 1 wt % to about 25 wt % based on the total weight of the polyamide polymer and the second cooling composition.

Aspect 182. The composite fiber of Aspect 179, wherein the second cooling composition is present in an amount of about 5 wt % to about 35 wt % based on the total weight of the polyamide polymer and the second cooling composition.

Aspect 183. The composite fiber of Aspect 179, wherein the second cooling composition is present in an amount of about 5 wt % to about 30 wt % based on the total weight of the polyamide polymer and the second cooling composition.

Aspect 184. The composite fiber of Aspect 179, wherein the second cooling composition is present in an amount of about 10 wt % to about 35 wt % based on the total weight of the polyamide polymer and the second cooling composition.

Aspect 185. The composite fiber of Aspect 179, wherein the second cooling composition is present in an amount of about 10 wt % to about 30 wt % based on the total weight of the polyamide polymer and the second cooling composition.

Aspect 186. The composite fiber of Aspect 179, wherein the second cooling composition is present in an amount of about 15 wt % to about 35 wt % based on the total weight of the polyamide polymer and the second cooling composition.

Aspect 187. The composite fiber of Aspect 179, wherein the second cooling composition is present in an amount of about 15 wt % to about 30 wt % based on the total weight of the polyamide polymer and the second cooling composition.

Aspect 188. The composite fiber of any one of 1-Aspect 187, wherein the second cooling composition comprises a second ceramic material, a second cooling compound, a second metal, a second metal alloy, a second metal oxide, a second mineral, a second salt, or combinations thereof.

Aspect 189. The composite fiber of Aspect 188, wherein the second ceramic material comprises aluminum oxide, aluminum titanate, zirconium oxide, aluminum nitride, silicon carbide, silicon nitride, silicon alumina nitride, or combinations thereof.

Aspect 190. The composite fiber of Aspect 188, wherein the second cooling compound comprises a transition metal oxide, a Group 1 oxide, a Group 2 oxide, a Group 13 oxide, a Group 14 oxide, a transition metal carbide, a Group 13 carbide, Group 14 carbide, a transition metal nitride, a Group 13 nitride, Group 14 nitride, or mixtures thereof.

Aspect 191. The composite fiber of Aspect 190, wherein the second cooling compound comprises aluminum oxide, magnesium oxide, silicon carbide, silicon dioxide, silicon carbide, silicon dioxide, titanium oxide, titanium dioxide, titanium trioxide, zirconium dioxide, or combinations thereof.

Aspect 192. The composite fiber of Aspect 191, wherein the second cooling compound comprises aluminum oxide, magnesium oxide, silicon dioxide, titanium dioxide, or combinations thereof.

Aspect 193. The composite fiber of Aspect 192, wherein the second cooling compound comprises titanium dioxide.

Aspect 194. The composite fiber of Aspect 188, wherein the second metal comprises silver, aluminum, copper, or combinations thereof.

Aspect 195. The composite fiber of Aspect 194, wherein the second metal comprises silver.

Aspect 196. The composite fiber of Aspect 194, wherein the second metal comprises copper.

Aspect 197. The composite fiber of Aspect 194, wherein the second metal comprises a mixture of copper and silver.

Aspect 198. The composite fiber of Aspect 197, wherein the second metal alloy comprises silver, aluminum, copper, or combinations thereof.

Aspect 199. The composite fiber of Aspect 197, wherein in the second metal alloy comprises silver.

Aspect 200. The composite fiber of Aspect 197, wherein in the second metal alloy comprises copper.

Aspect 201. The composite fiber of Aspect 197, wherein in the second metal alloy comprises silver and copper.

Aspect 202. The composite fiber of Aspect 188, wherein the second metal oxide comprises gold (II) oxide, gold (Ill) oxide, silver (I) oxide, silver (II) oxide, silver (I, Ill) oxide, magnesium oxide, iron (II) oxide, iron (Ill) oxide, copper (I) oxide, copper (II) oxide, or combinations thereof.

Aspect 203. The composite fiber of Aspect 202, wherein the second metal oxide comprises silver (I) oxide, copper (I) oxide, copper (II) oxide, or combinations thereof.

Aspect 204. The composite fiber of Aspect 202, wherein the second metal oxide comprises silver (I) oxide.

Aspect 205. The composite fiber of Aspect 188, wherein the second mineral comprises dolomite, tourmaline, zircon, magnesia, magnesite, calcite, aragonite, zircon, limestone, allendeite, periclase, baddeleyite, eudialyte, loranskite, menezesite, rutile, ilmenite, titanite, anatase, brookite, is quartz, granite, chalcedony, chrysoprase, garnet, phenacite, olivine, mica, kaolinite, feldspar, zeolite, carnelian, agate, onyx, jasper, heliotrope, flint, calzirtite, kobeite, lakargiite, lindsleyite, loveringite, mathiasite, tazheranite, zircon, zirconolite, zirkelite, or combinations thereof.

Aspect 206. The composite fiber of Aspect 205, wherein the second mineral comprises dolomite, tourmaline, zircon, magnesia, magnesite, calcite, periclase, limestone, aragonite, quartz, or combinations thereof.

Aspect 207. The composite fiber of Aspect 188, wherein the second mineral comprises calcium, magnesium, silicon, zirconium, titanium, or combinations thereof.

Aspect 208. The composite fiber of Aspect 207, wherein the second mineral comprising calcium is calcite, aragonite, dolomite, tourmaline, or combinations thereof.

Aspect 209. The composite fiber of Aspect 207, wherein the second mineral comprising magnesium is magnesia, periclase, magnesite, dolomite, tourmaline, or combinations thereof.

Aspect 210. The composite fiber of Aspect 207, wherein the second mineral comprising silicon is quartz, granite, chalcedony, chrysoprase, garnet, phenacite, olivine, mica, kaolinite, feldspar, zeolite, carnelian, agate, onyx, jasper, heliotrope, flint, or combinations thereof.

Aspect 211. The composite fiber of Aspect 207, wherein the second mineral comprising titanium is rutile, ilmenite, titanite, anatase, brookite, or combinations thereof.

Aspect 212. The composite fiber of Aspect 207, wherein the second mineral comprising zirconium is zircon, allendeite, baddeleyite, eudialyte, loranskite, menezesite, or combinations thereof.

Aspect 213. The composite fiber of Aspect 207, wherein the second mineral comprises zirconium and titanium; and wherein the mineral is calzirtite, kobeite, lakargiite, lindsleyite, loveringite, mathiasite, tazheranite, zircon, zirconolite, zirkelite, or combinations thereof.

Aspect 214. The composite fiber of Aspect 188, wherein the second cooling salt is a Group I salt, a Group II salt, a transition metal salt, or combinations thereof.

Aspect 215. The composite fiber of Aspect 214, wherein the second cooling salt is a Group I salt.

Aspect 216. The composite fiber of Aspect 215, wherein the second cooling salt is a Group I salt comprising a cation of sodium, potassium or combinations thereof.

Aspect 217. The composite fiber of any one of Aspect 214-Aspect 216, wherein the second cooling salt comprises a Group I carbonate, a Group I halide, a Group I nitrate, a Group I sulfate, or combinations thereof.

Aspect 218. The composite fiber of Aspect 214, wherein the second cooling salt is a Group II salt.

Aspect 219. The composite fiber of Aspect 218, wherein the second cooling salt is a Group II salt comprising a cation of calcium, magnesium or combinations thereof.

Aspect 220. The composite fiber of any one of Aspect 214, Aspect 218, or Aspect 219, wherein the second cooling salt comprises a Group II carbonate, a Group II halide, a Group II nitrate, a Group II sulfate, or combinations thereof.

Aspect 221. The composite fiber of Aspect 214, wherein the second cooling salt is a transition metal salt.

Aspect 222. The composite fiber of Aspect 221, wherein the second cooling salt is a transition metal salt comprising a cation of silver, copper, titanium, iron, nickel, zinc, gold, or combinations thereof.

Aspect 223. The composite fiber of any one of Aspect 214, Aspect 221, or Aspect 222, wherein the second cooling salt comprises a transition metal carbonate, a transition metal halide, a transition metal nitrate, a transition metal sulfate, or combinations thereof.

Aspect 224. The composite fiber of any one of Aspect 214-Aspect 223, wherein the second cooling salt comprises a Group I sulfate, a Group II sulfate, transition metal sulfate, or combinations thereof.

Aspect 225. The composite fiber of Aspect 224, wherein the second cooling salt comprises sodium sulfate, potassium sulfate, calcium sulfate, magnesium sulfate, or combinations thereof.

Aspect 226. The composite fiber of any one of Aspect 214-Aspect 223, wherein the second cooling salt comprises a Group I halide, a Group II halide, transition metal halide, or combinations thereof.

Aspect 227. The composite fiber of Aspect 226, wherein the second cooling salt comprises iron (II) chloride, iron (III) chloride, sodium chloride, potassium chloride, calcium chloride, magnesium chloride, or combinations thereof.

Aspect 228. The composite fiber of Aspect 227, wherein the second cooling salt comprises potassium chloride.

Aspect 229. The composite fiber of any one of Aspect 214-Aspect 223, wherein the second cooling salt comprises a Group I carbonate, a Group II carbonate, transition metal carbonate, or combinations thereof.

Aspect 230. The composite fiber of Aspect 229, wherein the second cooling salt comprises calcium carbonate, magnesium carbonate, or combinations thereof.

Aspect 231. The composite fiber of any one of 1-Aspect 230, wherein the second cooling material is a powder, a wire, a filament, a sheet, a particle, or combinations thereof.

Aspect 232. The composite fiber of Aspect 231, wherein the second cooling composition comprises a particle, a powder, or combinations thereof.

Aspect 233. The composite fiber of Aspect 232, where the second cooling composition comprises a particle.

Aspect 234. The composite fiber of Aspect 233, wherein the second cooling composition comprises a nanoparticle, a microparticle, or combinations thereof.

Aspect 235. The composite fiber of Aspect 234, wherein the nanoparticle has a size of about 10 nm to about 100 nm.

Aspect 236. The composite fiber of Aspect 234, wherein the nanoparticle has a size of about 15 nm to about 50 nm.

Aspect 237. The composite fiber of Aspect 234, wherein the nanoparticle has a size of about 20 nm to about 40 nm.

Aspect 238. The composite fiber of Aspect 234, wherein the microparticle has a size of about 10 μm to about 200 μm.

Aspect 239. The composite fiber of Aspect 234, wherein the microparticle has a size of about 20 μm to about 100 μm.

Aspect 240. The composite fiber of Aspect 234, wherein the microparticle has a size of about 30 μm to about 90 μm.

Aspect 241. The composite fiber of Aspect 234, wherein the microparticle has a size of about 40 μm to about 80 μm.

Aspect 242. The composite fiber of Aspect 234, wherein the microparticle has a size of about 50 μm to about 70 μm.

Aspect 243. The composite fiber of any one of 1-Aspect 242, wherein the aluminum is present in the second cooling composition in an amount of about 0.01 wt % to about 5 wt %.

Aspect 244. The composite fiber of Aspect 243, wherein the aluminum is present in the second cooling composition in an amount of about 0.05 wt % to about 0.9 wt %.

Aspect 245. The composite fiber of Aspect 243, wherein the aluminum is present in the second cooling composition in an amount of about 0.05 wt % to about 0.8 wt %.

Aspect 246. The composite fiber of Aspect 243, wherein the aluminum is present in the second cooling composition in an amount of about 0.05 wt % to about 0.7 wt %.

Aspect 247. The composite fiber of Aspect 243, wherein the aluminum is present in the second cooling composition in an amount of about 0.10 wt % to about 1.0 wt %.

Aspect 248. The composite fiber of Aspect 243, wherein the aluminum is present in the second cooling composition in an amount of about 0.15 wt % to about 1.0 wt %.

Aspect 249. The composite fiber of Aspect 243, wherein the aluminum is present in the second cooling composition in an amount of about 0.20 wt % to about 1.0 wt %.

Aspect 250. The composite fiber of any one of 1-Aspect 249, wherein the calcium is present in the second cooling composition in an amount of about 0.01 wt % to about 5 wt %.

Aspect 251. The composite fiber of Aspect 250, wherein the calcium is present in the second cooling composition in an amount of about 0.05 wt % to about 1.0 wt %.

Aspect 252. The composite fiber of Aspect 250, wherein the calcium is present in the second cooling composition in an amount of about 0.05 wt % to about 0.9 wt %.

Aspect 253. The composite fiber of Aspect 250, wherein the calcium is present in the second cooling composition in an amount of about 0.05 wt % to about 0.8 wt %.

Aspect 254. The composite fiber of Aspect 250, wherein the calcium is present in the second cooling composition in an amount of about 0.05 wt % to about 0.7 wt %.

Aspect 255. The composite fiber of Aspect 250, wherein the calcium is present in the second cooling composition in an amount of about 0.1 wt % to about 4.0 wt %.

Aspect 256. The composite fiber of Aspect 250, wherein the calcium is present in the second cooling composition in an amount of about 0.1 wt % to about 3.0 wt %.

Aspect 257. The composite fiber of Aspect 250, wherein the calcium is present in the second cooling composition in an amount of about 0.1 wt % to about 2.0 wt %.

Aspect 258. The composite fiber of Aspect 250, wherein the calcium is present in the second cooling composition in an amount of about 1.0 wt % to about 5.0 wt %.

Aspect 259. The composite fiber of Aspect 250, wherein the calcium is present in the second cooling composition in an amount of about 1.0 wt % to about 4.0 wt %.

Aspect 260. The composite fiber of Aspect 250, wherein the calcium is present in the second cooling composition in an amount of about 1.0 wt % to about 3.0 wt %.

Aspect 261. The composite fiber of any one of 1-Aspect 260, wherein the copper is present in the second cooling composition in an amount of about 0.01 wt % to about 10 wt %.

Aspect 262. The composite fiber of Aspect 261, wherein the copper is present in the second cooling composition in an amount of about 0.05 wt % to about 1.0 wt %.

Aspect 263. The composite fiber of Aspect 261, wherein the copper is present in the second cooling composition in an amount of about 0.05 wt % to about 0.7 wt %.

Aspect 264. The composite fiber of Aspect 261, wherein the copper is present in the second cooling composition in an amount of about 0.05 wt % to about 0.5 wt %.

Aspect 265. The composite fiber of Aspect 261, wherein the copper is present in the second cooling composition in an amount of about 0.05 wt % to about 0.3 wt %.

Aspect 266. The composite fiber of Aspect 261, wherein the copper is present in the second cooling composition in an amount of about 1.0 wt % to about 9.0 wt %.

Aspect 267. The composite fiber of Aspect 261, wherein the copper is present in the second cooling composition in an amount of about 1.0 wt % to about 8.0 wt %.

Aspect 268. The composite fiber of Aspect 261, wherein the copper is present in the second cooling composition in an amount of about 1.0 wt % to about 7.0 wt %.

Aspect 269. The composite fiber of Aspect 261, wherein the copper is present in the second cooling composition in an amount of about 1.0 wt % to about 6.0 wt %.

Aspect 270. The composite fiber of Aspect 261, wherein the copper is present in the second cooling composition in an amount of about 0.5 wt % to about 5.0 wt %.

Aspect 271. The composite fiber of Aspect 261, wherein the copper is present in the second cooling composition in an amount of about 0.5 wt % to about 4.0 wt %.

Aspect 272. The composite fiber of Aspect 261, wherein the copper is present in the second cooling composition in an amount of about 0.5 wt % to about 3.0 wt %.

Aspect 273. The composite fiber of any one of 1-Aspect 272, wherein the iron is present in the second cooling composition in an amount of about 0.01 wt % to about 5 wt %.

Aspect 274. The composite fiber of Aspect 273, wherein the iron is present in the second cooling composition in an amount of about 0.05 wt % to about 1.0 wt %.

Aspect 275. The composite fiber of Aspect 273, wherein the iron is present in the second cooling composition in an amount of about 0.05 wt % to about 0.9 wt %.

Aspect 276. The composite fiber of Aspect 273, wherein the iron is present in the second cooling composition in an amount of about 0.05 wt % to about 0.8 wt %.

Aspect 277. The composite fiber of Aspect 273, wherein the iron is present in the second cooling composition in an amount of about 0.05 wt % to about 0.7 wt %.

Aspect 278. The composite fiber of Aspect 273, wherein the iron is present in the second cooling composition in an amount of about 0.05 wt % to about 0.6 wt %.

Aspect 279. The composite fiber of Aspect 273, wherein the iron is present in the second cooling composition in an amount of about 0.05 wt % to about 0.5 wt %.

Aspect 280. The composite fiber of Aspect 273, wherein the iron is present in the second cooling composition in an amount of about 0.1 wt % to about 5.0 wt %.

Aspect 281. The composite fiber of Aspect 273, wherein the iron is present in the second cooling composition in an amount of about 0.1 wt % to about 4.0 wt %.

Aspect 282. The composite fiber of Aspect 273, wherein the iron is present in the second cooling composition in an amount of about 0.1 wt % to about 3.0 wt %.

Aspect 283. The composite fiber of Aspect 273, wherein the iron is present in the second cooling composition in an amount of about 0.1 wt % to about 2.0 wt %.

Aspect 284. The composite fiber of any one of 1-Aspect 283, wherein the magnesium is present in the second cooling composition in an amount of about 0.01 wt % to about 15 wt %.

Aspect 285. The composite fiber of Aspect 284, wherein the magnesium is present in the second cooling composition in an amount of about 0.05 wt % to about 1.0 wt %.

Aspect 286. The composite fiber of Aspect 284, wherein the magnesium is present in the second cooling composition in an amount of about 0.05 wt % to about 0.7 wt %.

Aspect 287. The composite fiber of Aspect 284, wherein the magnesium is present in the second cooling composition in an amount of about 0.05 wt % to about 0.5 wt %.

Aspect 288. The composite fiber of Aspect 284, wherein the magnesium is present in the second cooling composition in an amount of about 0.05 wt % to about 0.3 wt %.

Aspect 289. The composite fiber of Aspect 284, wherein the magnesium is present in the second cooling composition in an amount of about 1.0 wt % to about 15.0 wt %.

Aspect 290. The composite fiber of Aspect 284, wherein the magnesium is present in the second cooling composition in an amount of about 1.0 wt % to about 14.0 wt %.

Aspect 291. The composite fiber of Aspect 284, wherein the magnesium is present in the second cooling composition in an amount of about 1.0 wt % to about 13.0 wt %.

Aspect 292. The composite fiber of Aspect 106, wherein the magnesium is present in the second cooling composition in an amount of about 1.0 wt % to about 12.0 wt %.

Aspect 293. The composite fiber of Aspect 106, wherein the magnesium is present in the second cooling composition in an amount of about 1.0 wt % to about 11.0 wt %.

Aspect 294. The composite fiber of Aspect 106, wherein the magnesium is present in the second cooling composition in an amount of about 1.0 wt % to about 10.0 wt %.

Aspect 295. The composite fiber of Aspect 106, wherein the magnesium is present in the second cooling composition in an amount of about 5.0 wt % to about 15.0 wt %.

Aspect 296. The composite fiber of any one of 1-Aspect 295, wherein the potassium is present in the second cooling composition in an amount of about 0.01 wt % to about 5 wt %.

Aspect 297. The composite fiber of Aspect 296, wherein the potassium is present in the second cooling composition in an amount of about 0.05 wt % to about 1.0 wt %.

Aspect 298. The composite fiber of Aspect 296, wherein the potassium is present in the second cooling composition in an amount of about 0.05 wt % to about 0.9 wt %.

Aspect 299. The composite fiber of Aspect 296, wherein the potassium is present in the second cooling composition in an amount of about 0.05 wt % to about 0.8 wt %.

Aspect 300. The composite fiber of Aspect 296, wherein the potassium is present in the second cooling composition in an amount of about 0.05 wt % to about 0.7 wt %.

Aspect 301. The composite fiber of Aspect 296, wherein the potassium is present in the second cooling composition in an amount of about 0.05 wt % to about 0.6 wt %.

Aspect 302. The composite fiber of Aspect 296, wherein the potassium is present in the second cooling composition in an amount of about 0.05 wt % to about 0.5 wt %.

Aspect 303. The composite fiber of Aspect 296, wherein the potassium is present in the second cooling composition in an amount of about 0.1 wt % to about 5.0 wt %.

Aspect 304. The composite fiber of Aspect 296, wherein the potassium is present in the second cooling composition in an amount of about 0.1 wt % to about 4.0 wt %.

Aspect 305. The composite fiber of Aspect 296, wherein the potassium is present in the second cooling composition in an amount of about 0.1 wt % to about 3.0 wt %.

Aspect 306. The composite fiber of Aspect 296, wherein the potassium is present in the second cooling composition in an amount of about 1.0 wt % to about 2.0 wt %.

Aspect 307. The composite fiber of Aspect 296, wherein the potassium is present in the second cooling composition in an amount of about 1.0 wt % to about 4.0 wt %.

Aspect 308. The composite fiber of Aspect 296, wherein the potassium is present in the second cooling composition in an amount of about 2.0 wt % to about 5.0 wt %.

Aspect 309. The composite fiber of any one of 1-Aspect 308, wherein the silver is present in the second cooling composition in an amount of about 0.01 wt % to about 10 wt %.

Aspect 310. The composite fiber of Aspect 309, wherein the silver is present in the second cooling composition in an amount of about 0.05 wt % to about 1.0 wt %.

Aspect 311. The composite fiber of Aspect 309, wherein the silver is present in the second cooling composition in an amount of about 0.05 wt % to about 0.7 wt %.

Aspect 312. The composite fiber of Aspect 309, wherein the silver is present in the second cooling composition in an amount of about 0.05 wt % to about 0.5 wt %.

Aspect 313. The composite fiber of Aspect 309, wherein the silver is present in the second cooling composition in an amount of about 0.05 wt % to about 0.3 wt %.

Aspect 314. The composite fiber of Aspect 309, wherein the silver is present in the second cooling composition in an amount of about 0.1 wt % to about 10.0 wt %.

Aspect 315. The composite fiber of Aspect 309, wherein the silver is present in the second cooling composition in an amount of about 0.1 wt % to about 9.0 wt %.

Aspect 316. The composite fiber of Aspect 309, wherein the silver is present in the second cooling composition in an amount of about 0.1 wt % wt % to about 8.0 wt %.

Aspect 317. The composite fiber of Aspect 309, wherein the silver is present in the second cooling composition in an amount of about 0.1 wt % to about 7.0 wt %.

Aspect 318. The composite fiber of Aspect 309, wherein the silver is present in the second cooling composition in an amount of about 0.1 wt % to about 6.0 wt %.

Aspect 319. The composite fiber of Aspect 309, wherein the silver is present in the second cooling composition in an amount of about 0.1 wt % to about 5.0 wt %.

Aspect 320. The composite fiber of Aspect 309, wherein the silver is present in the second cooling composition in an amount of about 1.0 wt % to about 5.0 wt %.

Aspect 321. The composite fiber of any one of 1-Aspect 320, wherein the sodium is present in the second cooling composition in an amount of about 0.01 wt % to about 5 wt %.

Aspect 322. The composite fiber of Aspect 321, wherein the sodium is present in the second cooling composition in an amount of about 0.05 wt % to about 1.0 wt %.

Aspect 323. The composite fiber of Aspect 321, wherein the sodium is present in the second cooling composition in an amount of about 0.05 wt % to about 0.9 wt %.

Aspect 324. The composite fiber of Aspect 321, wherein the sodium is present in the second cooling composition in an amount of about 0.05 wt % to about 0.8 wt %.

Aspect 325. The composite fiber of Aspect 321, wherein the sodium is present in the second cooling composition in an amount of about 0.05 wt % to about 0.7 wt %.

Aspect 326. The composite fiber of Aspect 321, wherein the sodium is present in the second cooling composition in an amount of about 0.05 wt % to about 0.6 wt %.

Aspect 327. The composite fiber of Aspect 321, wherein the sodium is present in the second cooling composition in an amount of about 0.05 wt % to about 0.5 wt %.

Aspect 328. The composite fiber of Aspect 321, wherein the sodium is present in the second cooling composition in an amount of about 0.1 wt % to about 5.0 wt %.

Aspect 329. The composite fiber of Aspect 321, wherein the sodium is present in the second cooling composition in an amount of about 0.1 wt % to about 4.0 wt %.

Aspect 330. The composite fiber of Aspect 321, wherein the sodium is present in the second cooling composition in an amount of about 0.1 wt % to about 3.0 wt %.

Aspect 331. The composite fiber of any one of 1-Aspect 330, wherein the titanium is present in the second cooling composition in an amount of about 0.01 wt % to about 5 wt %.

Aspect 332. The composite fiber of Aspect 331, wherein the titanium is present in the second cooling composition in an amount of about 0.05 wt % to about 1.0 wt %.

Aspect 333. The composite fiber of Aspect 331, wherein the titanium is present in the second cooling composition in an amount of about 0.05 wt % to about 0.9 wt %.

Aspect 334. The composite fiber of Aspect 331, wherein the titanium is present in the second cooling composition in an amount of about 0.05 wt % to about 0.8 wt %.

Aspect 335. The composite fiber of Aspect 331, wherein the titanium is present in the second cooling composition in an amount of about 0.05 wt % to about 0.7 wt %.

Aspect 336. The composite fiber of Aspect 331, wherein the titanium is present in the second cooling composition in an amount of about 0.05 wt % to about 0.6 wt %.

Aspect 337. The composite fiber of Aspect 331, wherein the titanium is present in the second cooling composition in an amount of about 0.05 wt % to about 0.5 wt %.

Aspect 338. The composite fiber of Aspect 331, wherein the titanium is present in the second cooling composition in an amount of about 0.05 wt % to about 0.4 wt %.

Aspect 339. The composite fiber of Aspect 331, wherein the titanium is present in the second cooling composition in an amount of about 0.05 wt % to about 0.3 wt %.

Aspect 340. The composite fiber of Aspect 331, wherein the titanium is present in the second cooling composition in an amount of about 0.05 wt % to about 0.2 wt %.

Aspect 341. The composite fiber of Aspect 331, wherein the titanium is present in the second cooling composition in an amount of about 0.1 wt % to about 5.0 wt %.

Aspect 342. The composite fiber of Aspect 331, wherein the titanium is present in the second cooling composition in an amount of about 0.1 wt % to about 4.0 wt %.

Aspect 343. The composite fiber of Aspect 331, wherein the titanium is present in the second cooling composition in an amount of about 0.1 wt % to about 3.0 wt %.

Aspect 344. The composite fiber of any one of 1-Aspect 343, wherein the zirconium is present in the second cooling composition in an amount of about 0.01 wt % to about 5 wt %.

Aspect 345. The composite fiber of Aspect 344, wherein the zirconium is present in the second cooling composition in an amount of about 0.05 wt % to about 1.0 wt %.

Aspect 346. The composite fiber of Aspect 344, wherein the zirconium is present in the second cooling composition in an amount of about 0.05 wt % to about 0.9 wt %.

Aspect 347. The composite fiber of Aspect 344, wherein the zirconium is present in the second cooling composition in an amount of about 0.05 wt % to about 0.8 wt %.

Aspect 348. The composite fiber of Aspect 344, wherein the zirconium is present in the second cooling composition in an amount of about 0.05 wt % to about 0.7 wt %.

Aspect 349. The composite fiber of Aspect 344, wherein the zirconium is present in the second cooling composition in an amount of about 0.05 wt % to about 0.6 wt %.

Aspect 350. The composite fiber of Aspect 344, wherein the zirconium is present in the second cooling composition in an amount of about 0.05 wt % to about 0.5 wt %.

Aspect 351. The composite fiber of Aspect 344, wherein the zirconium is present in the second cooling composition in an amount of about 0.1 wt % to about 5.0 wt %.

Aspect 352. The composite fiber of Aspect 344, wherein the zirconium is present in the second cooling composition in an amount of about 0.1 wt % to about 4.0 wt %.

Aspect 353. The composite fiber of Aspect 344, wherein the zirconium is present in the second cooling composition in an amount of about 0.1 wt % to about 3.0 wt %.

Aspect 354. The composite fiber of any one of Aspect 243-Aspect 353, wherein a wt % amount of aluminum, calcium, copper, iron, magnesium, potassium, silicon, silver, sodium, titanium, zirconium, or combinations thereof is the wt % amount of the element as determined by elemental analysis of the polyamide polymer and the second cooling composition.

Aspect 355. The composite fiber of Aspect 354, wherein the elemental analysis is carried out using field emission scanning electron microscopy with a segmented backscatter detector, a Everhart-Thornley electron detector, in-lens electron detectors, or combinations thereof.

Aspect 356. The composite fiber of Aspect 354, wherein the elemental analysis is carried out using field emission scanning electron microscopy with energy-dispersive spectroscopy.

Aspect 357. The composite fiber of any one of 1-Aspect 356, wherein the composite fiber has a side-by-side cross-section.

Aspect 358. The composite fiber of any one of 1-Aspect 356, wherein the composite fiber has an eccentric sheath-core cross-section.

Aspect 359. The composite fiber of any one of 1-Aspect 356, wherein the composite fiber has an islands-in-the-sea cross-section.

Aspect 360. The composite fiber of any one of 1-Aspect 356, wherein the composite fiber has a segmented pie cross-section.

Aspect 361. The composite fiber of any one of 1-Aspect 356, wherein the composite fiber has a concentric cross-section.

Aspect 362. The composite fiber of any one of 1-Aspect 361, wherein the composite fiber has a fiber weight of about 100 d/60f to about 200 d/75f.

Aspect 363. An article comprising the composite fiber of any one of 1-Aspect 362.

Aspect 364. The article of Aspect 363, wherein the article is an article of clothing.

Aspect 365. The article of Aspect 364, wherein the article of clothing is a pair of pants, a shirt, a jacket, a dress, an article of intimate apparel, or a skirt.

Aspect 366. The article of Aspect 363, wherein the article is an article of sportswear.

Aspect 367. The article of Aspect 363, wherein is the article is an article of drapery.

Aspect 368. The article of Aspect 363, wherein is the article is a floor covering.

Aspect 369. The article of Aspect 363, wherein is the article is a tote bag, a furniture cover, a tarpaulin, or a vehicle seat.

Aspect 370. A single-covered yarn comprising: (a) a core fiber comprising the composite fiber of any one of 1-Aspect 362; and (b) a first fiber comprising a cellulosic fiber; wherein the first yarn is wound around the core yarn to form a single-covered yarn.

Aspect 371. The single-covered yarn of Aspect 370, wherein the cellulosic fiber is a regenerated cellulosic fiber.

Aspect 372. The single-covered yarn of Aspect 371, wherein the regenerated cellulosic fiber is a viscose rayon, a high wet modulus rayon, a cuprammonium rayon, a saponified rayon, a modal rayon, a lyocell rayon, or combinations thereof.

Aspect 373. The single-covered yarn of Aspect 372, wherein the regenerated cellulosic fiber is a viscose rayon.

Aspect 374. The single-covered yarn of any one of Aspect 370-Aspect 373, wherein the first fiber has a weight of about 105 d/20f to about 130 d/40f.

Aspect 375. The single-covered yarn of Aspect 374, wherein the first fiber has a weight of about 115 d/25f to about 135 d/35f.

Aspect 376. The single-covered yarn of Aspect 374, wherein the first fiber has a weight of about 120 d/30f±10%.

Aspect 377. The single-covered yarn of Aspect 374, wherein the first fiber has a weight of about 120 d/30f±5%.

Aspect 378. The single-covered yarn of Aspect 374, wherein first fiber has a weight of about 120 d/30f±3%.

Aspect 379. The single-covered yarn of any one of Aspect 370-Aspect 378, wherein the single-covered yarn has a weight of about 250 denier to about 350 denier.

Aspect 380. The single-covered yarn of Aspect 379, wherein the single-covered yarn has a weight of about 270 denier to about 330 denier.

Aspect 381. The single-covered yarn of Aspect 379, wherein the single-covered yarn has a weight of about 280 denier to about 320 denier.

Aspect 382. The single-covered yarn of Aspect 379, wherein the single-covered yarn has a weight of about 285 denier to about 310 denier.

Aspect 383. The single-covered yarn of Aspect 379, wherein the single-covered yarn has a weight of about 290 denier±10%.

Aspect 384. The single-covered yarn of Aspect 379, wherein the single-covered yarn has a weight of about 290 denier±5%.

Aspect 385. The single-covered yarn of Aspect 379, wherein the single-covered yarn has a weight of about 290 denier±3%.

Aspect 386. The single-covered yarn of any one of Aspect 370-Aspect 385, wherein the single-covered yarn has a weight of about 250 denier to about 360 denier.

Aspect 387. The single-covered yarn of Aspect 386, wherein the single-covered yarn has a weight of about 270 denier to about 360 denier.

Aspect 388. The single-covered yarn of Aspect 386, wherein the single-covered yarn has a weight of about 280 denier to about 360 denier.

Aspect 389. The single-covered yarn of Aspect 386, wherein the single-covered yarn has a weight of about 285 denier to about 360 denier.

Aspect 390. The single-covered yarn of Aspect 386, wherein the single-covered yarn has a weight of about 350 denier±10%.

Aspect 391. The single-covered yarn of Aspect 386, wherein the single-covered yarn has a weight of about 350 denier±5%.

Aspect 392. The single-covered yarn of Aspect 386, wherein the single-covered yarn has a weight of about 350 denier±3%.

Aspect 393. An article comprising the single-covered yarn of any one of Aspect 370-Aspect 392.

Aspect 394. The article of Aspect 393, wherein the article is an article of clothing.

Aspect 395. The article of Aspect 394, wherein the article of clothing is a pair of pants, a shirt, a jacket, a dress, an article of intimate apparel, or a skirt.

Aspect 396. The article of Aspect 393, wherein the article is an article of sportswear.

Aspect 397. The article of Aspect 393, wherein is the article is an article of drapery.

Aspect 398. The article of Aspect 393, wherein is the article is a floor covering.

Aspect 399. The article of Aspect 393, wherein is the article is a tote bag, a furniture cover, a tarpaulin, or a vehicle seat.

Aspect 400. A double-covered yarn comprising: (a) an elastic core comprising an elastic yarn;

(b) a first fiber comprising the composite fiber of any one of 1-Aspect 362; and (c) a second fiber comprising a cellulosic fiber; wherein the first fiber is wound around the elastic core to form a single-covered yarn; and wherein the second fiber is wound around the single-covered yarn to form a double-covered yarn.

Aspect 401. The double-covered yarn of Aspect 400, wherein the elastic core comprises a spandex yarn, a polyester yarn, or combinations thereof.

Aspect 402. The double-covered yarn of Aspect 401, wherein the polyester yarn is a yarn comprising polyethylene terephthalate, a polytrimethylene terephthalate, or combinations thereof.

Aspect 403. The double-covered yarn of Aspect 402, wherein the polyester yarn comprises a composite filament of polyethylene terephthalate and polytrimethylene terephthalate; and wherein the filament has the polyethylene terephthalate and polytrimethylene terephthalate arranged side-by-side.

Aspect 404. The double-covered yarn of Aspect 400-Aspect 403, wherein the elastic core comprises a spandex yarn and a polyester yarn comprising polyethylene terephthalate, a polytrimethylene terephthalate, or combinations thereof.

Aspect 405. The double-covered yarn of Aspect 400-Aspect 404, wherein the elastic yarn has a weight of about 30 denier to about 50 denier.

Aspect 406. The double-covered yarn of Aspect 405, wherein the elastic yarn has a weight of about 35 denier to about 45 denier.

Aspect 407. The double-covered yarn of Aspect 405, wherein the elastic yarn has a weight of about 36 denier to about 44 denier.

Aspect 408. The double-covered yarn of Aspect 405, wherein the elastic yarn has a weight of about 37 denier to about 43 denier.

Aspect 409. The double-covered yarn of Aspect 405, wherein the elastic yarn has a weight of about 38 denier to about 42 denier.

Aspect 410. The double-covered yarn of Aspect 405, wherein the elastic yarn has a weight of about 39 denier to about 41 denier.

Aspect 411. The double-covered yarn of any one of Aspect 400-Aspect 410, wherein the stretch rate is about 2.5 to about 5.

Aspect 412. The double-covered yarn of Aspect 411, wherein the stretch rate is about 3 to about 4.

Aspect 413. The double-covered yarn of Aspect 411, wherein the stretch rate is about 3.2 to about 3.8.

Aspect 414. The double-covered yarn of any one of Aspect 400-Aspect 413, wherein the cellulosic fiber is a regenerated cellulosic fiber.

Aspect 415. The double-covered yarn of Aspect 414, wherein the regenerated cellulosic fiber is a viscose rayon, a high wet modulus rayon, a cuprammonium rayon, a saponified rayon, a modal rayon, a lyocell rayon, or combinations thereof.

Aspect 416. The double-covered yarn of Aspect 414, wherein the regenerated cellulosic fiber is a viscose rayon.

Aspect 417. The double-covered yarn of any one of Aspect 400-Aspect 416, wherein the second yarn has a weight of about 105 d/20f to about 130 d/40f.

Aspect 418. The double-covered yarn of Aspect 417, wherein the second yarn has a weight of about 115 d/25f to about 135 d/35f.

Aspect 419. The double-covered yarn of Aspect 417, wherein the second yarn has a weight of about 120 d/30f±10%.

Aspect 420. The double-covered yarn of Aspect 417, wherein the second yarn has a weight of about 120 d/30f±5%.

Aspect 421. The double-covered yarn of Aspect 417, wherein the second yarn has a weight of about 120 d/30f±3%.

Aspect 422. The double-covered yarn of any one of Aspect 400-Aspect 421, wherein the double-covered yarn has a weight of about 250 denier to about 350 denier.

Aspect 423. The double-covered yarn of Aspect 422, wherein the double-covered yarn has a weight of about 270 denier to about 330 denier.

Aspect 424. The double-covered yarn of Aspect 422, wherein the double-covered yarn has a weight of about 280 denier to about 320 denier.

Aspect 425. The double-covered yarn of Aspect 422, wherein the double-covered yarn has a weight of about 285 denier to about 310 denier.

Aspect 426. The double-covered yarn of Aspect 422, wherein the double-covered yarn has a weight of about 290 denier±10%.

Aspect 427. The double-covered yarn of Aspect 422, wherein the double-covered yarn has a weight of about 290 denier±5%.

Aspect 428. The double-covered yarn of Aspect 422, wherein the double-covered yarn has a weight of about 290 denier±3%.

Aspect 429. The double-covered yarn of any one of Aspect 400-Aspect 428, wherein the double-covered yarn has a weight of about 250 denier to about 360 denier.

Aspect 430. The double-covered yarn of Aspect 429, wherein the double-covered yarn has a weight of about 270 denier to about 360 denier.

Aspect 431. The double-covered yarn of Aspect 429, wherein the double-covered yarn has a weight of about 280 denier to about 360 denier.

Aspect 432. The double-covered yarn of Aspect 429, wherein the double-covered yarn has a weight of about 285 denier to about 360 denier.

Aspect 433. The double-covered yarn of Aspect 429, wherein the double-covered yarn has a weight of about 350 denier±10%.

Aspect 434. The double-covered yarn of Aspect 429, wherein the double-covered yarn has a weight of about 350 denier±5%.

Aspect 435. The double-covered yarn of Aspect 429, wherein the double-covered yarn has a weight of about 350 denier±3%.

Aspect 436. An article comprising the double-covered yarn of any one of Aspect 400-Aspect 435.

Aspect 437. The article of Aspect 436, wherein the article is an article of clothing.

Aspect 438. The article of Aspect 437, wherein the article of clothing is a pair of pants, a shirt, a jacket, a dress, an article of intimate apparel, or a skirt.

Aspect 439. The article of Aspect 436, wherein the article is an article of sportswear.

Aspect 440. The article of Aspect 436, wherein is the article is an article of drapery.

Aspect 441. The article of Aspect 436, wherein is the article is a floor covering.

Aspect 442. The article of Aspect 436, wherein is the article is a tote bag, a furniture cover, a tarpaulin, or a vehicle seat.

Aspect 443. A fabric comprising: a weft yarn comprising the single-covered yarn of any one of Aspect 370-Aspect 392 or the double-covered yarn of any one of Aspect 400-Aspect 442; and a warp yarn comprising cotton fibers.

Aspect 444. The fabric of Aspect 443, wherein the warp yarn is a cotton yarn having a weight of about 8's to about 50's.

Aspect 445. The fabric of Aspect 443 or Aspect 444, wherein the fabric is a warp-faced fabric.

Aspect 446. The fabric of any one of Aspect 443-Aspect 445, wherein the fabric is a left-handed twill weave; and wherein the left-handed twill weave has diagonals run from the right to the left of the fabric.

Aspect 447. The fabric of any one of Aspect 443-Aspect 445, wherein the fabric is a right-handed twill weave; and wherein the-handed twill weave has diagonals run from the left to the right of the fabric.

Aspect 448. The fabric of any one of Aspect 443-Aspect 447, wherein the weave pattern is a 3 by 1 weave; and wherein 3 warp yarns are woven over and under a weft yarn.

Aspect 449. The fabric of any one of Aspect 443-Aspect 448, wherein the fabric comprises about 50 wt % to about 80 wt % cotton fibers; about 1 wt % to about 15 wt % of a polyester polymer; about 1 wt % to about 10 wt % of a polyamide polymer; and about 0.1 wt % to about 5 wt % of an elastic fiber or elastic filament.

Aspect 450. The fabric of Aspect 449, wherein the fabric comprises about 55 wt % to about 75 wt % cotton fibers; about 8 wt % to about 12 wt % of a polyester polymer; about 4 wt % to about 8 wt % of a polyamide polymer; and about 1 wt % to about 4 wt % of an elastic fiber or elastic filament.

Aspect 451. The fabric of Aspect 449, wherein the fabric comprises about 60 wt % to about 75 wt % cotton fibers; about 8 wt % to about 10 wt % of a polyester polymer; about 4 wt % to about 7 wt % of a polyamide polymer; and about 2 wt % to about 4 wt % of an elastic fiber or elastic filament.

Aspect 452. The fabric of Aspect 449, wherein the fabric comprises about 55 wt % to about 70 wt % cotton fibers; about 8 wt % to about 12 wt % of a polyester polymer; about 4 wt % to about 8 wt % of a polyamide polymer; and about 1 wt % to about 4 wt % of an elastic fiber or elastic filament.

Aspect 453. The fabric of Aspect 449, wherein the fabric comprises about 60 wt % to about 70 wt % cotton fibers; about 8 wt % to about 10 wt % of a polyester polymer; about 4 wt % to about 7 wt % of a polyamide polymer; and about 2 wt % to about 4 wt % of an elastic fiber or elastic filament.

Aspect 454. The fabric of any one of Aspect 443-Aspect 453, wherein the fabric has a weight of about 4 oz/sy to about 12 oz/sy.

Aspect 455. The fabric of Aspect 454, wherein the fabric has a weight of about 5 oz/sy to about 10 oz/sy.

Aspect 456. The fabric of Aspect 454, wherein the fabric has a weight of about 6 oz/sy to about 10 oz/sy.

Aspect 457. The fabric of Aspect 454, wherein the fabric has a weight of about 9.5 oz/sy to about 10.5 oz/sy.

Aspect 458. The fabric of Aspect 454, wherein the fabric has a weight of about 10 oz/sy±10%.

Aspect 459. The fabric of Aspect 454, wherein the fabric has a weight of about 10 oz/sy±5%.

Aspect 460. The fabric of Aspect 454, wherein the fabric has a weight of about 10 oz/sy±3%.

Aspect 461. The fabric of Aspect 454, wherein the fabric has a weight of about 4 oz/sy to about 10 oz/sy.

Aspect 462. The fabric of Aspect 454, wherein the fabric has a weight of about 5 oz/sy to about 8 oz/sy.

Aspect 463. The fabric of Aspect 454, wherein the fabric has a weight of about 5 oz/sy to about 7 oz/sy.

Aspect 464. The fabric of Aspect 454, wherein the fabric has a weight of about 5.5 oz/sy to about 6.5 oz/sy.

Aspect 465. The fabric of Aspect 454, wherein the fabric has a weight of about 6.25 oz/sy±10%.

Aspect 466. The fabric of Aspect 454, wherein the fabric has a weight of about 6.25 oz/sy±5%.

Aspect 467. The fabric of Aspect 454, wherein the fabric has a weight of about 6.25 oz/sy±3%.

Aspect 468. The fabric of any one of Aspect 443-Aspect 467, wherein the fabric has a Qmax value of about 0.15 to about 0.50 when determined in accordance with FTTS-FA-019 as specified by Committee of Conformity Assessment of Accreditation and Certification on Functional and Technical Textiles (Taiwan).

Aspect 469. The fabric of Aspect 468, wherein the fabric has a Qmax value of about 0.16 to about 0.25.

Aspect 470. The fabric of Aspect 468, wherein the fabric has a Qmax value of about 0.16±10%.

Aspect 471. The fabric of Aspect 468, wherein the fabric has a Qmax value of about 0.16±5%.

Aspect 472. The fabric of Aspect 468, wherein the fabric has a Qmax value of about 0.16±3%.

Aspect 473. The fabric of Aspect 468, wherein the fabric has a Qmax value of about 0.17 to about 0.25.

Aspect 474. The fabric of Aspect 468, wherein the fabric has a Qmax value of about 0.20±10%.

Aspect 475. The fabric of Aspect 468, wherein the fabric has a Qmax value of about 0.20±5%.

Aspect 476. The fabric of Aspect 468, wherein the fabric has a Qmax value of about 0.20±3%.

Aspect 477. The fabric of any one of Aspect 443-Aspect 476, wherein the fabric has a Qmax value that is about 20% greater than the Qmax value for a reference denim fabric; wherein the reference denim fabric consists essentially of cotton yarn, having a fabric weight that is ±10% of the fabric, and the same weave pattern as the fabric; and wherein Qmax is determined in accordance with FTTS-FA-019 as specified by Committee of Conformity Assessment of Accreditation and Certification on Functional and Technical Textiles (Taiwan).

Aspect 478. The fabric of Aspect 477, wherein the fabric has a Qmax value that is about 25% greater than the Qmax value for a reference denim fabric.

Aspect 479. The fabric of Aspect 477, wherein the fabric has a Qmax value that is about 30% greater than the Qmax value for a reference denim fabric.

Aspect 480. The fabric of any one of Aspect 443-Aspect 479, wherein the fabric has a wicking time of less than about 5 minutes for water to rise 20 mm in length when determined in accordance with AATCC Test Method 197.

Aspect 481. The fabric of Aspect 480, wherein the fabric has a wicking time of about 2 minutes for the water to rise 20 mm in length.

Aspect 482. The fabric of Aspect 480, wherein the fabric has a wicking time of about 5 minutes for the water to rise 20 mm in length.

Aspect 483. The fabric of Aspect 480, wherein the fabric has a wicking time of about 1 minutes for the water to rise 20 mm in length.

Aspect 484. The fabric of any one of Aspect 443-Aspect 483, wherein the fabric has a drying time that is at least about 10% faster than the drying time for a reference denim fabric when determined in accordance with AATCC Test Method 201; and wherein the reference denim fabric consists essentially of cotton yarn, having a fabric weight that is ±10% of the fabric, and the same weave pattern as the fabric.

Aspect 485. The fabric of Aspect 484, wherein the fabric has a drying time that is at least about 20% faster than the drying time for the reference denim fabric.

Aspect 486. The fabric of Aspect 484, wherein the fabric has a drying time that is at least about 25% faster than the drying time for the reference denim fabric.

Aspect 487. The fabric of Aspect 484, wherein the fabric has a drying time that is at least about 30% faster than the drying time for the reference denim fabric.

Aspect 488. The fabric of Aspect 484, wherein the fabric has a drying time that is at least about 40% faster than the drying time for the reference denim fabric.

Aspect 489. The fabric of Aspect 484, wherein the fabric has a drying time that is at least about 50% faster than the drying time for the reference denim fabric.

Aspect 490. The fabric of any one of Aspect 443-Aspect 489, wherein the fabric has a drying rate of less than about 2.5 ml/hr when determined in accordance with AATCC Test Method 201.

Aspect 491. The fabric of Aspect 490, wherein the fabric has a drying rate of about 0.5 ml/hr to about 1.5 ml/hr.

Aspect 492. The fabric of Aspect 490, wherein the fabric has a drying rate of about 0.5 ml/hr to about 1.0 ml/hr.

Aspect 493. The fabric of Aspect 490, wherein the fabric has a drying rate of about 0.7 ml/hr to about 1.0 ml/hr.

Aspect 494. The fabric of Aspect 490, wherein the fabric has a drying rate of about 0.5 ml/hr to about 0.7 ml/hr.

Aspect 495. The fabric of any one of Aspect 443-Aspect 494, wherein the fabric is a 3/1 twill.

Aspect 496. The fabric of any one of Aspect 443-Aspect 495, wherein the fabric has a weight of about 5 oz/yd$^2$ to about 15 oz/yd$^2$.

Aspect 497. The fabric of Aspect 496, wherein the fabric has a weight of about 5 oz/yd$^2$ to about 10 oz/yd$^2$.

Aspect 498. The fabric of Aspect 496, wherein the fabric has a weight of about 5 oz/yd$^2$ to about 7 oz/yd$^2$.

Aspect 499. The fabric of any one of Aspect 443-Aspect 498, wherein the fabric has warp x weft count of about 100×100 to about 150×150.

Aspect 500. The fabric of Aspect 499, wherein the fabric has warp x weft count of about 110×110 to about 130×130.

Aspect 501. The fabric of Aspect 499, wherein the fabric has warp x weft count of about 115×115 to about 130×130.

Aspect 502. The fabric of Aspect 499, wherein the fabric has warp x weft count of about 120×120 to about 130×130.

Aspect 503. An article comprising the fabric of any one of Aspect 443-Aspect 502.

Aspect 504. The article of Aspect 503, wherein the article is an article of clothing.

Aspect 505. The article of Aspect 504, wherein the article of clothing is a pair of pants, a shirt, a jacket, a dress, an article of intimate apparel, or a skirt.

Aspect 506. The article of Aspect 503, wherein the article is an article of sportswear.

Aspect 507. The article of Aspect 503, wherein is the article is an article of drapery.

Aspect 508. The article of Aspect 503, wherein is the article is a floor covering.

Aspect 509. The article of Aspect 503, wherein is the article is a tote bag, a furniture cover, a tarpaulin, or a vehicle seat.

From the foregoing, it will be seen that aspects herein are well adapted to attain all the ends and objects hereinabove set forth together with other advantages which are obvious and which are inherent to the structure.

While specific elements and steps are discussed in connection to one another, it is understood that any element and/or steps provided herein is contemplated as being combinable with any other elements and/or steps regardless of explicit provision of the same while still being within the scope provided herein.

It will be understood that certain features and subcombinations are of utility and may be employed without reference to other features and subcombinations. This is contemplated by and is within the scope of the claims.

Since many possible aspects may be made without departing from the scope thereof, it is to be understood that all matter herein set forth or shown in the accompanying drawings and detailed description is to be interpreted as illustrative and not in a limiting sense.

It is also to be understood that the terminology used herein is for the purpose of describing particular aspects only, and is not intended to be limiting. The skilled artisan will recognize many variants and adaptations of the aspects described herein. These variants and adaptations are intended to be included in the teachings of this disclosure and to be encompassed by the claims herein.

Now having described the aspects of the present disclosure, in general, the following Examples describe some additional aspects of the present disclosure. While aspects of the present disclosure are described in connection with the following examples and the corresponding text and figures, there is no intent to limit aspects of the present disclosure to this description. On the contrary, the intent is to cover all alternatives, modifications, and equivalents included within the spirit and scope of the present disclosure.

I. EXAMPLES

The following examples are put forth so as to provide those of ordinary skill in the art with a complete disclosure and description of how the compounds, compositions, articles, devices and/or methods claimed herein are made and evaluated, and are intended to be purely exemplary of the disclosure and are not intended to limit the scope of what the inventors regard as their disclosure. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

Example 1

Exemplary Disclosed Fabric. A representative disclosed fabric sample was prepared with the following characteristics: 48"×6.25 oz/sy; aggregate fiber content of 67% Cotton 15% Rayon, 9% Polyester, 6% Nylon, 3% Spandex; warp faced fabric with a 3/1 twill weave pattern. The fabric had a warp yarn comprised cotton fibers; and the weft yarn comprised a disclosed double-covered yarn. The yarn count for warp yarn was 62.0 Tex (9.5's/1) and weft yarn is 40.0 Tex (360.0 Denier). The double-covered yarn in the weft yarn comprised a composite fiber comprising a core component and sheath layer that comprised: (a) core component of polyester yarn comprising titanium oxide (0.034-0.05% by weight based on the total weight of the core component; particle size 50-70 μm), silver oxide (0.5-0.912% by weight based on the total weight of the core component; particle size: 20-35.5 nm), and calcium carbonate (0.002-0.01% by weight based on the total weight of the core component; particle size 35-500 μm); and (b) sheath layer of nylon yarn comprising titanium oxide (6.7-10.0% by weight based on the total weight of the sheath layer; particle size 50-70 μm), silver oxide (5-7.0% by weight based on the total weight of the sheath layer; particle size 20-35.5 nm), and calcium carbonate (0.59-2.0% by weight based on the total weight of the sheath layer; particle size 35-500 μm).

The foregoing cooling composition amounts are those as determined in the sheath layer and core component by elemental analysis and quantitative compositional analysis performed using field emission scanning electron microscope (FESEM) carried out with a FEI Teneo scanning electron microscope (FEI, Inc., Hillsboro, Oreg., US) equipped with an extremely large area detector for energy-dispersive spectroscopy (INCA Energy detector; Oxford Instruments, Concord, Mass., US). Elemental analysis capability was provided using the OXFORD XMAX software (Oxford Instruments). The area of analysis was chosen under "Scan Image" option. The raw elemental analysis was carried out under the "Acquire spectra" option and the final average analysis was presented under the "Fitted spectra tool."

Standard Denim Fabric. A comparator denim sample representative of a commonly available standard denim fabric was prepared with the following characteristics: 52"× 6.5 oz/sy; aggregate fiber content was 100% cotton; warp faced fabric with a 3/1 twill weave pattern.

The representative disclosed fabric sample and comparator denim sample were subjected to tests to determine the following: (a) Qmax was determined in accordance with FTTS-FA-019 as specified by Committee of Conformity Assessment of Accreditation and Certification on Functional and Technical Textiles (Taiwan); (b) drying time and rates were determined in accordance with AATCC 200 ("Drying Rate of Textiles at their Absorbent Capacity: Air Flow Method") and AATCC 201 ("Drying Rate of Fabrics: Heated Plate Method"); and (c) UPF dry and wet evaluation were determined in accordance with AATCC 183 ("Transmittance or Blocking of Erythemally Weighted Ultraviolet Radiation through Fabrics"). The data obtained in these tests are given below in Table 1. All tests were conducted by Intertek Testing Services Taiwan Ltd. (8F, No. 423, Ruiguang Rd., Neihu District, Taipei 11492, Taiwan (R.O.C.).

TABLE 1

| Test Sample | Q max | DRY TIME (secs) | DRY RATE (ml/hr) | UV dry | UV wet |
|---|---|---|---|---|---|
| Representative disclosed fabric sample | 0.201 | 11.9 | 0.65 | 2490 | 4093 |
| Comparator denim sample | 0.15 | >60 | N/A* | 592 | 798 |

*Not applicable per AATCC 200 standards, i.e., fabric took greater than 30 seconds for absorbency.

The data in Table 1 show that a representative disclosed fabric, i.e., a disclosed denim fabric, has surprisingly superior thermal characteristics as exhibited in the 34% enhanced Qmax value; and markedly improved drying and UPF characteristics. For example, the representative disclosed fabric is 500% faster in moisture wicking compared to a standard denim sample (cf. a dry time of 11.9 seconds for the representative disclosed fabric versus over 60 seconds for a standard denim sample), and much improved drying rates (cf. a drying rate of 0.65 ml/hr for the representative disclosed fabric versus a non-measurable drying rate for a standard denim sample under the conditions of the test, i.e., the standard denim sample showed absorbency greater than 30 seconds, so a determination of ml/hour could not be made). Moreover, with regard to UPF properties, the representative disclosed fabric show a 320% improvement in the dry evaluation and a 413% improvement in the wet evaluation. The foregoing improvements were attainable while using a 100% cotton yarn in the warp weave, but incorporating a disclosed double-covered yarn in the weft weave.

Figure 2A:
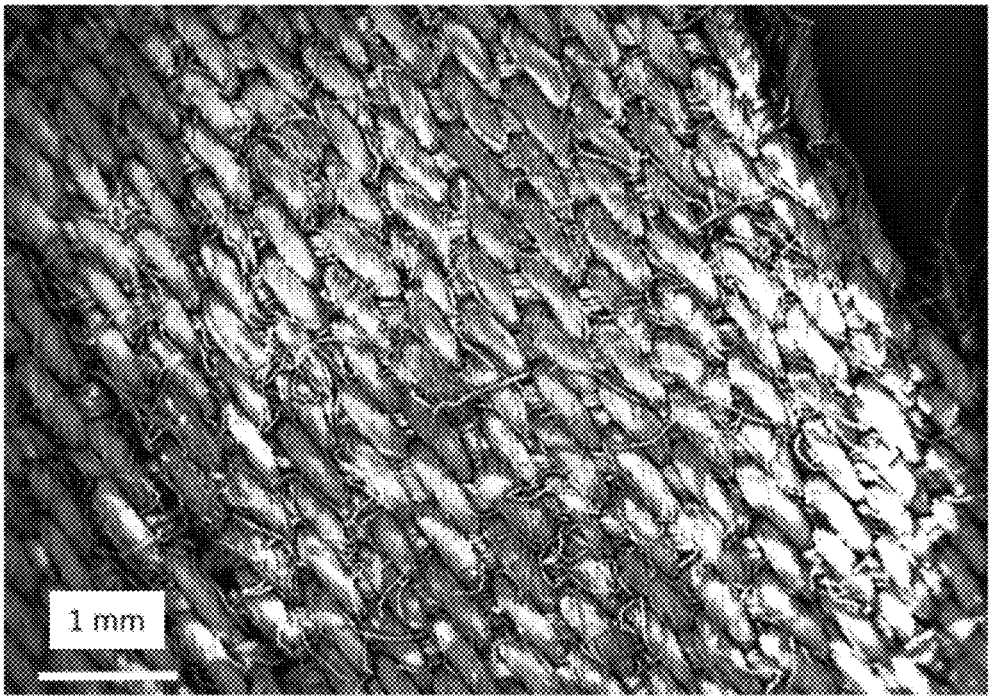
FIGS. 2A-2B show representative scanning electron micrograph (SEM) images of a disclosed fabric comprising a twill weave comprising a weft yarn comprising a disclosed double-covered yarn; and a warp yarn comprising a cotton yarn.
Figure 2B:
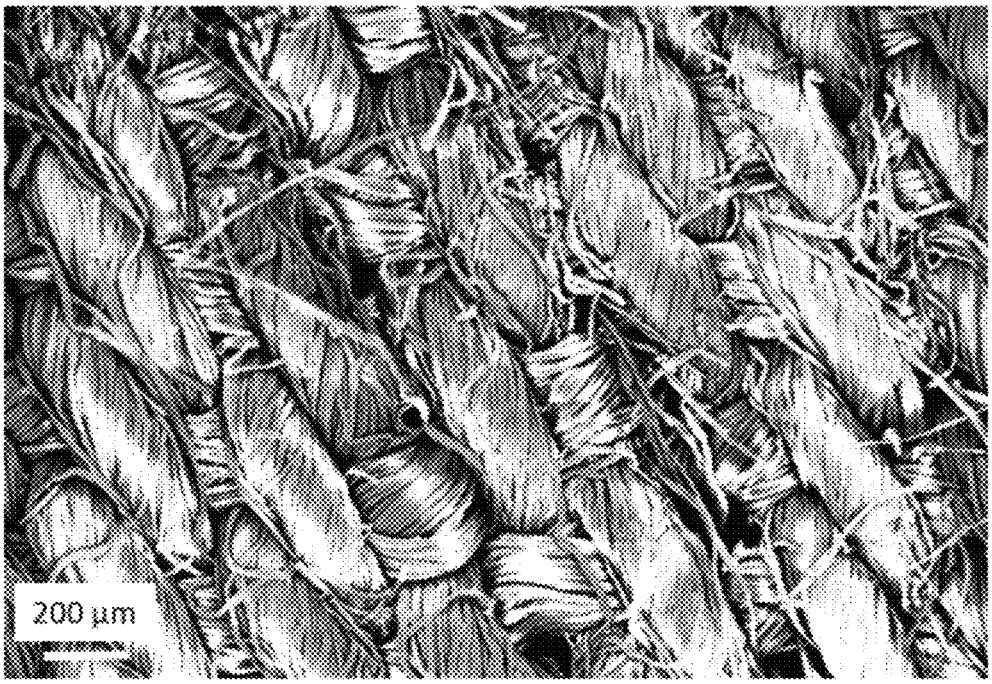
Figure 3A:
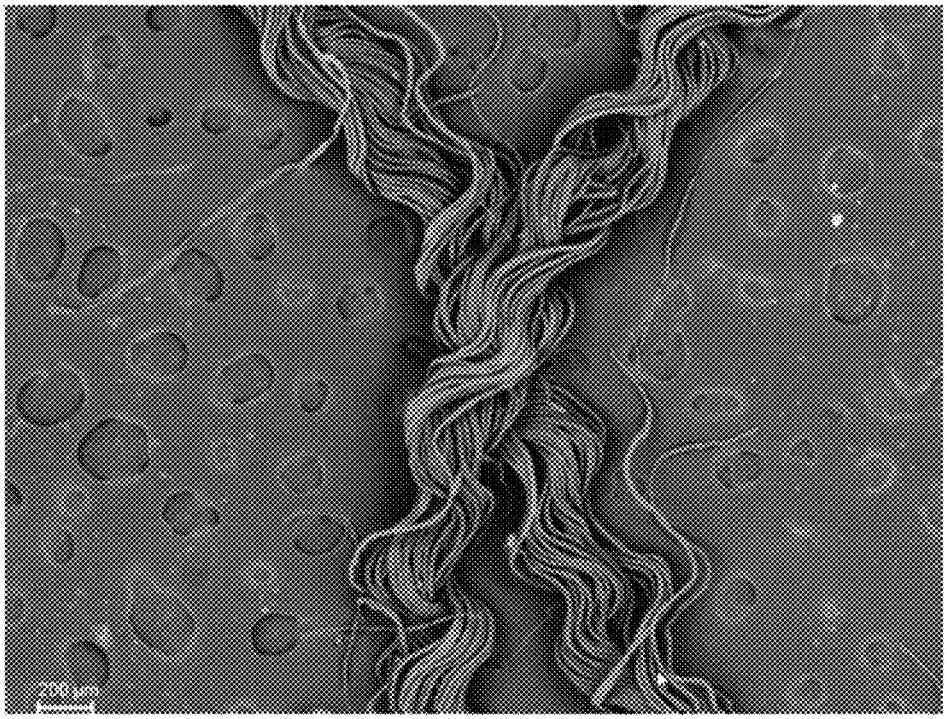
FIGS. 3A-3B show representative scanning electron micrograph (SEM) images of a disclosed warp yarn comprising a disclosed cotton yarn.
Figure 3B:
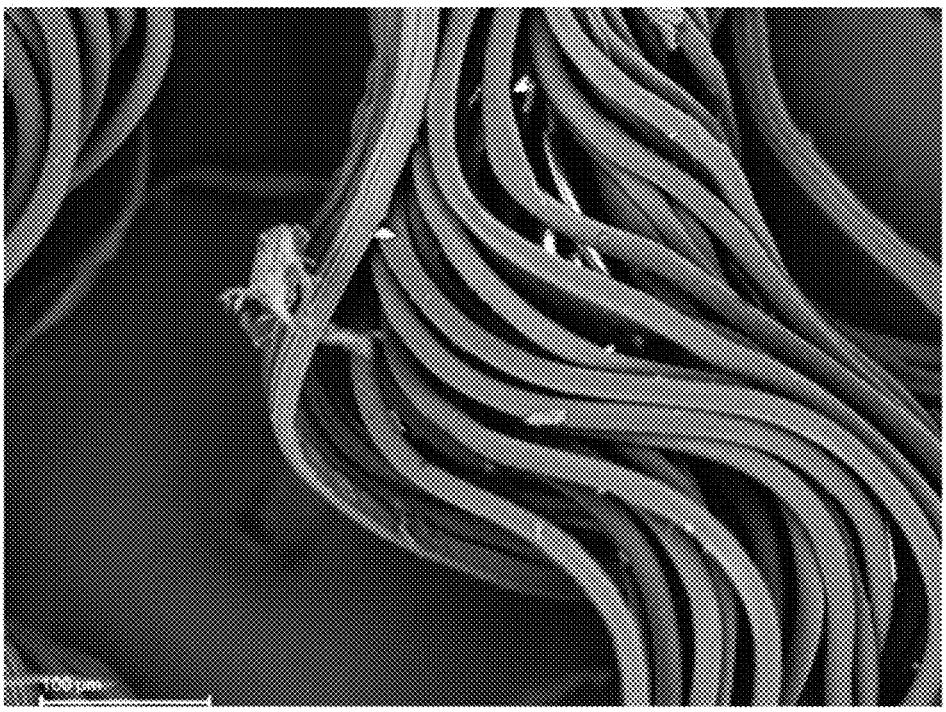
Figure 4A:
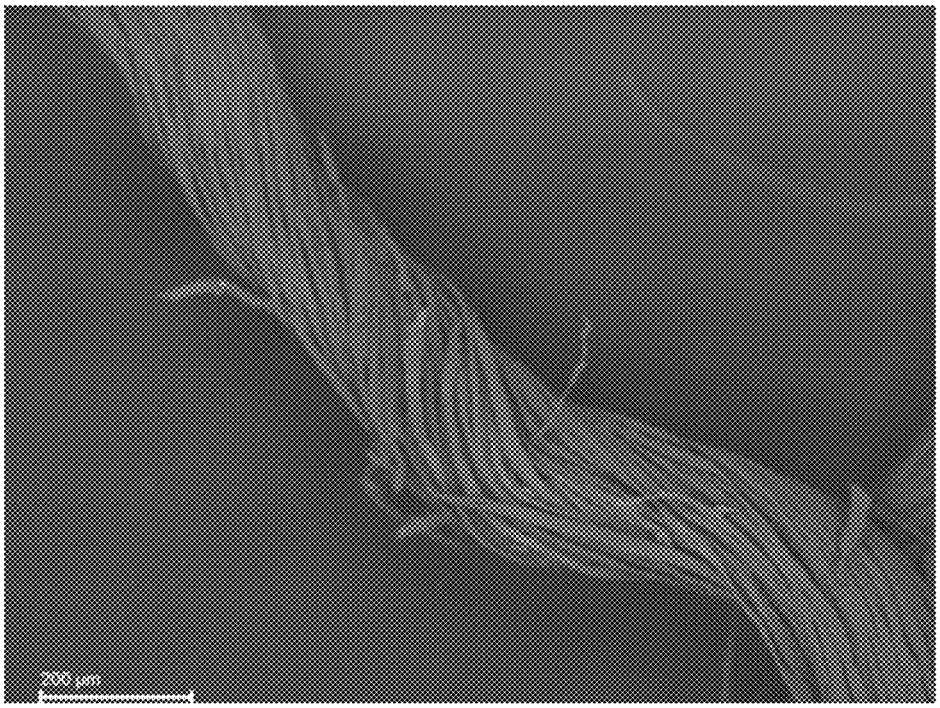
FIGS. 4A-4C show representative scanning electron micrograph (SEM) images of a disclosed weft yarn comprising a disclosed double-covered yarn.
Figure 4B:
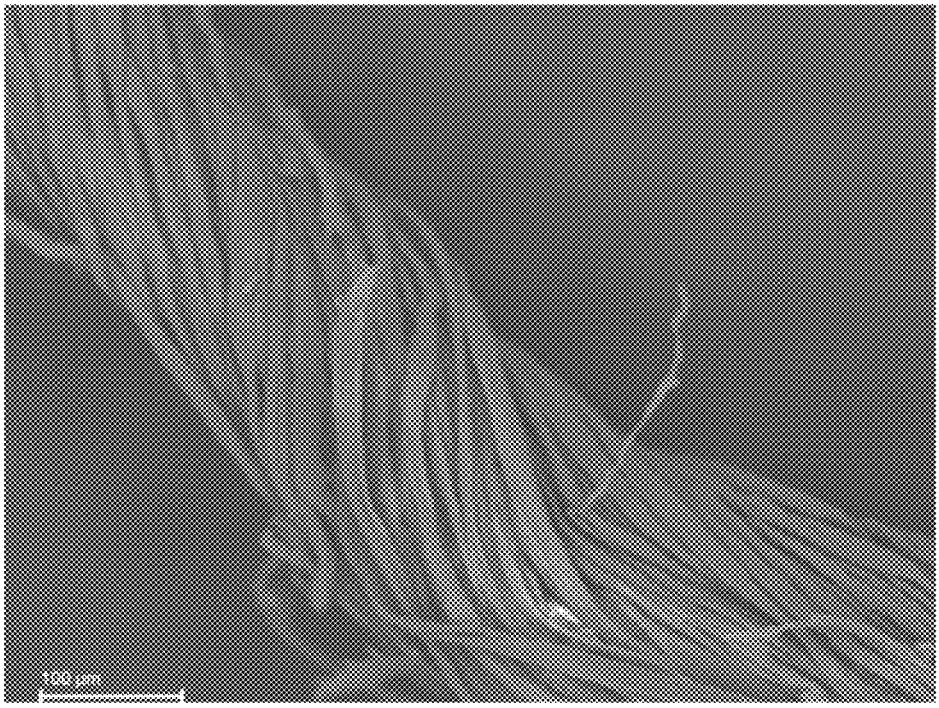
Figure 4C:
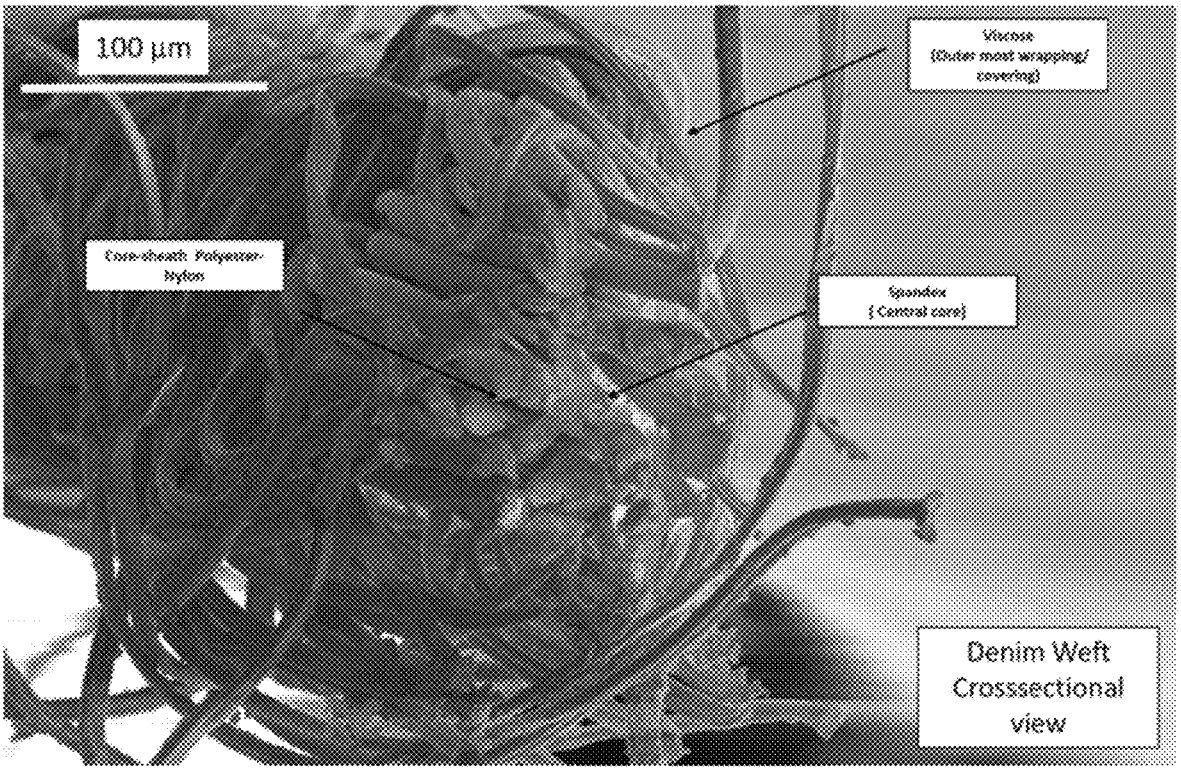
Figure 5:
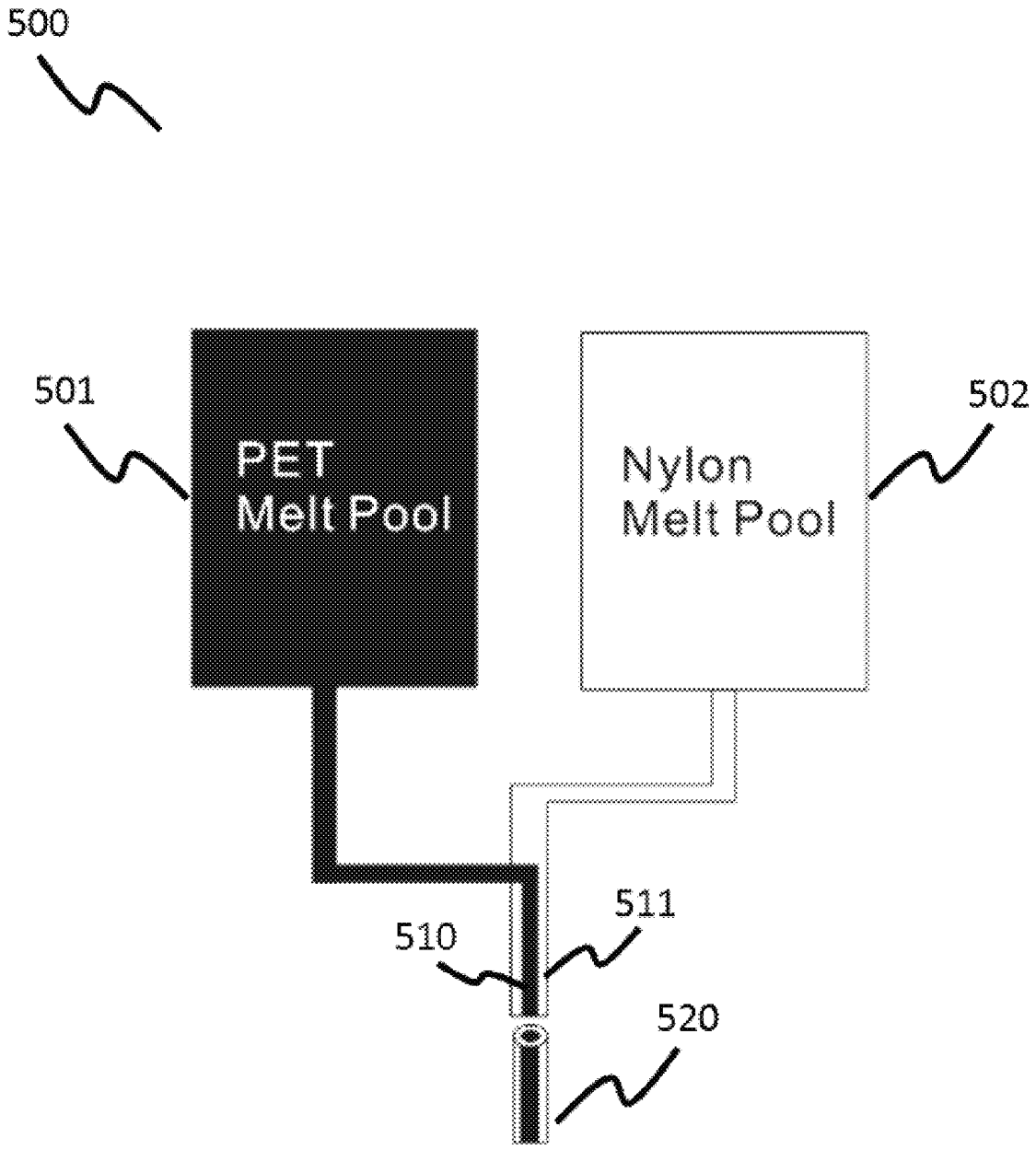
FIG. 5 shows a representative schematic view of a disclosed process, 500, to prepare a disclosed composite fiber with indicia numbers as follows: a reservoir, such as a hopper, having a PET melt pool comprising a PET and a first cooling composition, 501; a reservoir, such as a hopper, having a nylon melt pool comprising a nylon and a second cooling composition, 502; an inner spinneret assembly, 510, for ejecting the core of a composite fiber; an outer spinneret assembly, 511, for ejecting the sheath layer around the core of a composite fiber; and the composite fiber, 520, formed by the process.

Representative scanning electron micrograph (SEM) images are shown in FIGS. 2A-2B of the representative disclosed fabric sample used in this example. Representative SEM images are shown in FIGS. 3A-3B of the warp yarn used in representative disclosed fabric sample of this example. Representative SEM images are shown in FIGS. 4A-4B of the weft yarn used in representative disclosed fabric sample of this example. All SEM images were obtained at the Georgia Electron Microscopy Center (University of Georgia, 151 Barrow Hall, 115 D.W. Brooks Drive, Athens Ga. 30602, USA).

Example 2

Exemplary Disclosed Fabric. A representative disclosed fabric sample was prepared with the following characteristics: 52"×10 oz/sy; aggregate fiber content 72% Cotton, 8% Polyester, 5% Nylon, 13% Rayon, 2% Spandex; warp faced fabric with a 3/1 twill weave pattern with a fabric count of 89×46. The fabric had a warp yarn comprised cotton fibers; and the weft yarn comprised a disclosed double-covered yarn. The yarn count for warp yarn was 62.0 Tex (9.5's/1) and weft yarn is 40.0 Tex (360.0 Denier). The double-covered yarn in the weft yarn comprised a composite fiber comprising a core component and sheath layer that comprised: (a) core component comprising polyester and a cooling composition comprising titanium oxide (0.034-0.05% by weight based on the total weight of the core component; particle size 50-70 μm), silver oxide (0.5-0.912% by weight based on the total weight of the core component; particle size: 20-35.5 nm), and calcium carbonate (0.002-0.01% by weight based on the total weight of the core component; particle size 35-500 μm); and (b) sheath layer of nylon yarn comprising titanium oxide (6.7-10.0% by weight based on the total weight of the sheath layer; particle size 50-70 μm), silver oxide (5-7.0% by weight based on the total weight of the sheath layer; particle size 20-35.5 nm), and calcium carbonate (0.59-2.0% by weight based on the total weight of the sheath layer; particle size 35-500 μm).

The foregoing cooling composition amounts are those as determined in the sheath layer and core component by elemental analysis and quantitative compositional analysis performed using field emission scanning electron microscope (FESEM) carried out with a FEI Teneo scanning electron microscope (FEI, Inc., Hillsboro, Oreg., US) equipped with an extremely large area detector for energy-dispersive spectroscopy (INCA Energy detector; Oxford Instruments, Concord, Mass., US). Elemental analysis capability was provided using the OXFORD XMAX software (Oxford Instruments). The area of analysis was chosen under "Scan Image" option. The raw elemental analysis was carried out under the "Acquire spectra" option and the final average analysis was presented under the "Fitted spectra tool."

Representative scanning electron micrograph (SEM) images are shown in FIGS. 2A-2B of the representative disclosed fabric sample used in this example. Representative SEM images are shown in FIGS. 3A-3B of the warp yarn used in representative disclosed fabric sample of this example. Representative SEM images are shown in FIGS. 4A-4B of the weft yarn used in representative disclosed fabric sample of this example. All SEM images were obtained at the Georgia Electron Microscopy Center (University of Georgia, 151 Barrow Hall, 115 D.W. Brooks Drive, Athens Ga. 30602, USA).

Comparator Fabrics. Comparator fabric used, and shown in Table 2 below, was representative of a commonly available conventional denim fabric. The conventional denim fabric used was: 98.0% cotton, 2.0% spandex, with with a 3/1 twill weave pattern with a fabric count of 78×61 and a weight of 10 ounces/square yard; a yarn count for warp yarn of 67.8 Tex (8.7's/1) and weft yarn was 67.3 Tex (15.8's/1).

The representative disclosed fabric sample and comparator denim sample were subjected to tests to determine the following: (a) Qmax was determined in accordance with FTTS-FA-019 as specified by Committee of Conformity Assessment of Accreditation and Certification on Functional and Technical Textiles (Taiwan); (b) drying time and rates were determined in accordance with AATCC 201 ("Drying Rate of Fabrics: Heated Plate Method"); (c) thermal resistance was determined in accordance with ISO 11092:2014 ("Textiles—Physiological effects—Measurement of thermal and water-vapour resistance under steady-state conditions (sweating guarded-hotplate test)"); and (d) Vertical Wicking was determined in accordance with AATCC 197. The data obtained in these tests are given below in Table 2. All testing was conducted by Intertek Testing Services Taiwan Ltd. (8F, No. 423, Ruiguang Rd., Neihu District, Taipei 11492, Taiwan (R.O.C.).

TABLE 2

| Test Sample | Q max[1] | Thermal Resistance[2] | Air permeability[‡] |
|---|---|---|---|
| Representative disclosed fabric sample | 0.181 | 0.018 | 19.6 |
| Conventional denim fabric sample | 0.155 | n.d. | n.d. |

| Test Sample | Drying Time[†] | Drying Rate[††] | Wicking* | Wicking** |
|---|---|---|---|---|
| Representative disclosed fabric sample | 11.65 | 1.03 | 2 | 2 |
| Conventional denim fabric sample | 22.53 | 0.53 | 13 | 21 |

[1]Reported in W/cm$^2$ and carried out per FTTS-FA-019.
[2]Reported in Km$^2$/W and carried out per ISO 11092: 2014.
[‡]Reported in cfm and carried out per ASTM 737.
[†]Reported in minutes and carried out per AATCC 201.
[††]Reported in ml/hr and carried out per AATCC 201.
*Reported in time (minutes) for water level to reach 20 mm in the length direction and carried out per AATCC 197.
**Reported in time (minutes) for water level to reach 20 mm in the width direction per AATCC 197.

The data in Table 2 show that a representative disclosed fabric, i.e., a disclosed denim fabric comprising a disclosed double-covered yarn and a cotton yarn, has surprisingly superior fabric characteristics as exhibited in the Q max, moisture wicking and drying characteristics. For example, the representative disclosed fabric had a 500% faster rate in moisture wicking compared to a standard denim fabric (cf. a wicking time of 2 minutes for the representative disclosed fabric versus 13 minutes for a standard denim sample), and much improved drying rates (cf. a drying rate of 1.03 ml/hr for the representative disclosed fabric versus 0.53 ml/hr for standard denim fabric under the conditions of the test.

Moreover, the data in Table 2 show an improved Qmax value for the disclosed representative fabric compared to standard denim fabric. In particular, the Qmax value was improved 16.8% compared to standard denim fabric.

In the aggregate, the disclosed representative fabric showed a surprisingly significant improvement in a number of characteristics and properties compared to a conventional denim fabric.

Example 3

Exemplary Disclosed Fabric. As described above for Example 2.

Comparator Fabrics. Comparator fabrics used, and shown in Table 3 below, were representative of a commonly available standard denim fabric or other cooling fabrics. Comparator Fabric A: 9.7 oz/sy; aggregate fiber content was 75% Cotton, 23% Polyester, 2% Lycra Elastane; warp faced fabric with a 3/1 twill weave pattern with fabric count of 116×66. Comparator Fabric B: 11 oz/sy; aggregate fiber content was 70% Cotton, 28% Polyester, 2% Spandex; warp faced fabric with a 3/1 twill weave pattern with fabric count of 80×51.

The representative disclosed fabric sample and comparator denim sample were subjected to tests to determine the following: (a) Qmax was determined in accordance with FTTS-FA-019 as specified by Committee of Conformity Assessment of Accreditation and Certification on Functional and Technical Textiles (Taiwan); (b) drying time and rates were determined in accordance with AATCC 201 ("Drying Rate of Fabrics: Heated Plate Method"); (c) thermal resistance was determined in accordance with ISO 11092:2014 ("Textiles—Physiological effects—Measurement of thermal and water-vapour resistance under steady-state conditions (sweating guarded-hotplate test)"); and (d) Vertical Wicking was determined in accordance with AATCC 197. The data obtained in these tests are given below in Table 2. All testing was conducted by Intertek Testing Services Taiwan Ltd. (8F, No. 423, Ruiguang Rd., Neihu District, Taipei 11492, Taiwan (R.O.C.).

TABLE 3

| Test Sample | Q max[1] | Thermal Resistance[2] | Air permeability[‡] |
|---|---|---|---|
| Representative disclosed fabric sample | 0.181 | 0.018 | 19.6 |
| Comparator Fabric A | 0.124 | n.d. | 6.27 |
| Comparator Fabric B | 0.115 | n.d. | 7.77 |

| Test Sample | Drying Time[†] | Drying Rate[††] | Wicking* | Wicking** |
|---|---|---|---|---|
| Representative disclosed fabric sample | 11.65 | 1.03 | 2 | 2 |
| Comparator Fabric A | 14.42 | 0.83 | 4 | 19 |
| Comparator Fabric B | 17.17 | 0.70 | 4 | 4 |

[1]Reported in W/cm$^2$ and carried out per FTTS-FA-019.
[2]Reported in Km$^2$/W and carried out per ISO 11092: 2014.
[‡]Reported in cfm and carried out per ASTM 737.
[†]Reported in minutes and carried out per AATCC 201.
[††]Reported in ml/hr and carried out per AATCC 201.
*Reported in time (minutes) for water level to reach 20 mm in the length direction and carried out per AATCC 197.
**Reported in time (minutes) for water level to reach 20 mm in the width direction per AATCC 197.

The data in Table 2 show that a representative disclosed fabric, i.e., a disclosed denim fabric comprising a disclosed double-covered yarn and a cotton yarn, has surprisingly superior fabric characteristics as exhibited in the thermal resistance, air permeability, and improved drying and wicking characteristics. For example, the representative disclosed denim fabric had a 48-57% improvement in Qmax value compared to the comparator conventional cooling denim fabrics, i.e., Comparator Fabrics A and B. It should be noted that the Qmax method determines the maximum heat lost or instantaneous cooling feeling of the fabric between the temperature of 25° C. and 35° C., i.e., a cooling characteristic associated with a short time period.

Moreover, the representative disclosed denim fabric had 50% improvement in moisture wicking compared to the comparator conventional cooling denim fabrics (cf. a wicking time of 2 minutes for the representative disclosed fabric versus 4 minutes for a comparator cooling denim fabrics), and much improved drying rates (cf. a drying rate of 1.03 ml/hr for the representative disclosed fabric versus 0.83 ml/hr for Comparator Fabric A under the conditions of the test).

In the aggregate, the disclosed representative fabric showed a surprisingly significant improvement in a number of characteristics and properties compared to conventional.

Example 4

Exemplary Disclosed Fabric. A representative disclosed fabric sample was prepared using a disclosed single-covered yarn comprising a disclosed composite fiber with a core-sheath structure. The representative disclosed fabric sample had the following characteristics: 8.9 oz/sy; aggregate fiber content 74% Cotton, 5% Polyester, 3% Nylon, 16% viscose, 2% elastane; warp faced fabric with a right hand 3/1 twill weave pattern with a fabric count of 126×124 (warp x weft). The warp yarn comprised 12's cotton yarn and 40 D spandex yarn. The weft yarn comprised a disclosed single-covered yarn as follows: viscose FDY 300 D wrapped around a yarn FDY 150 D/72F (75 D/36F*2 ply) having a thickness of approximately 11.8's comprising a disclosed polyester core-polyamide sheath fiber (PE/PA) FDY 150 D/72F (75/36*2 ply). The weft yarn had the following aggregate composition: 66 wt % viscose, 20 wt % polyester, and 14 wt % nylon. The single-covered yarn in the weft yarn comprised a composite fiber comprising a core component and sheath component that comprised: (a) core component comprising polyester and a first cooling composition comprising (by elemental analysis as described below) 0.56 wt % Al; 0.38 wt % Ca; 0.30 wt % Fe; 0.23 wt % K; 10.69 wt % Mg; 0.56 wt % Na; and 3.64 wt % Si; and (b) sheath component of nylon comprising a second cooling composition 0.94 wt % Al; 0.63 wt % Ca; 0.50 wt % Fe; 0.38 wt % K; 17.81 wt % Mg; 0.94 wt % Na; and 6.06 wt % Si.

The foregoing cooling composition amounts are those as determined in the sheath layer and core component by elemental analysis and quantitative compositional analysis performed using field emission scanning electron microscope (FESEM) carried out with a FEI Teneo scanning electron microscope (FEI, Inc., Hillsboro, Oreg., US) equipped with an extremely large area detector for energy-dispersive spectroscopy (150 mm Oxford XMaxN; Oxford Instruments, Concord, Mass., US). Elemental analysis capability was provided using the Aztec Energy software (Oxford Instruments). The area of analysis was chosen under "Scan Image" option. The raw elemental analysis was carried out under the "Acquire spectra" option and the final average analysis was presented under the "Fitted spectra tool."

Figure 8:
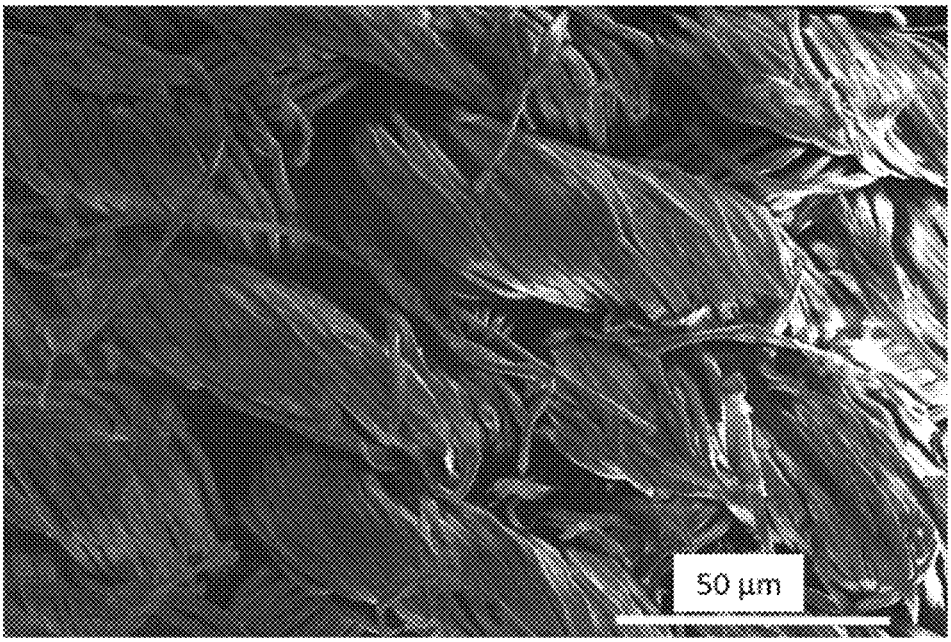
FIG. 8 shows a representative scanning electron micrograph (SEM) image of a disclosed fabric comprising a twill weave comprising a weft yarn comprising a disclosed single-covered yarn; and a warp yarn comprising a cotton yarn. The figure shows a 50 μm scalar bar shown in the lower right of the image.
Figure 9A:
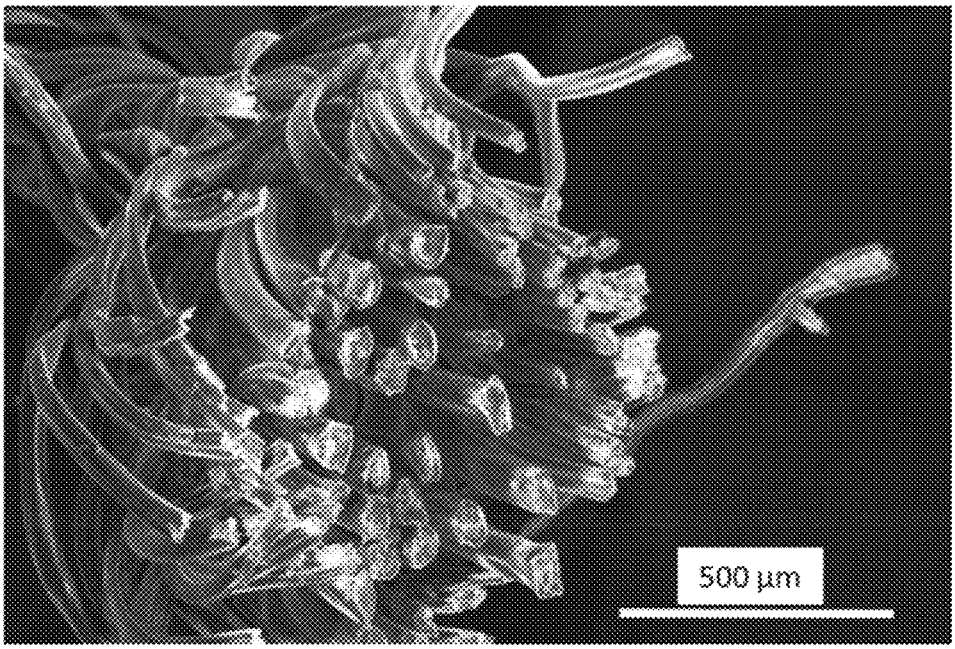
FIGS. 9A-9B show representative scanning electron micrograph (SEM) images cross-sectional ends a disclosed weft yarn comprising a disclosed single-covered yarn.
Figure 9B:
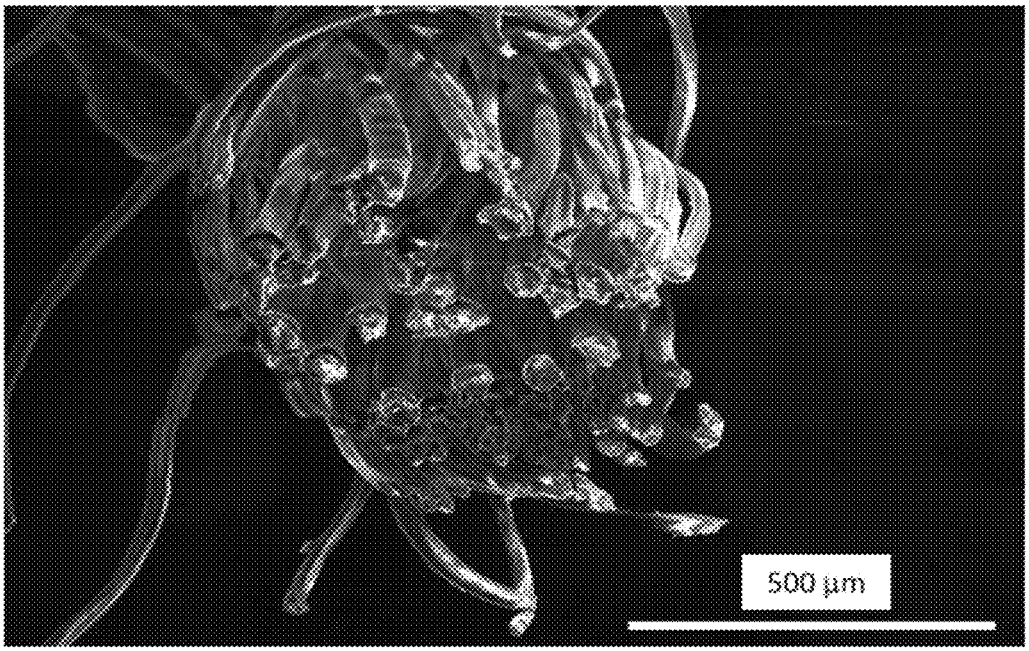
Figure 10:
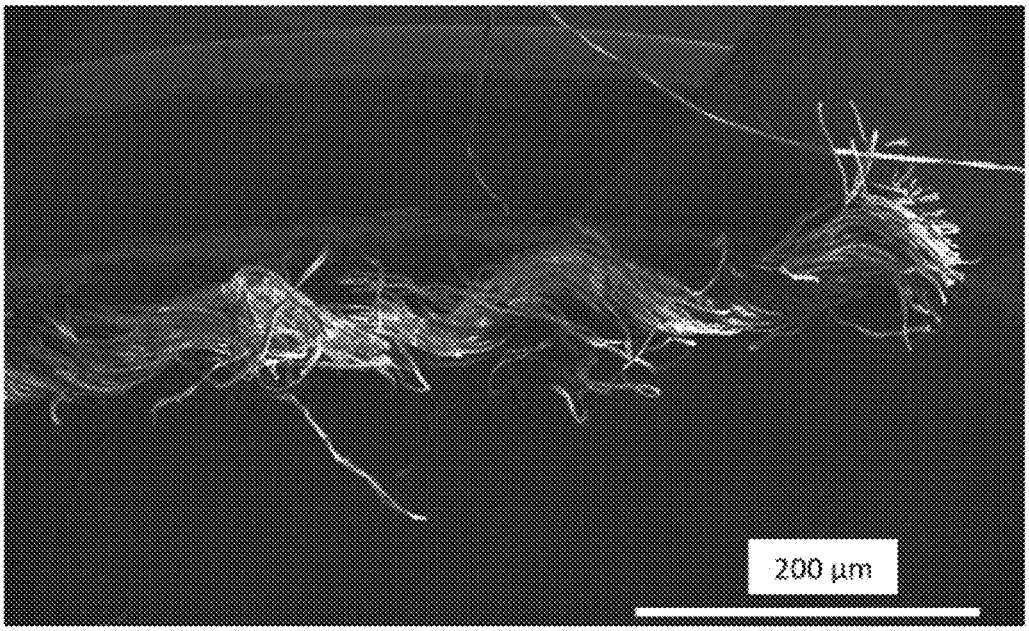
FIG. 10 shows representative scanning electron micrograph (SEM) image of a longitudinal view of a disclosed weft yarn comprising a disclosed single-covered yarn. A 200 μm scalar bar shown in the lower right of the image.

Representative scanning electron micrograph (SEM) images are shown in FIG. 7 of the representative disclosed fabric sample used in this example. Representative SEM images are shown in FIGS. 8-9B of the weft yarn used in representative disclosed fabric sample of this example. All SEM images were obtained at the Georgia Electron Microscopy Center (University of Georgia, 151 Barrow Hall, 115 D.W. Brooks Drive, Athens Ga. 30602, USA).

Conventional Denim Fabric. A conventional denim fabric was used as a comparator fabric used, and was representative of a commonly available conventional denim fabric. The conventional denim fabric used was: 98.0% cotton, 2.0% spandex, with with a 3/1 twill weave pattern with a fabric count of 78×61 and a weight of 10 ounces/square yard; a yarn count for warp yarn of 67.8 Tex (8.7's/1) and weft yarn was 67.3 Tex (15.8's/1).

The representative disclosed fabric sample and comparator denim sample were subjected to tests to determine the following: (a) Qmax was determined in accordance with FTTS-FA-019 as specified by Committee of Conformity Assessment of Accreditation and Certification on Functional and Technical Textiles (Taiwan); (b) drying time and rates were determined in accordance with AATCC 201 ("Drying Rate of Fabrics: Heated Plate Method"); (c) thermal resistance was determined in accordance with ISO 11092:2014 ("Textiles—Physiological effects—Measurement of thermal and water-vapour resistance under steady-state conditions (sweating guarded-hotplate test)"); and (d) Vertical Wicking was determined in accordance with AATCC 197. The data obtained in these tests are given below in Table 4. All testing was conducted by Intertek Testing Services Taiwan Ltd. (8F, No. 423, Ruiguang Rd., Neihu District, Taipei 11492, Taiwan (R.O.C.).

TABLE 4

| Test Sample | Q max[1] | Drying Time[†] | Drying Rate[††] | Wicking* | Wicking** |
|---|---|---|---|---|---|
| Representative disclosed fabric sample | 0.197 | 15.27 | 0.79 | 1 | 1 |
| Conventional denim fabric sample | 0.155 | 22.53 | 0.53 | 13 | 21 |

[1]Reported in W/cm$^2$ and carried out per FTTS-FA-019.
[†]Reported in minutes and carried out per AATCC 201.
[††]Reported in ml/hr and carried out per AATCC 201.
*Reported in time (minutes) for water level to reach 20 mm in the length direction and carried out per AATCC 197.
**Reported in time (minutes) for water level to reach 20 mm in the width direction per AATCC 197.

The data in Table 4 show that a representative disclosed fabric, i.e., a disclosed denim fabric comprising a disclosed single-covered yarn and a cotton yarn, had surprisingly superior fabric characteristics as exhibited in the Q max, moisture wicking and drying characteristics. For example, the representative disclosed fabric had a 13- to 21-fold faster rate in moisture wicking compared to a standard denim fabric (cf. a wicking time of 1 minute for the representative disclosed fabric in each of the length and width directions versus 13 and 21 minutes for a standard denim sample in the length and width directions, respectively), and much improved drying rates (cf. a drying rate of 0.79 ml/hr for the representative disclosed fabric versus 0.53 ml/hr for standard denim fabric under the conditions of the test.

Moreover, the data in Table 4 show a significantly improved Qmax value for the disclosed representative fabric compared to standard denim fabric. In particular, the Qmax value was improved 27.1% compared to standard denim fabric.

In the aggregate, the disclosed representative fabric showed a surprisingly significant improvement in a number of characteristics and properties compared to a conventional denim fabric.

It will be apparent to those skilled in the art that various modifications and variations can be made in the present disclosure without departing from the scope or spirit of the disclosure. Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A double-covered yarn comprising:

(a) an elastic core comprising an elastic yarn;

(b) a first fiber comprising a composite fiber; and (c) a second fiber comprising a cellulosic fiber;

wherein the first fiber is wound around the elastic core to form a single-covered yarn; and wherein the second fiber is wound around the single-covered yarn to form a double-covered yarn;

wherein the composite fiber comprises a core component and a sheath component;

wherein the core component comprises a polyester polymer and a first cooling composition;

wherein the sheath component comprises a polyamide polymer and a second cooling composition;

wherein the first cooling composition is present in an amount of about 1 wt % to about 20 wt % based on the weight of the polyester polymer and the first cooling composition;

wherein the first cooling composition comprises Ag, Al, Ca, Cu, Fe, K, Mg, Si, Ti, or combinations thereof present in at least one ionic or covalent compound;

wherein the second cooling composition is present in an amount of about 1 wt % to about 20 wt % based on the weight of the polyamide polymer and the second cooling composition; and wherein the second cooling composition comprises Ag, Al, Ca, Cu, Fe, K, Mg, Si, Ti, or combinations thereof present in an at least one ionic or covalent compound.

2. The double-covered of claim 1, wherein the first cooling composition comprises one or more of:

(a) Ag in an amount of about 0.1 wt % to about 10 wt % as determined in the composite fiber by elemental analysis;

(b) Al in an amount of about 0.1 wt % to about 1 wt % as determined in the composite fiber by elemental analysis;

(c) Ca in an amount of about 0.1 wt % to about 3 wt % as determined in the composite fiber by elemental analysis;

(d) Cu in an amount of about 0.1 wt % to about 10 wt % as determined in the composite fiber by elemental analysis;

(e) Fe in an amount of about 0.05 wt % to about 3 wt % as determined in the composite fiber by elemental analysis;

(f) K in an amount of about 0.1 wt % to about 3 wt % as determined in the composite fiber by elemental analysis;

(g) Mg in an amount of about 0.01 wt % to about 1.0 wt % as determined in the composite fiber by elemental analysis;

(h) Si in an amount of about 0.1 wt % to about 3 wt % as determined in the composite fiber by elemental analysis; and (i) Ti in an amount of about 0.01 wt % to about 1.0 wt % as determined in the composite fiber by elemental analysis;

wherein the weight percent value is based on the weight of the core component.

3. The double-covered of claim 1, wherein the second cooling composition comprises one or more of:

(a) Ag in an amount of about 0.1 wt % to about 10 wt % as determined in the composite fiber by elemental analysis;

(b) Al in an amount of about 0.1 wt % to about 1 wt % as determined in the composite fiber by elemental analysis;

(c) Ca in an amount of about 0.1 wt % to about 3 wt % as determined in the composite fiber by elemental analysis;

(d) Cu in an amount of about 0.1 wt % to about 10 wt % as determined in the composite fiber by elemental analysis;

(e) Fe in an amount of about 0.05 wt % to about 3 wt % as determined in the composite fiber by elemental analysis;

(f) K in an amount of about 0.1 wt % to about 3 wt % as determined in the composite fiber by elemental analysis;

(g) Mg in an amount of about 0.01 wt % to about 1.0 wt % as determined in the composite fiber by elemental analysis;

(h) Si in an amount of about 0.1 wt % to about 3 wt % as determined in the composite fiber by elemental analysis; and (j) Ti in an amount of about 0.01 wt % to about 1.0 wt % as determined in the composite fiber by elemental analysis;

wherein the weight percent value is based on the weight of the sheath component.

4. The double-covered of claim 1, wherein the composite fiber comprises about 30 wt % to about 60 wt % of the polyester polymer and the first cooling composition and about 30 wt % to about 60 wt % of the polyamide polymer and the second cooling composition; and wherein the weight percent is based upon the weight of the composite fiber.

5. The double-covered of claim 1, wherein the cellulosic fiber is a regenerated cellulosic fiber.

6. The double-covered of claim 5, wherein the regenerated cellulosic fiber is a viscose rayon, a high wet modulus rayon, a cuprammonium rayon, a saponified rayon, a modal rayon, a lyocell rayon, or combinations thereof.

7. The double-covered of claim 6, wherein the regenerated cellulosic fiber is a viscose rayon.

8. The double-covered of claim 1, wherein the composite fiber has a weight of about has a weight of about 130 d/50f to about 180 d/80f.

9. The double-covered of claim 1, wherein the first fiber has a weight of about 100 denier to about 350 denier.

10. The double-covered of claim 1, wherein the elastic core comprises a spandex yarn, a polyester yarn, or combinations thereof.

11. The double-covered of claim 10, wherein the polyester yarn is a yarn comprising polyethylene terephthalate, a polytrimethylene terephthalate, or combinations thereof.

12. The double-covered of claim 11, wherein the polyester yarn comprises a composite filament of polyethylene terephthalate and polytrimethylene terephthalate; and wherein the filament has the polyethylene terephthalate and polytrimethylene terephthalate arranged side-by-side.

13. The double-covered of claim 1, wherein the elastic core comprises a spandex yarn and a polyester yarn comprising polyethylene terephthalate, a polytrimethylene terephthalate, or combinations thereof.

14. The double-covered of claim 1, wherein the elastic yarn has a weight of about 30 denier to about 50 denier.

15. The double-covered of claim 1, wherein the second yarn has a weight of about 105 d/20f to about 130 d/40f.

16. The double-covered of claim 1, wherein the double-covered yarn has a weight of about 250 denier to about 350 denier.

17. An article comprising the double-covered yarn of any one of claim 1.

18. The article of claim 17, wherein the article is an article of clothing.

19. A fabric comprising:

a weft yarn comprising the double-covered yarn of claim 1; and a warp yarn comprising cotton fibers.

20. The fabric of claim 19, wherein the warp yarn is a cotton yarn having a weight of about 8's to about 50's.

* * * * *